US005609999A

United States Patent [19]

Aida et al.

[11] Patent Number: 5,609,999

[45] Date of Patent: Mar. 11, 1997

[54] SILVER HALIDE COLOR PHOTOGRAPHIC MATERIAL

[75] Inventors: Shunichi Aida; Keisuke Matsumoto; Toshiyuki Watanabe; Koji Wariishi, all of Minami-ashigara, Japan

[73] Assignee: Fuji Photo Film Co., Ltd., Kanagawa, Japan

[21] Appl. No.: 524,462

[22] Filed: Sep. 7, 1995

[30] Foreign Application Priority Data

Sep. 8, 1994 [JP] Japan ..... 6-239623
Sep. 30, 1994 [JP] Japan ..... 6-259745

[51] Int. Cl.[6] ..... G03C 1/46

[52] U.S. Cl. ..... 430/505; 430/506; 430/510; 430/517; 430/522; 430/544; 430/957; 430/607; 430/611; 430/558; 430/567; 430/585; 430/587

[58] Field of Search ..... 430/505, 506, 430/510, 517, 522, 585, 558, 567, 544, 957, 607, 611, 379, 587

[56] References Cited

U.S. PATENT DOCUMENTS 4,940,654 10/1990 Diehl et al. ..... 430/522
5,213,957 5/1993 Adachi ..... 430/522
5,278,037 1/1994 Karino ..... 430/517
5,296,344 3/1994 Jimbo et al. ..... 430/522
5,326,686 7/1994 Katoh et al. ..... 430/517
5,326,687 7/1994 Texter ..... 430/510
5,346,810 9/1994 Ohno ..... 430/522
5,380,634 1/1995 Kiekens et al. ..... 430/510
5,459,026 10/1995 Nakamura et al. ..... 430/587

FOREIGN PATENT DOCUMENTS 1-303437 12/1989 Japan .
3-127048 5/1991 Japan .

*Primary Examiner*—Geraldine Letscher
*Attorney, Agent, or Firm*—Birch, Stewart, Kolasch & Birch, LLP

[57] ABSTRACT

A silver halide color photographic material can be formed which exhibits good storage stability and provides excellent sharpness and superior color reproducibility by incorporating therein a dye comprising an indole moiety having a methyl group substituted by an electron-withdrawing group at the 1-position and an acidic nucleus which are connected together via a methine chain. The dye is typically provided in a light-insensitive layer in the form of a solid dispersion. Specific embodiments include the combination of the indole-containing dye with a magenta dye, fogged silver halide grains, a DIR compound or a mercaptoheterocyclic compound.

19 Claims, No Drawings

SILVER HALIDE COLOR PHOTOGRAPHIC MATERIAL

FIELD OF THE INVENTION

The present invention relates to a silver halide photographic material, more specifically, to a silver halide color photographic material capable of exhibiting excellent sharpness and color reproducibility and improved in storage stability. Still more specifically, the present invention relates to a high-sensitivity silver halide color photographic material capable of exhibiting excellent saturation in color reproduction, improved with respect to the adverse effect on the color reproduction due to the change in the color temperature of a light source and having excellent raw stock storability (i.e., with respect to the change in capability during the storage of a photographic material from the coating and production to the camera working and development processing).

BACKGROUND OF THE INVENTION

In a silver halide photographic material, a layer which absorbs light at a specific wavelength is commonly provided so as to prevent irradiation or halation or to control the sensitivity. For example, it is most common in practice to provide a yellow filter at the site closer to the support than the blue-sensitive layer but father from the support than other light-sensitive layers so as to cut the intrinsic sensitivities of the green- and red-sensitive layers.

The above-described light-absorbing layer usually uses fine grain colloidal silver. However, the colloidal silver grain may cause detrimental fogging in an emulsion layer adjacent to the light-absorbing layer or may be responsible for the increase in fogging during storage of the photographic material. In order to overcome these problems, it is proposed and partly employed in practice to use an organic dye in place of colloidal silver.

For example, a method where a specific layer is dyed using a solid fine grain of a water-insoluble dye is disclosed in JP-A-56-123639 (the term "JP-A" as used herein means an "unexamined published Japanese patent application"), JP-A-63-197943, European Patents 15601, 274723 and 299435 and U.S. Pat. No. 4,950,586.

In particular, a method where a solid dispersion of a dye comprising an acidic nucleus bonded to a 5-membered heterocyclic ring through a methine chain is described in JP-A-55-155351, JP-A-3-144438, JP-B-48-42175 (the term "JP-B" as used herein means an "examined Japanese patent publication"), European Patent No. 524594 and U.S. Pat. No. 4,923,788.

Further, JP-A-3-167546 describes the use of a compound consisting of a pyrazolone nucleus and an indole nucleus (or a pyrrole nucleus) as a photographic dye.

However, these techniques are still bound to such a problem that the decoloration speed at the development processing is slow, the decoloration cannot be completely effected even if a long time is spent, or the decoloration property varies due to the fluctuation in processings. This problem is a fatal defect for the photographic material to be observed directly such as color reversal film.

On the other hand, if the decoloration property is satisfied, another problem arises such that the fixability to the specific layer is insufficient to cause diffusion of the dye to other layers during the storage of the photographic material and thereby adversely affect the photographic capability.

Further, the solid dispersion of a dye has an unnecessary absorption and therefore, the sensitivity may be reduced in some cases.

Accordingly, a dye compound satisfied in the fixability (diffusion resistance) and at the same time, the decoloration property and exhibiting excellent absorption characteristics has been demanded.

With respect to the anti-irradiation method, U.S. Pat. No. 3,409,433 describes a method where a dye is added to an emulsion layer, which is, however, accompanied by the loss of sensitivity, imposing restrictions in designing a high-sensitivity photographic material.

Further, with respect to the method for dyeing a light-insensitive layer, a method is described, for example, in JP-A-61-292636, JP-A-61-295550, JP-A-62-10650 and JP-A-62-103641, however, the dyeing site therein is different from that of the present invention.

Furthermore, JP-A-1-105947 and JP-A-1-222257 describe a structure such that a light-insensitive layer is provided on the support side of a green-sensitive layer and the light-insensitive layer contains a nondiffusible dye having a spectral absorption maximum at from 500 to 600 nm, which is, however, different from the structure of the present invention and by no means provides effects as achieved in the present invention.

On the other hand, as a magenta dye-forming coupler, a 5-pyrazolone coupler has been commonly used. However, the dye formed from this coupler has side absorption of the yellow component, which gives rise to reduction in the color reproducibility. A pyrazoloazole-type magenta coupler capable of reducing the above-described side absorption has been investigated and is broadly attracting an attention. For example, U.S. Pat. No. 3,725,067, JP-A-60-172982, JP-A-60-33552, JP-A-61-72238 and U.S. Pat. Nos. 4,500,630, 4,540,654 and 5,021,325 describe this type of couplers.

For a silver halide color photographic material, it is an important feature to have good color reproducibility. In particular, the elementary colors such as red, blue and green have a strong impact on the eye of human beings and therefore, various attempts have hitherto been made to improve saturation in the reproduction of these elementary colors. However, as an adverse effect therefrom, another problem arises such that the change in coloration after development processing is intensified due to the change in the color temperature of a light source, for example, between fine weather and cloudy weather or between in the sun and in the shade in fine weather. Out of the silver halide color photographic materials, the color negative film is printed after development processing on a color printing paper and then subjected to viewing and therefore, the coloration may be corrected at the printing on the color printing paper, whereas the silver halide color reversal photographic material for camera work is subjected after development processing directly to the viewing and so, the above-described problem is serious for this type of photographic material.

JP-A-1-303437 describes that the color reproduction is improved by combining a compound having the same object with but different structure from that of formula (i) of the present invention with a means for achieving an interimage effect, however, in the photographic material of the present invention, the change in capability during storage of the photographic material is a matter of concerns and also, no clear description is found in the publication to state that the color temperature dependency can be improved.

SUMMARY OF THE INVENTION

Accordingly, an object of the present invention is to provide a silver halide photographic material improved in the capability of a yellow filter dye which has hitherto been insufficient, having excellent storage stability and capable of exhibiting superior sharpness and color reproducibility.

Another object of the present invention is to provide a high-sensitivity silver halide color photographic material, particularly, a high-sensitive silver halide color reversal photographic material, capable of exhibiting excellent saturation in color reproduction, improved with respect to the adverse effect on the color reproduction due to the change in the color temperature of a light source and having excellent raw stock storability.

The former object of the present invention can be achieved by a silver halide photographic material having the following constitution (1) or (2):

(1) a silver halide color photographic material comprising a support having thereon a light-insensitive layer and, in the order from the support side, a red-sensitive layer, a green-sensitive layer and a blue-sensitive layer, wherein the light-insensitive layer between the green-sensitive layer and the blue-sensitive layer contains at least one fine grain solid dispersion of a yellow dye represented by formula (I) and the light-insensitive layer between the red-sensitive layer and the green-sensitive layer contains at least one fine grain solid dispersion of a magenta dye represented by formula (II):

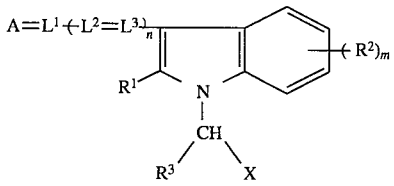

(I)

wherein A represents an acidic nucleus, $L^1$, $L^2$ and $L^3$ each represents a methine group which may be substituted, $R^1$ and $R^3$each represents a hydrogen atom or a substituent (including a substitutional atom), $R^2$ represents a substituent (including a substitutional atom), n represents 0 or 1, m represents 0 or an integer of from 1 to 4, provided that when m is an integer of from 2 to 4, the $R^2$ groups may be the same or different, and X represents an electron-withdrawing group having a Hammett's substituent constant $\tau_m$ of from 0.3 to 1.5;

$$D\text{-}(X)_y \qquad \text{(II)}$$

wherein D represents a compound having a chromophore, X represents a dissociative proton bonded to D directly or through a divalent linking group or a group having the dissociative proton and y represents an integer of from 1 to 7; or (2) the silver halide color photographic material as described in (1), wherein at least one silver halide emulsion layer contains a coupler represented by formula (M):

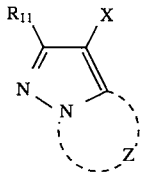

(M)

wherein $R_{11}$ represents a hydrogen atom or a substituent, Z represents a nonmetallic atom group necessary for forming a 5-membered azole ring containing from 2 to 4 nitrogen atoms, provided that the azole ring may have a substituent (including a condensed ring), and X represents a hydrogen atom or a group capable of splitting off upon coupling reaction with an oxidation product of the developing agent.

The latter object can be achieved by:

(3) a silver halide color photographic material comprising a blue-sensitive silver halide emulsion layer containing a yellow coupler, a green-sensitive silver halide emulsion layer containing a magenta coupler and a red-sensitive silver halide emulsion layer containing a cyan coupler, the silver halide emulsion layers each being consisting of at least two silver halide emulsion layers having different sensitivities from each other, wherein the silver halide color photographic material comprises at least one hydrophilic colloid layer containing at least one solid disperse dye of the compound represented by formula (i) and satisfies at least one of the following requirements (a) to (c):

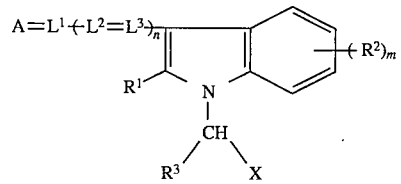

(i)

wherein A represents an acidic nucleus having at least one carboxyl group, $L^1$, $L^2$ and $L^3$ each represents a methine group which may be substituted, $R^1$ and $R^3$ each represents a hydrogen atom or a substituent (including a substitutional atom), $R^2$ represents a substituent (including a substitutional atom), n represents 0 or 1, m represents 0 or an integer of from 1 to 4, provided that when m is an integer of from 2 to 4, the $R^2$ groups may be the same or different, and X represents an electron-withdrawing group having a Hammett's substituent constant $\tau_m$ of from 0.3 to 1.5;

(a) a surface- and/or inside-fogged silver halide emulsion is contained in a light-sensitive silver halide emulsion layer or a layer adjacent to a light-sensitive silver halide emulsion layer;

(b) a DIR compound represented by formula (F) is contained;

$$A\text{—}(L)_n\text{—}(G)_m\text{—}(Time)_t\text{—}X \qquad \text{(F)}$$

wherein A represents a redox mother nucleus or a precursor thereof which is a group able to first allow the $\text{-}(Time)_2\text{-}X$ to split off when the group is oxidized in the process of photographic development processing, Time represents a group capable of releasing X after the release of the $\text{-}(Time)_t\text{-}X$ group and may have a timing controlling function, X represents a development inhibitor, L represents a divalent linking group, G represents an acidic group and n, m and t each represents 0 or 1, provided that when n is 1, m is not 0; and (c) a compound represented by formula (ii) is contained in at least one emulsion layer:

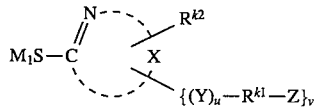

(ii)

wherein $M_1$ represents a hydrogen atom, a cation or a protective group of the mercapto group to be cleaved in alkali, X represents an atomic group necessary for forming a 5- or 6-membered heterocyclic ring, with two or three nitrogen atoms being present in the five or six atoms constituting the heterocyclic ring, $R^{k1}$ represents a linear or branched alkylene, alkenylene, aralkylene or arylene group, Y represents a divalent polar linking group, $R^{k2}$ represents a hydrogen atom or a group capable of substitution thereto, Z represents a polar substituent, u represents 0 or 1 and v represents 0, 1 or 2;

(4) the silver halide color photographic material as described in (3), wherein the silver halide color photographic material satisfies requirement (d):

(d) a relation as defined by the following expressions is present between the average iodide content of a low speed green-sensitive silver halide emulsion layer (AgI(GL)) and the average iodide content of a low speed blue-sensitive silver halide emulsion layer (AgI(BL)), and between the average iodide content of a low speed green-sensitive silver halide emulsion layer (AgI(GL)) and the average iodide content of a low speed red-sensitive silver halide emulsion layer (AgI(RL)):

$$2 \leqq \{AgI(GL)/AgI(BL)\} \leqq 0.9$$

$$2 \leqq \{AgI(GL)/AgI(RL)\} \leqq 0.9$$

(5) the silver halide color photographic material as described (3) or (4), wherein the silver halide color photographic material is a silver halide color reversal photographic material for camera work.

DETAILED DESCRIPTION OF THE INVENTION

The present invention will be described below in detail.

The compound of formula (I) will be described.

The acidic nucleus represented by A is preferably 5-pyrazolone, isooxazolone, barbituric acid, thiobarbituric acid, pyrazolopyridone, rhodanine, hydantoin, thiohydantoin, oxazolidinedione, pyrazolidinedione, indandione, hydroxypyridone, 1,2,3,4 -tetrahydroquinoline-2,4-dione or 3-oxo-2,3-dihydrobenzo[d]thiophene-1,1 -dioxide, more preferably 5-pyrazolone, hydroxypyridone, pyrazolopyridone, barbituric acid or isooxazolone, more preferably 5-pyrazolone.

The acidic nucleus represented by A preferably has at least one carboxyl group.

Examples of the electron-withdrawing group having a Hammett's substituent constant $a_m$ (for example, described in *Chem. Rev.*, 91,165 (1991)) of from 0.3 to 1.5 represented by X include a halogen atom (e.g., fluorine atom ($\tau_m$ value=0.34, hereinafter the same), chlorine atom (0.37), bromine atom (0.39), iodine atom (0.35)), a trifluoromethyl group (0.43), a cyano group (0.56), a formyl group (0.35), an acyl group (e.g., acetyl (0.38)), an acyloxy group (e.g., acetoxy (0.39)), a carboxyl group (0.37), an alkoxycarbonyl group (e.g., methoxycarbonyl (0.37), ethoxycarbonyl (0.37)), an aryloxycarbonyl group (e.g., phenoxycarbonyl (0.37)), an alkylcarbamoyl group (e.g., methylcarbamoyl (0.35)), a nitro group (0.71), an alkylsulfinyl group (e.g., methylsulfinyl (0.52)), an alkylsulfonyl group (e.g., methylsulfonyl (0.60)) and a sulfamoyl group (0.53). Among these, preferred are an alkoxycarbonyl group and a cyano group and more preferred is an alkoxycarbonyl group.

The methine group represented by $L^1$, $L^2$ or $L^3$ may have a substituent (e.g., a methyl group, an ethyl group, a cyano group, a chlorine atom) but is preferably not substituted and n is preferably 0.

Examples of the substituent represented by $R^1$, $R^2$ or $R^3$ include a substituted or unsubstituted alkyl group having from 1 to 8 carbon atoms (e.g., methyl, ethyl, propyl, isopropyl, n-butyl, isobutyl, sec-butyl, t-butyl, cyclohexyl, methoxyethyl, ethoxyethyl, ethoxycarbonylmethyl, ethoxycarbonylethyl, cyanoethyl, diethylaminoethyl, hydroxyethyl, chloroethyl, acetoxyethyl), a substituted or unsubstituted aralkyl group having from 7 to 12 carbon atoms (e.g., benzyl, 2-carboxybenzyl), a substituted or unsubstituted aryl group having from 6 to 18 carbon atoms (e.g., phenyl, 4-methylphenyl, 4-methoxyphenyl, 4-carboxyphenyl, 3,5-dicarboxyphenyl), a substituted or unsubstituted acyl group having from 2 to 6 carbon atoms (e.g., acetyl, propionyl, butanoyl, chloroacetyl), a substituted or unsubstituted sulfonyl group having from 1 to 8 carbon atoms (e.g., methanesulfonyl, p-toluenesulfonyl), an alkoxycarbonyl group having from 2 to 6 carbon atoms (e.g., methoxycarbonyl, ethoxycarbonyl), an aryloxycarbonyl group having from 7 to 12 carbon atoms (e.g., phenoxycarbonyl, 4-methylphenoxycarbonyl, 4-methoxyphenoxycarbonyl), a substituted or unsubstituted alkoxy group having from 1 to 4 carbon atoms (e.g., methoxy, ethoxy, n-butoxy, methoxyethoxy), a substituted or unsubstituted aryloxy group having from 6 to 10 carbon atoms (e.g., phenoxy, 4-methoxyphenoxy), a substituted or unsubstituted acyloxy having from 2 to 8 carbon atoms (e.g., acetoxy, ethylcarbonyloxy, cyclohexylcarbonyloxy, benzoyloxy, chloroacetyloxy), a substituted or unsubstituted sulfonyloxy group having from 1 to 6 carbon atoms (e.g., methanesulfonyloxy), a carbamoyloxy group having from 2 to 8 carbon atoms (e.g., methylcarbamoyloxy, diethylcarbamoyloxy), a substituted or unsubstituted amino group having from 0 to 8 carbon atoms (e.g., unsubstituted amino, methylamino, dimethylamino, diethylamino, phenylamino, methoxyphenylamino, chlorophenylamino, morpholino, piperidino, pyrrolidino, pyridylamino, methoxycarbonylamino, n-butoxycarbonylamino, phenoxycarbonylamino, methylcarbamoylamino, phenylcarbamoylamino, acetylamino, ethylcarbonylamino, cyclohexylcarbonylamino, benzoylamino, chloroacetylamino, methylsulfonylamino), a substituted or unsubstituted carbamoyl group having from 1 to 8 carbon atoms (e.g., unsubstituted carbamoyl, methylcarbamoyl, ethylcarbamoyl, n-butylcarbamoyl, t-butylcarbamoyl, dimethylcarbamoyl, morpholinocarbamoyl, pyridinocarbamoyl), a substituted or unsubstituted sulfonamido group having from 1 to 8 carbon atoms (e.g., methanesulfonamido, p-toluenesulfonamido), a halogen atom (e.g., fluorine, chlorine, bromine), a hydroxyl group, a nitro group, a cyano group and a carboxyl group.

$R^1$ is preferably a hydrogen atom or a substituent selected from an alkyl group, an aryl group, an alkoxycarbonyl group and an aryloxycarbonyl group, more preferably a hydrogen atom.

m is preferably 0, 1 or 2 and when m is 1 or 2, $R^2$ is preferably a substituent selected from an alkyl group, an aryl group, an amino group, an alkoxy group, an acyloxy group, a carbamoyl group, a halogen atom, a nitro group and a carboxyl group. m is more preferably 0.

$R^3$ is preferably a hydrogen atom or a substituent selected from an alkyl group and an aryl group, more preferably an alkyl group.

A preferred combination is such that the acidic nucleus represented by A is 5-pyrazolone, hydroxypyridone, pyrazolopyridone, barbituric acid or isooxazolone, n is 0, m is 0, $R^1$ is a hydrogen atom, $R^3$ is a hydrogen atom or an alkyl group and X is an alkoxycarbonyl group or a cyano group.

A more preferred combination is such that the acidic nucleus represented by A is 5-pyrazolone, n is 0, m is 0, $R^1$ is a hydrogen atom, $R^3$is an alkyl group and X is an alkoxycarbonyl group.

Examples of the substituent which the above-described groups each may have include a carboxylic acid group, a sulfonamido group having from 1 to 10 carbon atoms (e.g., methanesulfonamido, benzenesulfonamido, butanesulfonamido, n-octanesulfonamido), a sulfamoyl group having from 1 to 10 carbon atoms (e.g., unsubstituted sulfamoyl, methylsulfamoyl, phenylsulfamoyl, butylsulfamoyl), a sulfonylcarbamoyl group having from 2 to 10 carbon atoms (e.g., methanesulfonylcarbamoyl, propanesulfonylcarbamoyl, benzenesulfonylcarbamoyl), an acylsulfamoyl group having from 1 to 10 carbon atoms (e.g., acetylsulfamoyl, propionylsulfamoyl, pivaloylsulfamoyl, benzoylsulfamoyl), a chained or cyclic alkyl group having from 1 to 8 carbon atoms (e.g., methyl, ethyl, isopropyl, butyl, hexyl, cyclopropyl, cyclopentyl, cyclohexyl, 2-hydroxyethyl, 4-carboxybutyl, 2-methoxyethyl, benzyl, phenetyl, 4-carboxybenzyl, 2-diethylaminoethyl), an alkenyl group having from 2 to 8 carbon atoms (e.g., vinyl, allyl), an alkoxy group having from 1 to 8 carbon atoms (e.g., methoxy, ethoxy, butoxy), a halogen atom (e.g., F, Cl, Br), an amino group having from 0 to 10 carbon atoms (e.g, unsubstituted amino, dimethylamino, diethylamino, carboxyethylamino), an ester group having from 2 to 10 carbon atoms (e.g., methoxycarbonyl), an amido group having from 1 to 10 carbon atoms (e.g., acetylamino, benzamido), a carbamoyl group having from 1 to 10 carbon atoms (e.g., unsubstituted carbamoyl, methylcarbamoyl, ethylcarbamoyl), an aryl group having from 6 to 10 carbon atoms (e.g., phenyl, naphthyl, 4-carboxyphenyl, 3-carboxyphenyl, 3,5-dicarboxyphenyl, 4-methanesulfonamidophenyl, 4-butanesulfonamidophenyl), an aryloxy group having from 6 to 10 carbon atoms (e.g., phenoxy, 4-carboxyphenoxy, 3-methylphenoxy, naphthoxy), an alkylthio group having from 1 to 8 carbon atoms (e.g., methylthio, ethylthio, octylthio), an arylthio group having from 6 to 10 carbon atoms (e.g., phenylthio, naphthylthio), an acyl group having from 1 to 10 carbon atoms (e.g., acetyl, benzoyl, propanoyl), a sulfonyl group having from 1 to 10 carbon atoms (e.g., methanesulfonyl, benzenesulfonyl), a ureido group having from 1 to 10 carbon atoms (e.g., ureido, methylureido), a urethane group having from 2 to 10 carbon atoms (e.g., methoxycarbonylamino, ethoxycarbonylamino), a cyano group, a hydroxyl group, a nitro group and a heterocyclic group (e.g., 5-carboxybenzoxazole ring, pyridine ring, sulforane ring, pyrrole ring, pyrrolidine ring, morpholine ring, piperazine ring, pyrimidine ring, furan ring).

Specific examples of the compound represented by formula (I) are set forth below.

(I-1)

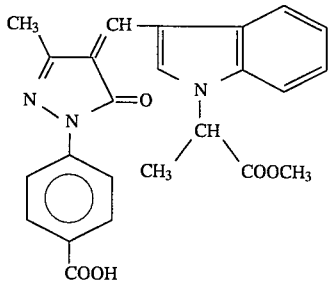

-continued (I-2)

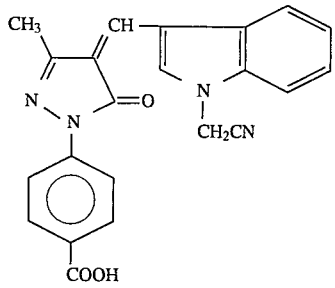

(I-3)

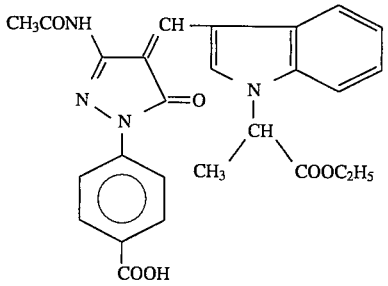

(I-4)

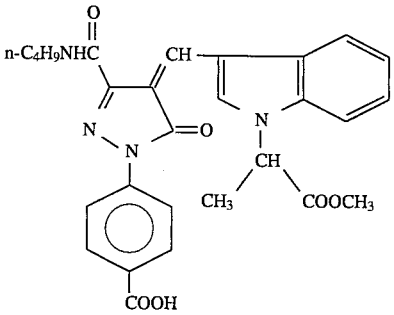

(I-5)

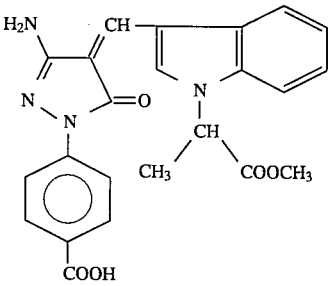

(I-6)

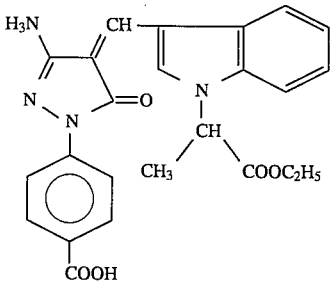

-continued
(I-7)
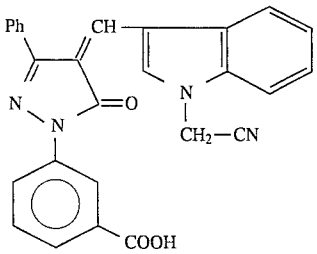
(I-8)
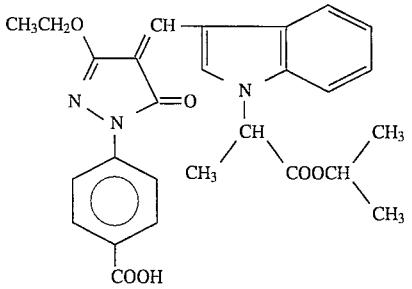
(I-9)
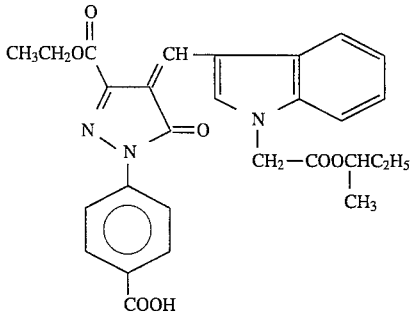
(I-10)
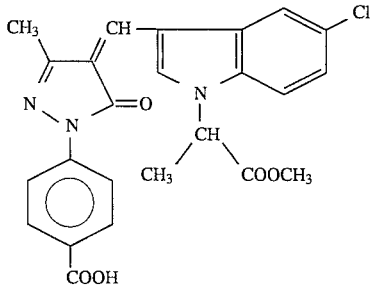
(I-11)
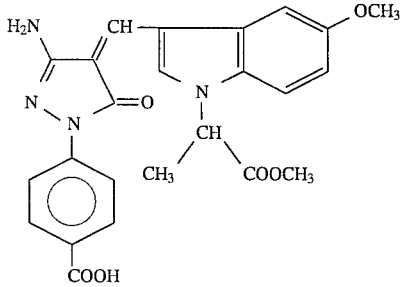
-continued
(I-12)
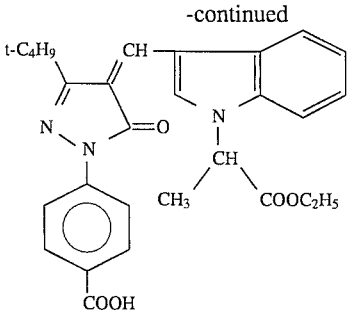
(I-13)
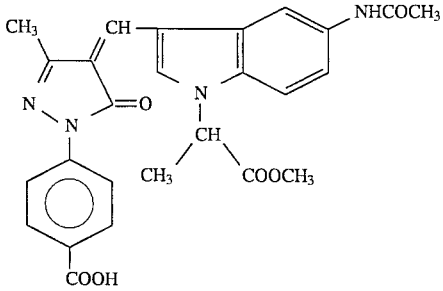
(I-14)
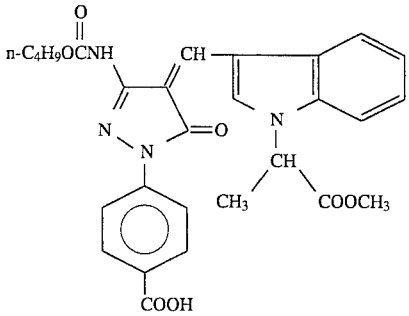
(I-15)
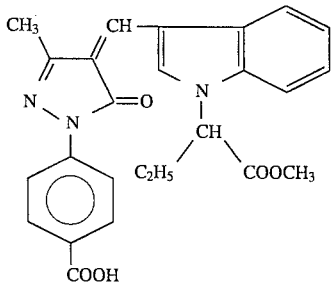
(I-16)
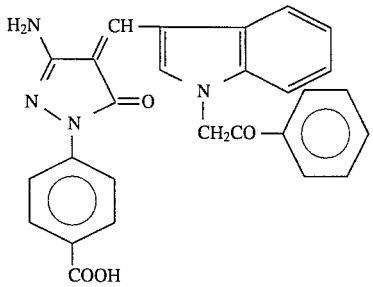

-continued
(I-17)
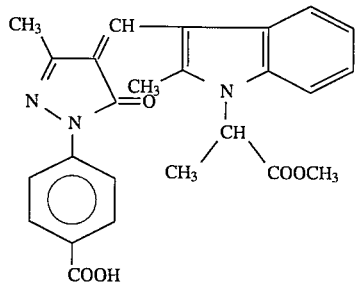
(I-18)
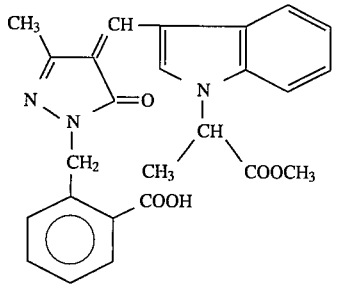
(I-19)
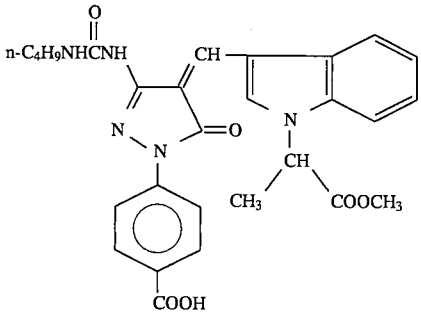
(I-20)
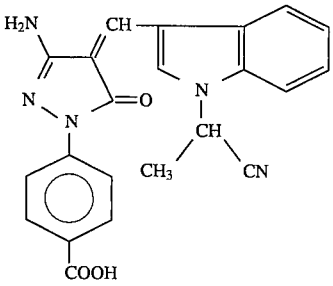
(I-21)
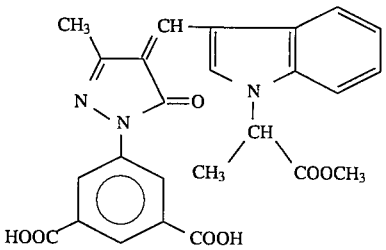
-continued
(I-22)
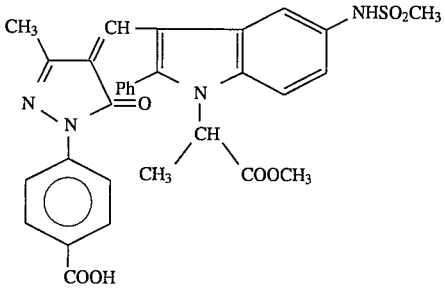
(I-23)
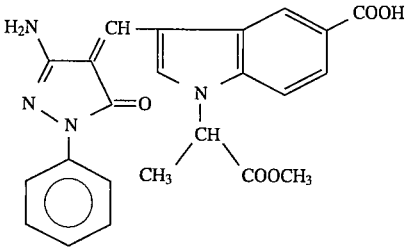
(I-24)
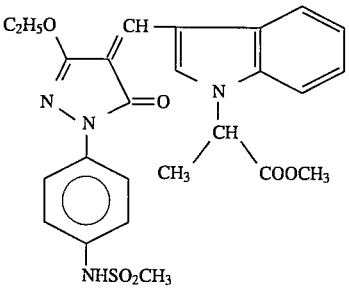
(I-25)
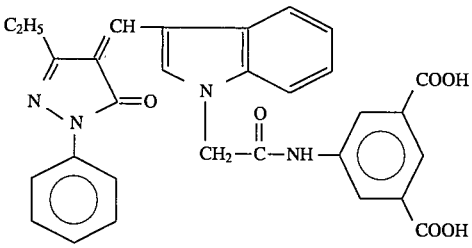
(I-26)
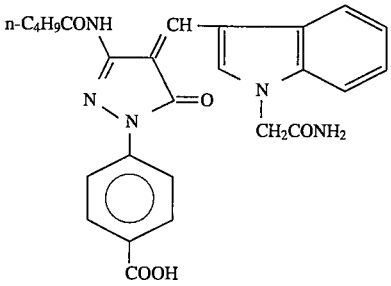
(I-27)
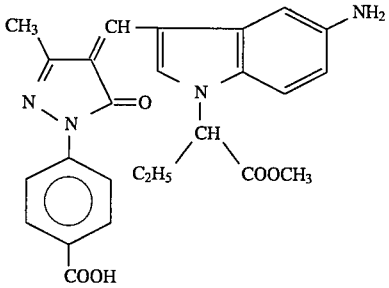

-continued
(I-28)
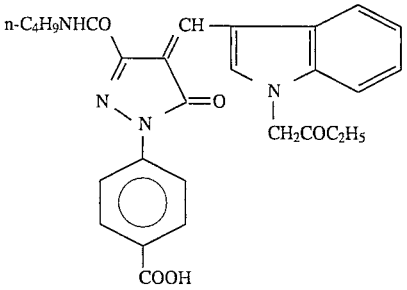
(I-29)
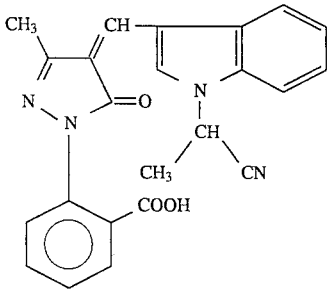
(I-30)
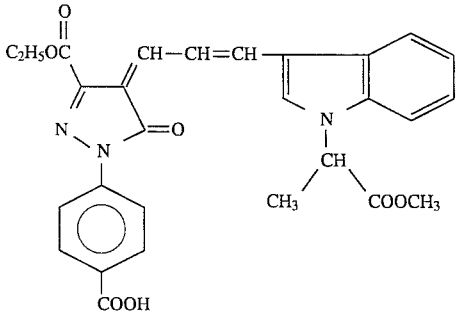
(I-31)
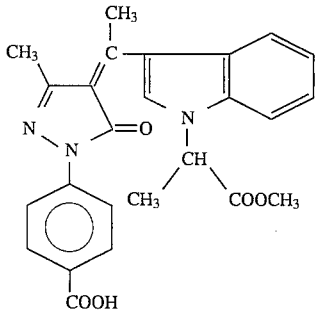
(I-32)
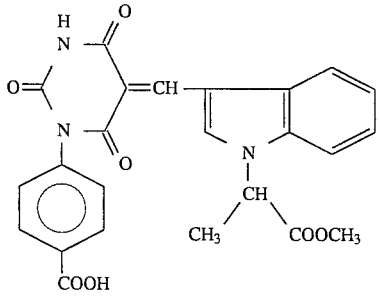
-continued
(I-33)
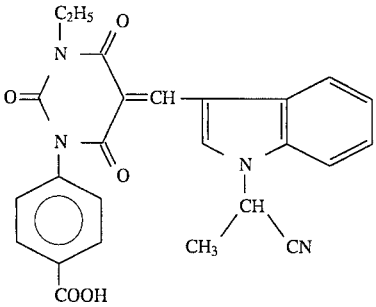
(I-34)
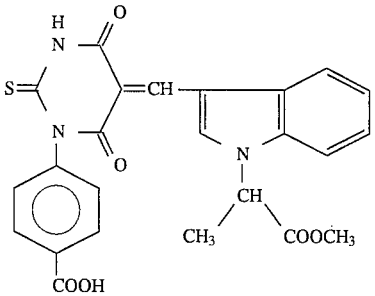
(I-35)
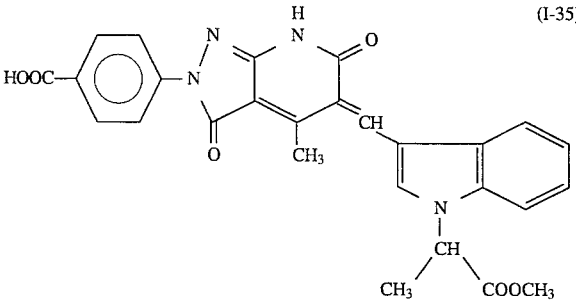
(I-36)
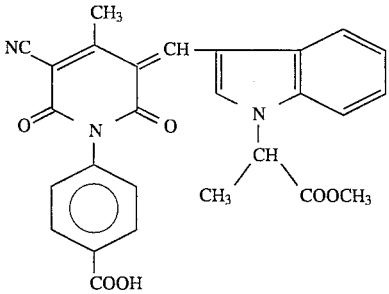
(I-37)
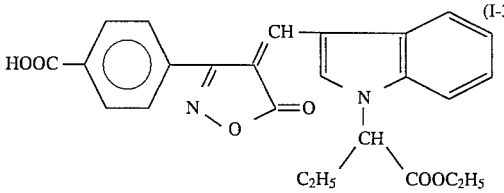
(I-38)
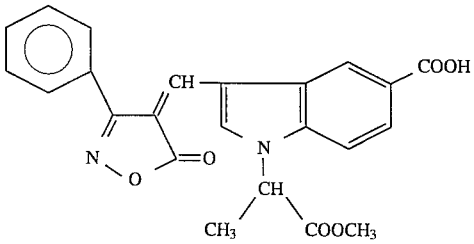

-continued

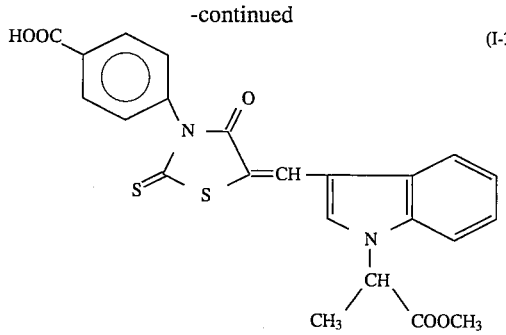

(I-39)

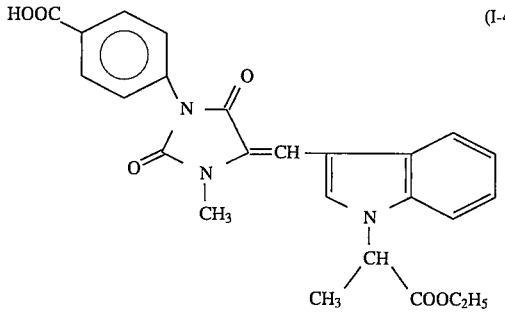

(I-40)

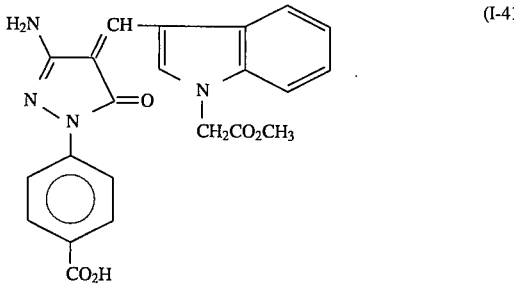

(I-41)

The compound represented by formula (I) of the present invention can be produced in the same manner as in the case of the compound represented by formula (i) of the present invention, as described below.

The silver halide color photographic material in constitution (3) of the present invention comprises a hydrophilic colloid layer containing at least one solid disperse dye of a compound represented by formula (i). The solid disperse dye of the compound represented by formula (i) is not particularly limited on its absorption characteristics but it is preferably used as a yellow filter as described below.

In the silver halide color photographic material for camera work for providing a high-quality image, the general layer arrangement is such that among light-sensitive silver halide emulsion layers, a blue-sensitive silver halide emulsion layer is disposed closest to the light source, a yellow filter layer is disposed closer to the support than the blue-sensitive silver halide emulsion layer and a green-sensitive silver halide emulsion layer and a red-sensitive silver halide emulsion layer are in this order disposed closer to the support. This constitution is most suitable of color separation because the silver halide emulsion in the green-sensitive silver halide emulsion layer and the red-sensitive silver halide emulsion layer has an intrinsic absorbance to blue light and the red sensitivity of the green-sensitive silver halide emulsion layer is prone to be higher than the green sensitivity of the red-sensitive silver halide emulsion layer.

The conventional yellow filter used to this end generally uses a yellow colloidal silver, because the yellow colloidal silver can be easily removed at the development processing of the silver halide color photographic material and shows no instability such that it moves from the layer to which initially it is added to other layers during the storage of the photographic material before use but stable capability can be provided. However, the yellow colloidal silver is a silver grain having broad light absorption characteristics, which is deficient in that it may serve as a development active site at the development processing (the effect thereof is particularly conspicuous when the solubility of the developer to silver halide is high). Accordingly, active investigations have been recently made to replace the yellow colloidal silver by an organic compound showing sharp absorption.

A representative example of such an organic compound is a solid disperse dye described in U.S. Pat. No. 4,923,788, which is, however, broad in the light absorption characteristics, insufficient in the increase in sensitivity of the green-sensitive layer and incapable of satisfactory solution of the change in capability due to the raw stock storage of the photographic material.

As a result of intensive investigations, the present inventors have found that by using a solid disperse dye of a compound represented by formula (i) of the present invention in the yellow filter layer in place of yellow colloidal silver, the increase in sensitivity of the green-sensitive layer and the raw stock storability of the photographic material can be fully satisfied and also, by using in combination at least one requirement selected from the above-described requirements (a) to (c), the photographic material using a solid disperse dye of the present invention can exhibit excellent saturation in the color reproduction and can be improved with respect to the bad effect by the color temperature of a light source as compared with that using yellow colloidal silver, and have accomplished the present invention.

The reason why the latter object can be achieved in view of the color reproduction by the constitution of the present invention seems to be ascribable to the following difference between the solid disperse dye of a compound represented by formula (i) of the present invention and the yellow colloidal silver.

If yellow colloidal silver is used in the yellow filter, due to the development activity of the yellow colloidal silver, the blue-sensitive emulsion layer adjacent thereto undergoes increase in the fog development amount and becomes susceptible to the interlayer effect from the green-sensitive emulsion layer and the red-sensitive emulsion layer. The yellow filter layer using a solid disperse dye of a compound represented by formula (i) of the present invention can prevent the blue-sensitive emulsion layer from readily subjecting itself to an interlayer effect as described above. Also, since the yellow filter layer using a solid disperse dye of a compound represented by formula (i) of the present invention can exhibit large absorption to blue light and small absorption to green light and red light as compared with that using yellow colloidal silver, the interlayer effect from the blue-sensitive emulsion layer to other layers can be reduced without impairing the saturation in color reproduction.

The saturation in color reproduction can also be intensified by increasing the interlayer effect among a blue-sensitive emulsion layer, a green-sensitive emulsion layer and a red-sensitive emulsion layer. In this case, if the interlayer effect between a blue-sensitive emulsion layer and a red-sensitive emulsion layer is excessively increased, another problem may be caused that the change in coloration due to the change in the color temperature of a light source is too much large. With respect to the change in the color temperature of a light source, the change in the ratio of the amount of blue light to the amount of red light is large in many cases either under daylight (e.g., fine/cloudy, in shade/in sun, strobe color temperature) or under tungsten light and therefore, if the interlayer effect between a blue-sensitive emulsion layer and a red-sensitive emulsion layer is too large as described above, disadvantageous results would be caused such that a red tint is too high when the color temperature is low and the proportion of red light is high, whereas a blue tint is too high when the color temperature is high and the proportion of blue light is high.

Accordingly, in order to obtain a photographic material capable of providing excellent saturation in the color reproduction and improved with respect to adverse effects due to the color temperature of a light source, it is necessary to increase the interlayer effect between a blue-sensitive emulsion layer and a green-sensitive emulsion layer or the interlayer effect between a green-sensitive emulsion layer and a red-sensitive emulsion layer as compared with the interlayer effect between a blue-sensitive emulsion and a red-sensitive emulsion layer. In the constitution of the present invention, requirements (a) to (c) each is a method for increasing the interlayer effect, however, if the yellow filter uses yellow colloidal silver, it is difficult to reduce the interlayer effect from a red-sensitive emulsion layer to a blue-sensitive emulsion layer while keeping the large interlayer effect from a red-sensitive emulsion layer to a green-sensitive emulsion layer because the yellow colloidal silver has the effect thereon as described above. By using a solid disperse dye of a compound represented by formula (i) in place of yellow colloidal silver as a yellow filter, the interlayer effect between the blue-sensitive emulsion layer and the red-sensitive emulsion layer can be reduced without impairing the saturation in color reproduction, whereby the saturation in color reproduction and the color temperature dependency can be improved at the same time.

The effect of the present invention can be exerted under either a daylight source (including an artificial light source such as strobe, etc.) or a tungsten light source.

The compound of formula (i) of the present invention will be described below in detail.

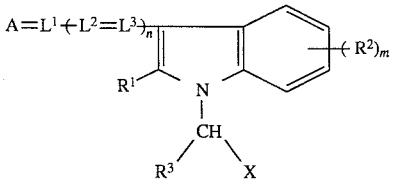

(i)

wherein A represents an acidic nucleus having at least one carboxyl group $L^1$, $L^2$, $L^3$ , and each represents a methine group which may be substituted, $R^x$ and $R^3$ each represents a hydrogen atom or a substituent (including a substitutional atom), $R^2$ represents a substituent (including a substitutional atom), n represents 0 or 1, m represents 0 or an integer of from 1 to 4, provided that when m is an integer of from 2 to 4, the $R^2$ groups may be the same or different, and X represents an electron-withdrawing group having a Hammett's substituent constant $\sigma_m$ of from 0.3 to 1.5.

In a preferred structure of formula (i), X is an alkoxycarbonyl group or a cyano group and A is an acidic nucleus substituted by a carboxyphenyl group.

Formula (i) will be described below in more detail.

In formula (i) of the present invention, X is an electron-withdrawing substituents selected as described above and thereby, the reaction of the compound represented by formula (i) with the nucleophilic agent (mainly, hydroxyl ion, sulfite ion) in the processing solution is accelerated during the photographic processing to provide an outstanding effect on the improvement in the decoloration property. This effect is assumed to result from the fact that an electron-withdrawing group is substituted on the indole nitrogen atom at the conjugate site of the point to react with the nucleophilic agent and thereby, the electron density at the reaction point is reduced to provide a readily reactive state.

The acidic nucleus represented by A of formula (i) is preferably 5-pyrazolone, isooxazolone, barbituric acid, thiobarbituric acid, pyrazolopyridone, rhodanine, hydantoin, thiohydantoin, oxazolidinedione, pyrazolidinedione, indandione, hydroxypyridone, 1,2,3,4-tetrahydroquinoline-2,4-dione or 3-oxo-2,3-dihydrobenzo[d]thiophene-1,1-dioxide, more preferably 5-pyrazolone, hydroxypyridone, pyrazolopyridone, barbituric acid or isooxazolone, more preferably 5-pyrazolone.

A in formula (i) contains at least one carboxyl group and the carboxyl group is preferably bonded to the aryl group (or the benzene ring) in the molecule, more preferably bonded to the phenyl group.

In view of the bonding of the carboxyl group, the compound represented by formula (i) of the present invention is preferably a compound represented by formula (i-1):

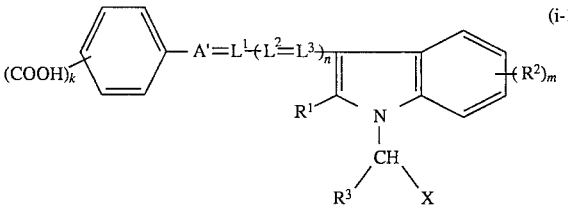

(i-1)

wherein k represents 1, 2 or 3, A' represents an acidic nucleus residue and $L^1$, $L^2$, $L^3$, $R^1$, $R^2$, $R^3$, X, n and m each has the same meaning as defined in formula (i).

In view of the acidic nucleus, the compound represented by formula (i) of the present invention is preferably a compound represented by formula (i-2).

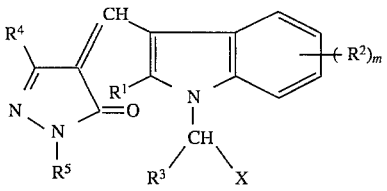

(i-2)

wherein $R^4$ and $R^5$ each represents a hydrogen atom or a substituent (including a substitutional atom), provided that at least one of $R^4$ and $R^5$ represents a substituent having a carboxyl group, and $R^1$, $R^2$, $R^3$, X and m each has the same meaning as defined in formula (i).

In considering the bonding of the carboxyl group together, at least one of $R^4$ and $R^5$ (preferably $R^5$) in formula (i-2) is a phenyl group substituted by a carboxyl group.

The specific embodiments for each of $L^1$, $L^2$, $L^3$ $R^1$, $R^2$, $R^3$, m, n and X in formula (i) are the same as those in formula (I).

A' of formula (i-1) represents a residue of the acidic nucleus represented by A.

The substitution of the carboxyl group to the phenyl group may be made at any position.

k represents 1, 2 or 3, preferably 1 or 2, more preferably 1.

A preferred combination in formula (i-1) is such that A' is a 5-pyrazolone residue, a hydroxypyridone residue, a pyrazolopyridone residue, a barbituric acid residue or an iosooxazolone residue, k is 1 or $R^1$, is a hydrogen atom, a methyl group or a phenyl group, $R^3$ is a hydrogen atom or an alkyl group and X is an alkoxycarbonyl group or a cyano group, n is 0 and m is 0.

A more preferred combination is such that A' is a 5-pyrazolone residue, n is 0, m is 0, k is 1, $R^1$ is a hydrogen atom, $R^3$ is an alkyl group and X is an alkoxycarbonyl group.

The substituent represented by $R^4$ or $R^5$ in formula (i-2) has the same meaning as the substituent represented by formula $R^1$, $R^2$ or $R^3$.

However, $R^4$ and $R^5$ each contains at least one carboxyl group.

The substituent represented by $R^4$ is preferably an unsubstituted alkyl group or a substituted or unsubstituted amino group, more preferably an unsubstituted alkyl group or an unsubstituted amino group, still more preferably a methyl group or an unsubstituted amino group.

The substituent represented by $R^5$ is preferably an aryl group substituted by a carboxyl group, more preferably a carboxyphenyl group.

A preferred combination in formula (i-2) is such that m is 0, $R^1$ is a hydrogen atom, $R^3$ is a hydrogen atom or an alkyl group, $R^4$ is an unsubstituted alkyl group or a substituted or unsubstituted amino group, $R^5$ is an aryl group substituted by a carboxyl group and X is an alkoxycarbonyl group or a cyano group.

A more preferred combination is such that m is 0, $R^1$ is a hydrogen atom, $R^3$ is an alkyl group, $R^4$ is a methyl group or an unsubstituted amino group, $R^5$ is a carboxyphenyl group and X is an alkoxycarbonyl group.

Specific examples of the compounds for use in the present invention are set forth below, but the present invention is by no means limited to these.

1.

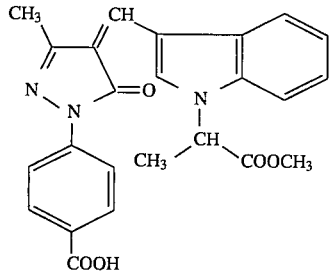

2.

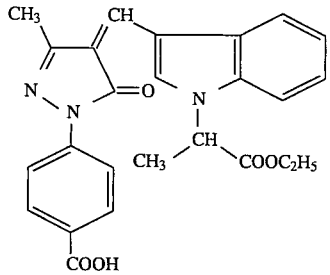

3.

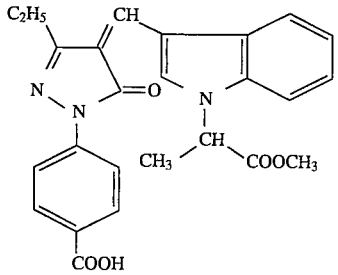

4.

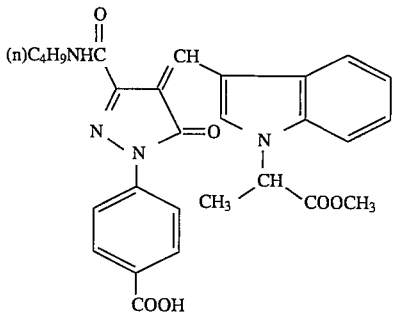

5.

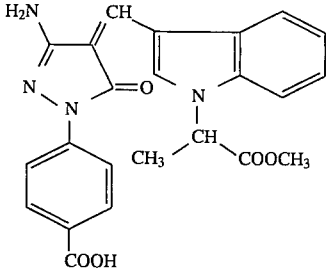

6.

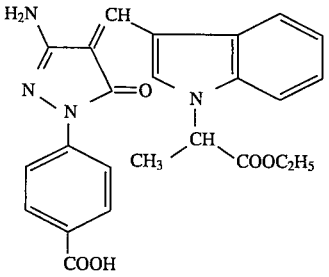

7.

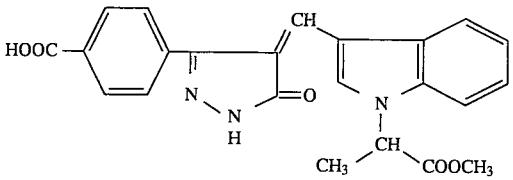

8.

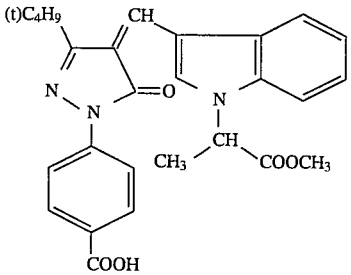

-continued
9.
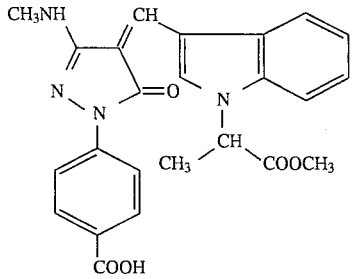
10.
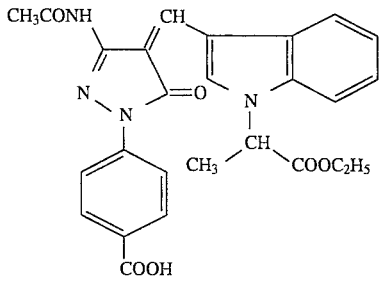
11.
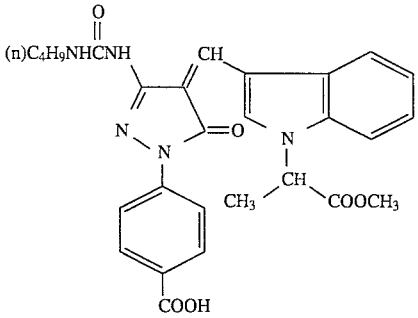
12.
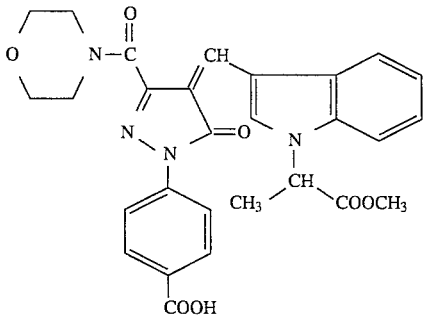
13.
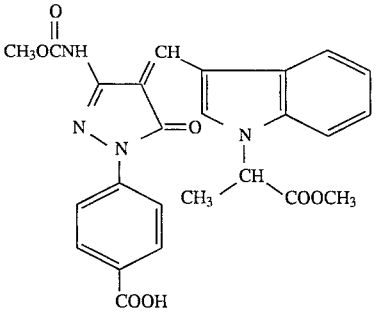
14.
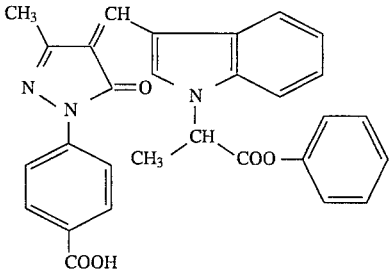
15.
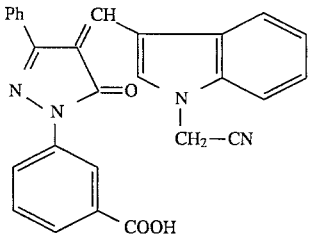
16.
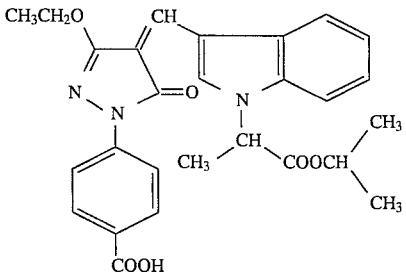
17.
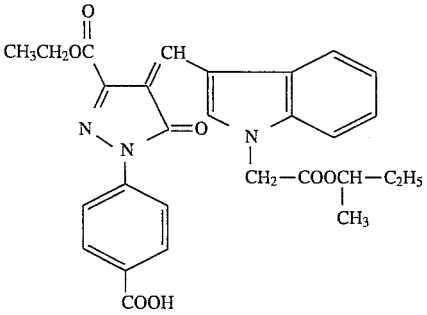
18.
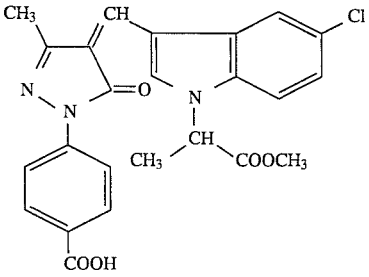

-continued
19.
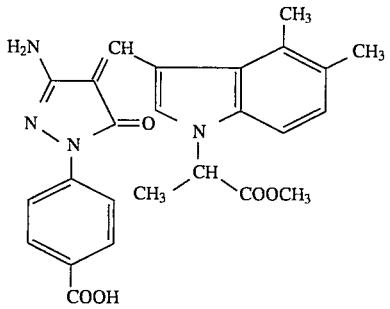
20.
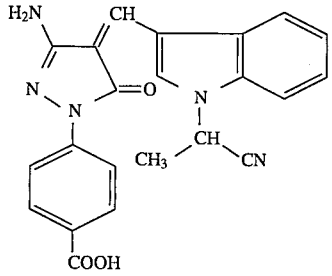
21.
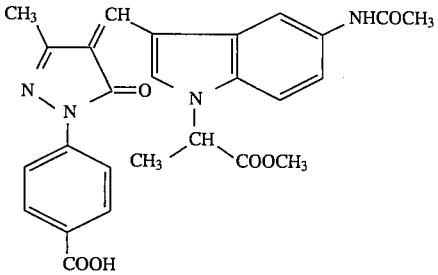
22.
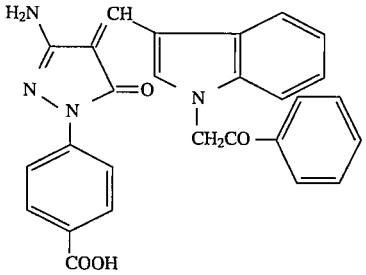
23.
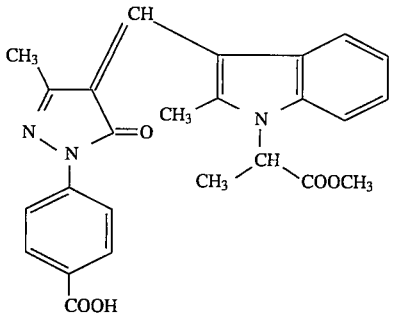
24.
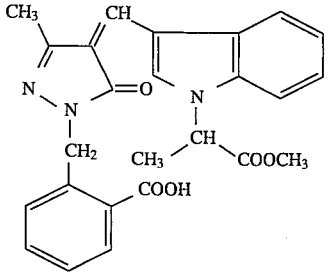
25.
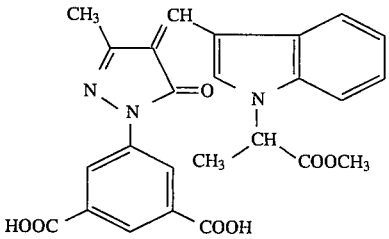
26.
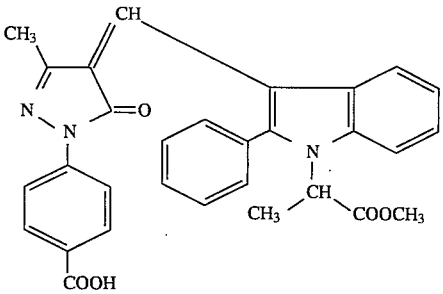
27.
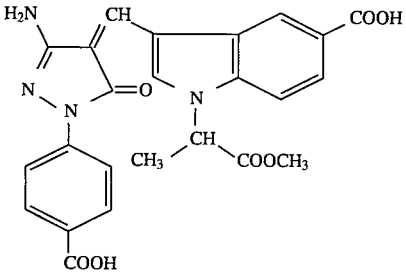
28.
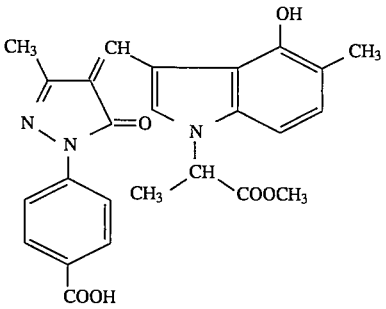

-continued
29.
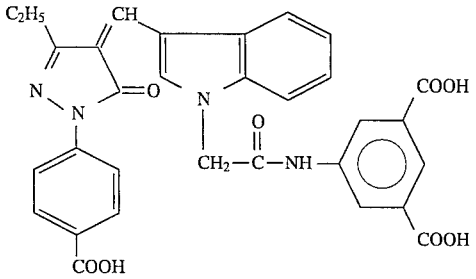
30.
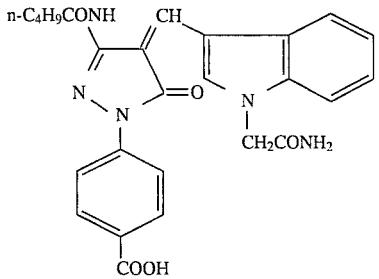
31.
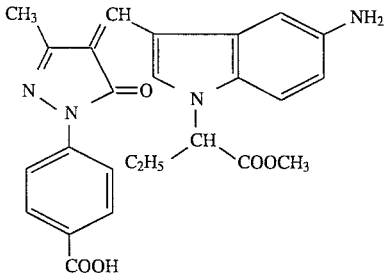
32.
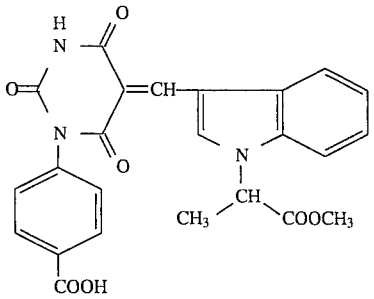
33.
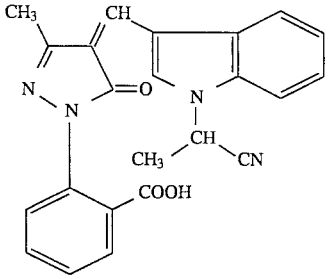
34.
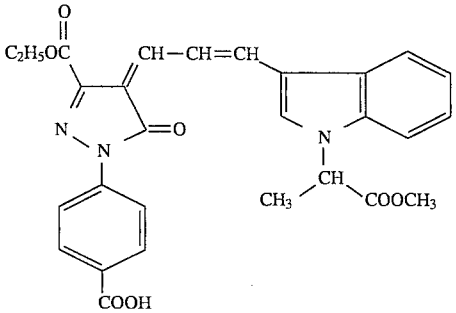
35.
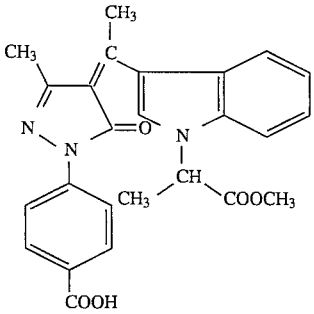
36.
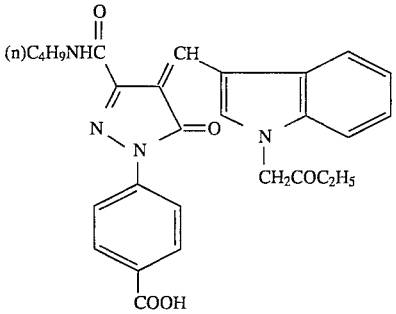
37.
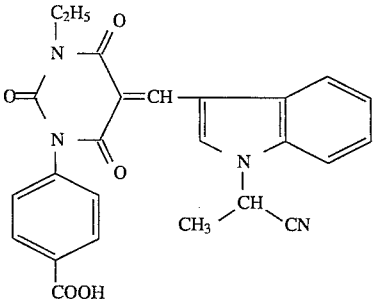
38.
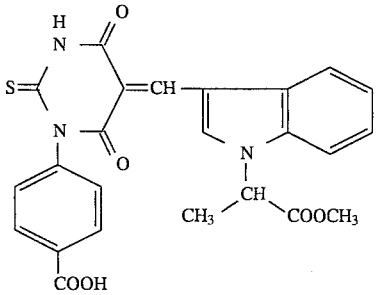

-continued

39.

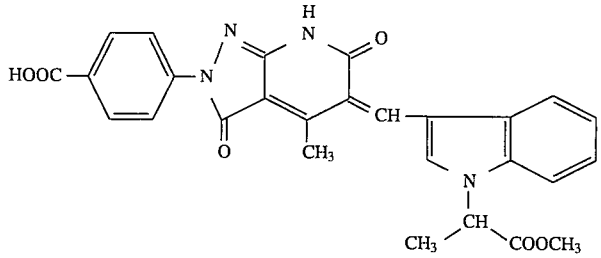

40.

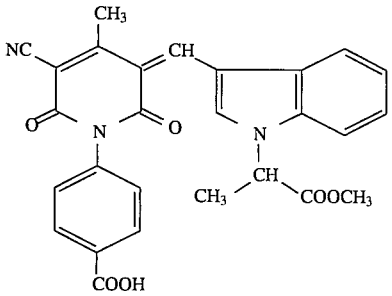

41.

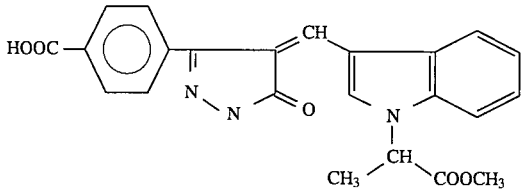

42.

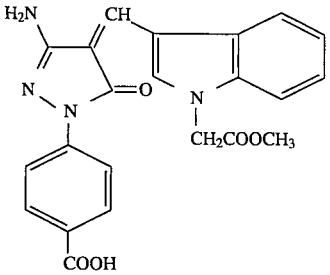

43.

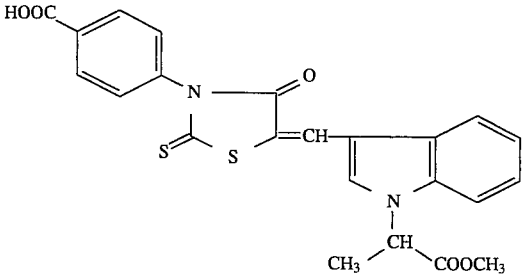

44.

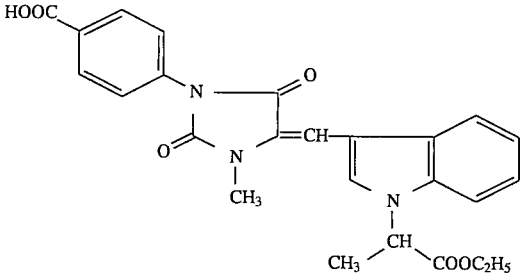

The compound represented by formula (I) or formula (i) of the present invention is sparingly soluble in water having a pH of from 5 to 7. The term "sparingly water soluble" as used herein means that the compound exhibits a solubility of 1.0 g/l (25° C.) in water having a pH of 5 to 7.

The compound represented by formula (I) or formula (i) of the present invention must not have, in particular, a sulfo group or a salt thereof (e.g., sodium salt, potassium salt, ammonium salt) as a substituent so that it can be sparingly soluble in water.

The compound represented by formula (i) of the present invention can be produced by reacting a compound having no substituent in the active methylene moiety of the acidic nucleus represented by A (namely, the moiety connected to $L^1$ in formula (i)) with a compound represented by formula (i-3) in an organic solvent (e.g., methanol, ethanol, isopropyl alcohol, acetonitrile, N,N-dimethylformamide, N,N-dimethylacetamido, acetic acid, pyridine) at a room temperature under reflux.

If the reaction speed is slow, an acetic acid, an acetic anhydride, a p-toluenesulfonic acid, a triethylamine, pyridine or an ammonium acetate may be added in an appropriate amount to facilitate the reaction.

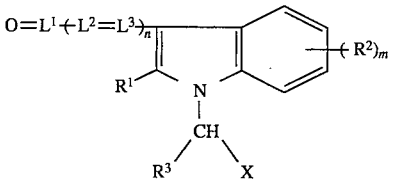

(i-3)

wherein $R^1$, $R^2$, $R^3$, $L^1$, $L^2$, $L^3$, X, m and n each has the same meaning as defined in formula (i).

The synthesis examples of the compound represented by formula (i) are described below.

(a) Synthesis of Methyl 2-(3-formyl-1-indolyl)propionate (Compound a)

4.4 g of indole-3-carbaldehyde, 5.5 g of methyl 2-bromopropionate, 8.3 g of potassium carbonate and 30 ml of N,N-dimethylformamide were mixed and heated while stirring on a steam bath for 3 hours. After slowly cooling the reaction solution to room temperature, the cooled reaction solution was poured into 120 ml of ice water while stirring and as a result, an oily product was precipitated and then solidified. The product was recrystallized with ethanol to obtain 6.2 g of Compound a as a crystal.

(b) Synthesis of Compound 1

5.5 g of 1-p-carboxyphenyl-3-methyl-5-pyrazolone and 5.8 g of Compound a were mixed with 50 ml of N,N-dimethylacetamide and the mixture was heated on a steam bath for 4 hours. After cooling to room temperature, 50 ml of methanol was added thereto and then a crystal was collected by filtration. The product was washed with a small amount of methanol and dried to obtain 7.4 g of Compound 1. λmax=406 nm (dimethylformamido)

(c) Synthesis of Compound 5

6.6 g of 3-amino-1-p-carboxyphenyl-5-pyrazolone and 6.9 g of Compound a were mixed with 30 ml of N,N-dimethylformamide and heated on a steam bath for 4 hours. After cooling to room temperature, 30 ml of methanol was added thereto and stirred at the same temperature for a while and then a crystal was collected by filtration. The product was washed with methanol and dried to obtain 7.6 g of Compound 5. λmax=414 nm (dimethylformamide)

In the present invention, the dispersion of the dye may be carried out using a disperser freely selected from a disperser such as a ball mill, a sand mill or a colloid mill described in JP-A-52-92716 and International WO88/04794 and a disperser such as a vibration ball mill, a planet ball mill, a jet mill, a roll mill, a Manthon Gaurine, a microfluidizer, a disk impeller mill, but preferably using a vertical or horizontal medium disperser.

In any case, a solvent (e.g., water) is preferably used and a surface active agent for dispersion is more preferably used. As the surface active agent for dispersion, an anionic surface active agent described in JP-A-52-92716 and International Patent WO88/04794 or an anionic polymer described in JP-A-4-324858 may be used and if desired, a nonionic or cationic surface active agent may be used, however, an anionic polymer or an anionic surface active agent is preferably used.

Further, the dye of the present invention may be dissolved in an appropriate solvent and then deposited as a fine crystal by adding thereto a bad solvent for the dye of the present invention and also in this case, the above-described surface active agent for dispersion may be used. Or, the dye may be dissolved in a solvent by controlling the pH and then formed into a fine crystal by changing the pH.

The dye of the present invention in the dispersion has an average grain size of from 0.005 to 10 μm, preferably from 0.01 to 1 μm, more preferably from 0.01 to 0.5 μm and in some cases, preferably from 0.01 to 0.1 μm. The fine grain of the dye is preferably monodisperse.

The dye represented by formula (I) or formula (i) may be dispersed without subjecting the dye solid not to any pretreatment. In this case, a dye solid in a wet state, which is obtained in the synthesis process of the dye, is preferably used for the dispersion.

Also, if desired, the dye may be subjected to heat treatment before and/or after the dispersion and in order to accomplish the heat treatment more effectively, the heat treatment is preferably carried out at least after the dispersion.

The heating method is not particularly restricted if the dye solid is heated and the temperature is preferably 40° C. or higher but the upper bound is not restricted if it is in the range where the dye is not decomposed, preferably 250° C. or lower. The temperature at heating is more preferably from 50° to 150° C.

The heating time is not particularly restricted if it is in the range where the dye is not decomposed, but it is generally from 15 minutes to 1 week, preferably from 1 hour to 4 days.

In order to effect the heat treatment, it is preferably carried out in a solvent and the solvent may be any if it does not substantially dissolve the dye represented by formula (I) or formula (i). Examples of the solvent include water, alcohols (e.g., methanol, ethanol, isopropyl alcohol, butanol, isoamyl alcohol, octanol, ethylene glycol, diethylene glycol, ethyl cellosolve), ketones (e.g., acetone, methyl ethyl ketone), esters (e.g., ethyl acetate, butyl acetate), alkylcarbons (e.g., acetic acid, propionic acid), nitriles (e.g., acetonitrile) and ethers (e.g., dimethoxyethane, dioxane, tetrahydrofuran).

The object of the present invention can be more effectively achieved by letting an organic carboxylic acid be present together in the heat treatment. Examples of the organic carboxylic acid include alkylcarboxylic acids (e.g., acetic acid, propionic acid), carboxymethyl celluloses (CMC) and arylcarboxylic acids (e.g., benzoic acid, salicylic acid).

The organic carboxylic acid as a solvent is used in an amount of from 0.5 to 100 times the weight of the dye represented by formula (I).

Also, the organic carboxylic acid as a solvent is used in an amount of from 0.5 to 100 times the weight of the dye represented by formula (i), (i-1) or (i-2).

The present invention can be applied to a color photographic material. Further, the present invention is effective particularly for a color photographic material which is thick as compared with a black-and-white photographic material because it generally comprises a large number of emulsion layers and other hydrophilic colloid layers and contains many kinds of additives, and contains a large number of oily additives to thereby be prone to reduction in the decoloration property of the dye.

The present invention is more particularly effective for a color reversal photographic material.

The dye represented by formula (I) may be used in any effective amount but it is preferably used in such an amount that the optical density falls in the range of from 0.05 to 3.0. The addition amount is preferably from 0.5 to 1,000 mg/m$^2$, more preferably from 1 to 600 mg/m$^2$. The addition time may be at any step before coating.

The dye represented by formula (I) may be used in any of an emulsion layer and other hydrophilic colloid layers (e.g., an inter layer, a protective layer, an antihalation layer, a filter layer, a back layer) and it may be used either in sole layer or in a plurality of layers.

The dye represented by formula (i) may be used in any effective amount, but it is preferably used in such an amount that the optical density falls within the range of from 0.05 to 3.0. The addition amount is from 0.5 to 1,000 mg/m$^2$, more preferably from 1 to 500 mg/m$^2$, per one layer. The addition time may be at any step before coating.

The dye represented by formula (i), (i-1) or (i-2) can be used in any of an emulsion layer and other hydrophilic colloid layers (e.g., an interlayer, a protective layer, an antihalation layer, a filter layer, a back layer) and it may be used either in sole layer or in a plurality of layers. It is preferably added to a light-insensitive layer.

The photographic material prepared according to the present invention may contain a dye other then that of the present invention in a hydrophilic colloid layer as a filter dye, for purposes of preventing irradiation or halation or for other various purposes. Preferred examples of the dye used to this effect include an oxonol dye, a hemioxonol dye, a styryl dye, a merocyanine dye, an anthraquinone dye and an azo dye, and in addition, a cyanine dye, an azomethine dye, a triarylmethane dye and a phthalocyanine dye are useful. This dye can be added after dissolving it in water when it is water soluble or it can be added as a solid fine grain dispersion product when it is hard to dissolve in water. An oil-soluble dye may be emulsified by an oil-in-water dispersion method and then added to a hydrophilic colloid layer.

The compound represented by formula (II) will be described below in detail.

The compound having a chromophore represented by D can be selected from various known dye compounds.

Examples of the compound include an oxonol dye, a merocyanine dye, a cyanine dye, an arylidene dye, an azomethine dye, a triphenylmethane dye, an azo dye, an anthraquinone dye, an indoaniline dye and a styryl dye.

The dissociative proton or the group having a dissociative proton represented by X has a property such that it is non-dissociative to render the compound of formula (II) substantially water-insoluble in a state where the compound represented by formula (II) is added to the silver halide photographic material of the present invention but it is dissociated to render the compound of formula (II) substantially water-soluble in the process of developing the photographic material. Examples of the group include a carboxylic acid group, a sulfonamido group, an arylsulfamoyl group, a sulfonylcarbamoyl group, a carbonylsulfamoyl group, an enol group of an oxonol dye and a phenolic hydroxyl group.

The compound represented by formula (II) is more preferably a compound represented by formula (IIa), (IIb), (IIc) or (IId):

$$A^1{=}L^1{\leftrightharpoons}L^2{=}L^3{\rightharpoonup}_m Q \quad \text{(IIa)}$$

$$A^1{=}L^1{\leftrightharpoons}L^2{=}L^3{\rightharpoonup}_n A^2 \quad \text{(IIb)}$$

$$A^1{\leftrightharpoons}L^1{-}L^2{\rightleftharpoons}_p B^1 \quad \text{(IIc)}$$

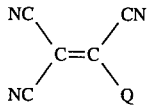
(IId)

wherein $A^1$ and $A^2$ each represents an acidic nucleus, $B^1$ represents a basic nucleus, Q represents an aryl group or a heterocyclic group, $L^1$, $L^2$ and $L^3$ each represents a methine group, m represents 0, 1 or 2 and n and p each represents 0, 1, or 3, provided that the compound represented by formula (IIa), (IIb), (IIc) or (IId) contains in one molecule at least one selected from the group consisting of a carboxylic acid group, a sulfonamido group, an arylsulfamoyl group, a sulfonylcarbamoyl group, a carbonylsulfamoyl group, an enol group of an oxonol dye and a phenolic hydroxyl group and contains no other water-soluble group (e.g., sulfonic acid group, a phosphoric acid group).

The acidic nucleus represented by $A^1$ or $A^2$ is preferably a cyclic ketomethylene compound or a compound having a methine group interposed by electron-withdrawing groups.

Examples of the cyclic ketomethylene compound include 2-pyrazoline-5-one, rhodanine, hydantoin, thiohydantoin, 2,4-oxazolidinedione, isooxazolone, barbituric acid, thiobarbituric acid, indandione, dioxopyrazolopyridine, hydroxypyridine, pyrazolidinedione, 2,5-dihydrofuran-2-one and pyrroline-2-one. These substituent each may have a substituent.

The compound having a methylene group interposed by electron-withdrawing groups is represented by formula: $Z^1CH_2Z^2$, wherein $Z^1$ and $Z^2$ each represents —CN, $—SO_2R^1$, $—COR^1$, $—COOR^2$, $—CONHR^2$, $—SO_2NHR^2$, $—C[{=}C(CN)_2]R^1$ or $—C[{=}C(CN)_2]NHR^1$ (wherein $R^1$ represents an alkyl group, an aryl group or a heterocyclic group, $R^2$ represents a hydrogen atom or a group represented by $R^1$ and these groups each may have a substituent).

Examples of the basic nucleus represented by $B^1$ include pyridine, quinoline, indolenine, oxazole, imidazole, thiazole, benzoxazole, benzimidazole, benzothiazole, oxazoline, naphthooxazole and pyrrole, which groups each may have a substituent.

Examples of the aryl group represented by Q include a phenyl group and a naphthyl group, which groups each may have a substituent. Examples of the heterocyclic group represented by Q include pyrrole, indole, furan, thiophene, imidazole, pyrazole, indolizine, quinoline, carbazole, phenothiazine, phenoxazine, indoline, thiazole, pyridine, pyridazine, thiadiazine, pyran, thiopyran, oxadiazole, benzoquinoline, thiadiazole, pyrrolothiazole, pyrrolopyridazine, tetrazole, oxazole, coumarin and coumarone, which groups each may have a substituent.

The methine group represented by $L^1$, $L^2$ or $L^3$ may have a substituent and the substituents may be combined with each other to form a 5- or 6-membered ring (e.g., cyclopentene, cyclohexene).

The substituent which the above-described groups each may have is not particularly restricted if the substituent does not substantially dissolve the compound represented by formula (II) in water having a pH of from 5 to 7.

Examples of the substituent include a carboxylic acid group, a sulfonamido group having from 1 to 10 carbon atoms (e.g., methanesulfonamido, benzenesulfonamido, butanesulfonamido, n-octanesulfonamido), a sulfamoyl group having from 1 to 10 carbon atoms (e.g., unsubstituted sulfamoyl, methylsulfamoyl, phenylsulfamoyl, butylsulfamoyl), a sulfonylcarbamoyl group having from 2 to 10 carbon atoms (e.g., methanesulfonylcarbamoyl, propanesulfonylcarbamoyl, benzenesulfonylcarbamoyl), an acylsulfamoyl group having from 1 to 10 carbon atoms (e.g., acetylsulfamoyl, propionylsulfamoyl, pivaloylsulfamoyl, benzoylsulfamoyl), a chained or cyclic alkyl group having from 1 to 8 carbon atoms (e.g., methyl, ethyl, isopropyl, butyl, hexyl, cyclopropyl, cyclopentyl, cyclohexyl, 2-hydroxyethyl, 4-carboxybutyl, 2-methoxyethyl, benzyl, phenetyl, 4-carboxybenzyl, 2-diethylaminoethyl), an alkenyl group having from 2 to 8 carbon atoms (e.g., vinyl, allyl), an alkoxy group having from 1 to 8 carbon atoms (e.g., methoxy, ethoxy, butoxy), a halogen atom (e.g., F, Cl, Br), an amino group having from 0 to 10 carbon atoms (e.g, unsubstituted amino, dimethylamino, diethylamino, carboxyethylamino), an ester group having from 2 to 10 carbon atoms (e.g., methoxycarbonyl), an amido group having from 1 to 10 carbon atoms (e.g., acetylamino, benzamido), a carbamoyl group having from 1 to 10 carbon atoms (e.g., unsubstituted carbamoyl, methylcarbamoyl, ethylcarbamoyl), an aryl group having from 6 to 10 carbon atoms (e.g., phenyl, naphthyl, 4-carboxyphenyl, 3-carboxyphenyl, 3,5-dicarboxyphenyl, 4-methanesulfonamidophenyl, 4-butanesulfonamidophenyl), an aryloxy group having from 6 to 10 carbon atoms (e.g., phenoxy, 4-carboxyphenoxy, 3-methylphenoxy, naphthoxy), an alkylthio group having from 1 to 8 carbon atoms (e.g., methylthio, ethylthio, octylthio), an arylthio group having from 6 to 10 carbon atoms (e.g., phenylthio, naphthylthio), an acyl group having from 1 to 10 carbon atoms (e.g., acetyl, benzoyl, propanoyl), a sulfonyl group having from 1 to 10 carbon atoms (e.g., methanesulfonyl, benzenesulfonyl), a ureido group having from 1 to 10 carbon atoms (e.g., ureido, methylureido), a urethane group having from 2 to 10 carbon atoms (e.g., methoxycarbonylamino, ethoxycarbonylamino), a cyano group, a hydroxyl group, a nitro group and a heterocyclic group (e.g., 5-carboxybenzoxazole ring, pyridine ring, sulforane ring, pyrrole ring, pyrrolidine ring, morpholine ring, piperazine ring, pyrimidine ring, furan ring).

Specific examples of the compound represented by formula (II) for use in the present invention are set forth below.
(II-1)
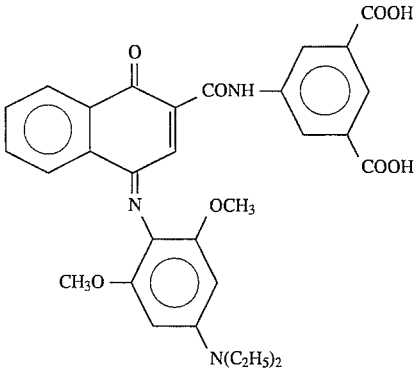
(II-2)
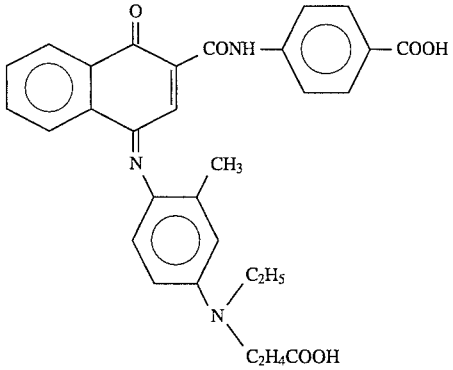
(II-3)
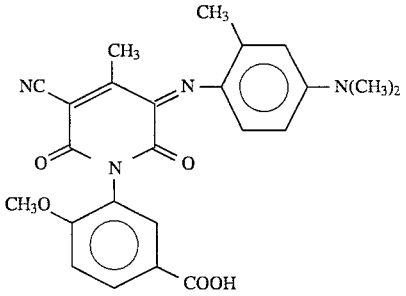
(II-4)
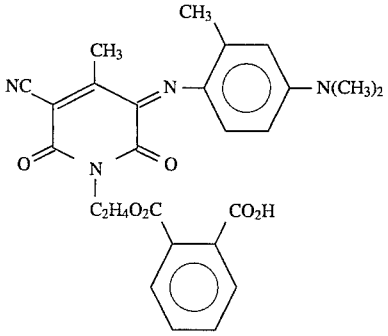
(II-5)
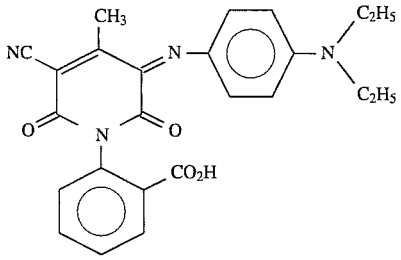

-continued
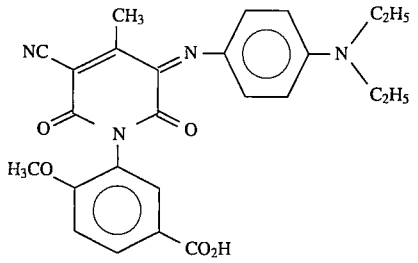
(II-6)
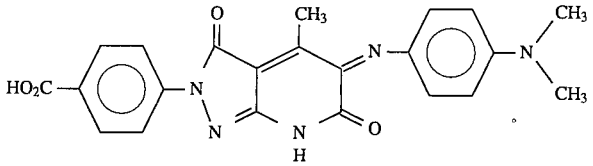
(II-7)
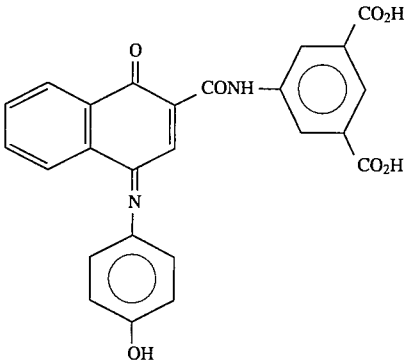
(II-8)
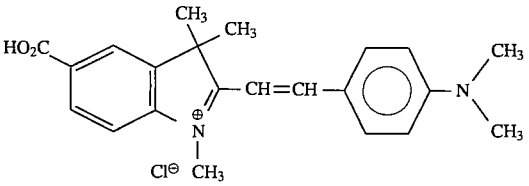
(II-9)
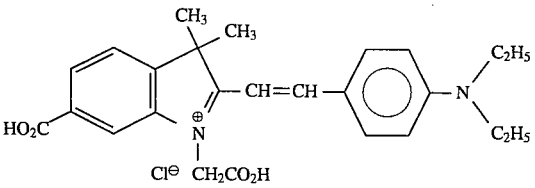
(II-10)
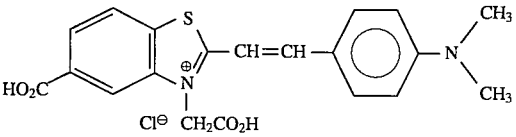
(II-11)
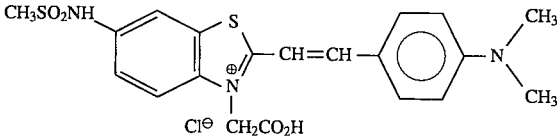
(II-12)

-continued
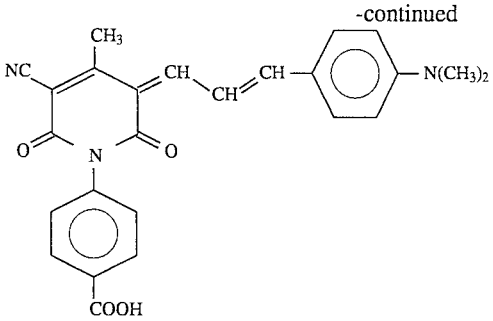
(II-13)
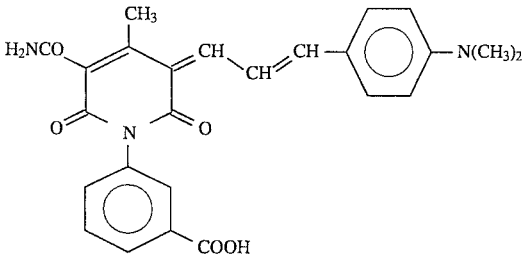
(II-14)
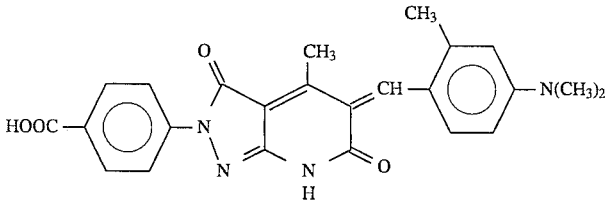
(II-15)
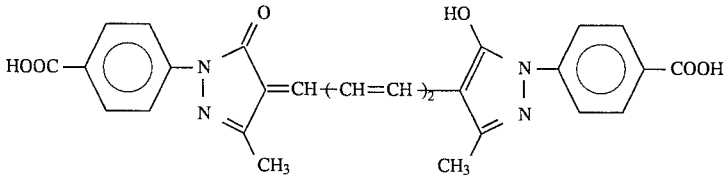
(II-16)
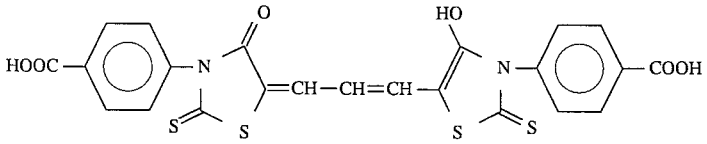
(II-17)
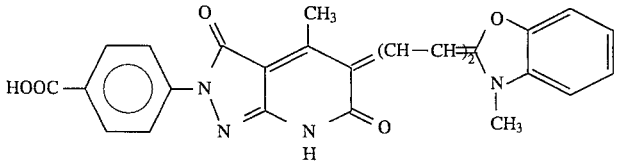
(II-18)
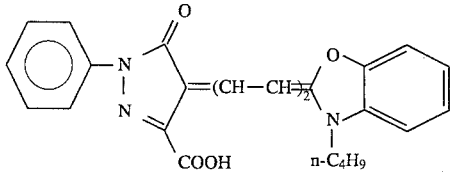
(II-19)

-continued (II-20)

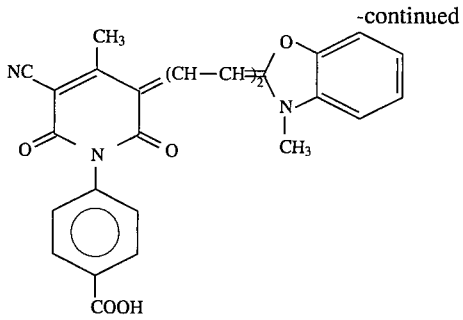

(II-21)

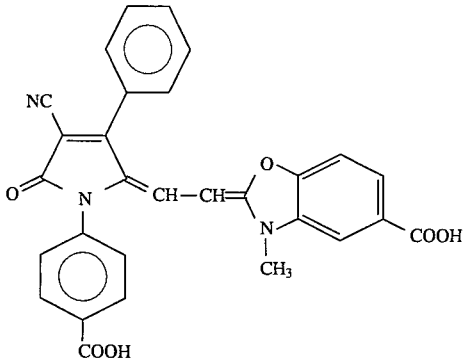

The dye represented by formula (II) can be produced according to the methods as described, for example, in WO88-04794, JP-A-2-173630, JP-A-1-247466, JP-A-3-7931, JP-A-4-37841, JP-A-3-7931, JP-A-59-50973, U.S. Pat. No. 4,092,168, JP-A-3-208047, U.S. Pat. No. 4,948,718, JP-A-3-67247 and JP-A-6-110156.

To the compound represented by formula (II), the dispersion method described in detail with respect to the compound represented by formula (I) can be applied as it is.

The dye in the dispersion has, the same as above, an average grain size of from 0.005 to 10 μm, preferably from 0.01 to 1 μm, more preferably from 0.01 to 0.5 μm. The grain size distribution of the dye fine grains is preferably monodisperse.

The dye represented by formula (II) may be used in an any effective amount but it is preferably used in such an amount that the optical density falls within the range of from 0.01 to 1.5. The addition amount is preferably from 0.5 to 1,000 mg/m$^2$, more preferably from 1.5 to 400 mg/m$^2$ The dye represented by formula (II) may be used in any of hydrophilic colloid layers or in an emulsion layer. The dye may also be used either in sole layer or in a plurality of layers.

The compound represented by formula (M) of the present invention will be described below in detail.

The coupler skeleton represented by formula (M) for use in the present invention is preferably 1H-imidazo[1,2-b]pyrazole, 1H-pyrazolo[1,5-b][1,2,4]triazole, 1H-pyrazolo[5,1c][1,2,4]triazole or 1H-pyrazolo[1,5-d]tetrazole, which are represented by formula (M-I), (M-II), (M-III) or (M-IV), respectively. The compounds represented by formulae (M-II) and (M-III) are more preferred.

(M-I)

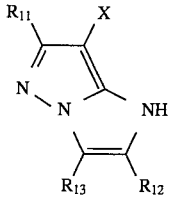

(M-II)

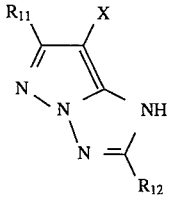

(M-III)

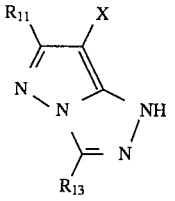

(M-IV)

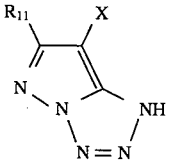

The substituents $R_{11}$, $R_{12}$, $R_{13}$ and X in the above-described formulae will be described below in detail.

$R_{11}$ represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a sulfonyl group, an aryloxycarbonyl group, an acyl group or an azolyl group, and $R_{11}$ may form a bis form by a divalent group.

More specifically, $R_{11}$ represents a hydrogen atom, a halogen atom (e.g., chlorine, bromine), an alkyl group (e.g., a linear or branched alkyl group having from 1 to 32 carbon atoms, an aralkyl group, an alkenyl group, an alkynyl group, a cycloalkyl group, a cycloalkenyl group; specific examples of these groups include ethyl, methyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecaneamido}phenyl}propyl, 2-ethoxytridecyl, trifluoromethyl, cyclopentyl and 3-(2,4-di-t-amylphenoxy)propyl), an aryl group (e.g., phenyl, 4-t-butylphenyl, 2,4-di-t-amylphenyl, 4-tetradecaneamidophenyl), a heterocyclic group (e.g., 2-furyl, 2-thienyl, 2-pyrimidinyl, 2-benzothiazolyl), a cyano ring, a hydroxyl group, a nitro group, a carboxyl group, an amino group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, 3-methoxycarbamoyl), an acylamino group (e.g., acetamido, benzamido, tetradecaneamido, 2-(2,4-di-t-amylphenoxy)butaneamido, 4-(3-t-butyl-4-hydroxyphenoxy)butaneamido, 2-{4-(4-hydroxyphenylsulfonyl)phenoxy}decaneamido), an alkylamino group (e.g., methylamino, butylamino, dodecylamino, diethylamino, methylbutylamino), an anilino group (e.g., phenylamino, 2-chloroanilino, 2-chloro-5-tetradecaneaminoanilino, 2-chloro-5-dodecyloxycarbonylanilino, N-acetylanilino, 2-chloro-5-{α-(3-t-butyl-4-hydroxyphenoxy)dodecaneamido}anilino), a ureido group (e.g., phenylureido, methylureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecaneamidophenylthio), an alkoxycarbonylamino group (e.g., methoxycarbonylamino, tetradecyloxycarbonylamino), a sulfonamido group (e.g., methanesulfonamido, hexadecanesulfonamido, benzenesulfonamido, p-toluenesulfonamido, octadecanesulfonamido, 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-(3-(2,4-di-t-amylphenoxy)propyl}carbamoyl), a sulfamoyl group (e.g., N-ethylsulfamoyl, N,N-dipropylsulfamoyl, dodecyloxyethyl)sulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonyl), an alkoxycarbonyl group (e.g., methoxycarbonyl, butyloxycarbonyl, dodecyloxycarbonyl, octadecyloxycarbonyl), a heterocyclic oxy group (e.g., 1-phenyltetrazole-5-oxy, 2-tetrahydropyranyloxy), an azo group (e.g., phenylazo, 4-methoxyphenylazo, 4-pivaloylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g., phenoxycarbonylamino), an imido group (e.g., N-succinimido, N-phthalimido, 3-octadecenylsuccinimido), a heterocyclic thio group (e.g., 2-benzothiazolylthio, 2,4-di-phenoxy-l,3,5-triazole-6-thio, 2-pyridylthio), a sulfinyl group (e.g., dodecanesulfinyl, 3-phenoxypropylsulfinyl), a 3-pentadecylphenylsulfinyl, phosphonyl group (e.g., phenoxyphosphonyl, octyloxyphosphonyl, phenylphosphonyl), an aryloxycarbonyl group (e.g., phenoxycarbonyl), an acyl group (e.g., acetyl, 3-phenylpropanoyl, benzoyl, 4-dodecyloxybenzoyl) or an azolyl group (e.g., imidazolyl, pyrazolyl, 3-chloropyrazole-1-yl, triazole).

Among these substituents, the groups which can further have a substituent may further have an organic substituent connected through the carbon atom, the oxygen atom, the nitrogen atom or the sulfur atom, or a halogen atom.

Among these substituents, preferred for $R_{11}$ are an alkyl group, an aryl group, an alkoxy group, an aryloxy group, an alkylthio group, a ureido group, a urethane group and an acylamino group.

Examples of the substituent $R_{12}$ include those described for $R_{11}$, and $R_{12}$ preferably represents a hydrogen atom, an alkyl group, an aryl group, a heterocyclic group, an alkoxycarbonyl group, a carbamoyl group, a sulfamoyl group, a sulfinyl group, an acyl group or a cyano group.

Examples of the substituent $R_{13}$ include those described for $R_{11}$, and $R_{13}$ preferably represents a hydrogen atom, an alkyl group, an aryl group, a heterocyclic group, an alkoxy group, an aryl group, a heterocyclic group, an alkoxy group, an aryloxy group, an alkylthio group, an arylthio group, an alkoxycarbonyl group, a carbamoyl group or an acyl group, more preferably an alkyl group, an aryl group, a heterocyclic group, an alkylthio group or an arylthio group.

X represents a hydrogen atom or a group capable of splitting off upon reaction with an oxidation product of an aromatic primary amine color developing agent, and specific examples of the group which can be released include a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl-, aryl- or heterocyclic thio group, a carbamoylamino group, a 5- or 6-membered nitrogen-containing heterocyclic group, an imido group and an arylazo group, which groups each may be substituted by a group allowed as the substituent of $R_{11}$.

More specifically, the group which can be released is a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), an acyloxy group (e.g., acetoxy, tetradecanoyloxy, benzoyloxy), an alkyl- or arylsulfonyloxy group (e.g., methanesulfonyloxy, toluenesulfonyloxy), an acylamino group (e.g., dichloroacetylamino, heptafluorobutyrylamino), an alkyl- or arylsulfonamido group (e.g., methanesulfonamino, trifluoromethanesulfonamino, p-toluenesulfonylamino), an alkoxycarbonyloxy group (e.g., ethoxycarbonyloxy, benzyloxycarbonyloxy),anaryloxycarbonyloxy group (e.g., phenoxycarbonyloxy), an alkyl-, aryl- or heterocyclic thio group (e.g., dodecylthio, 1-carboxydodecylthio, phenylthio, 2-butoxy-5-t-octylphenylthio, tetrazolylthio), a carbamoylamino group (e.g., N-methylcarbamoylamino, N-phenylcarbamoylamino), a 5- or 6-membered nitrogen-containing heterocyclic group (e.g., imidazole, pyrazolyl, triazolyl, tetrazolyl, 1,2-dihydro-2-oxo-1-pyridyl), an imido group (e.g., succinimido, hydantoinyl) or an arylazo group (e.g., phenylazo, 4-methoxyphenylazo). In addition, X may be a bis-type coupler resulting from condensation of a four-equivalent coupler by an aldehyde or a ketone as a splitting-off group bonded through the carbon atom. Also, X may contain a photographically useful group such as a development inhibitor and a development accelerator. X is preferably a halogen atom, an alkoxy group, an aryloxy group, an alkyl- or arylthio group or a 5- or 6-membered nitrogen-containing heterocyclic group bonded to the coupling active site through the nitrogen atom.

Specific examples of the magenta coupler compound represented by formula (M) are set forth below, but the present invention is by no means limited to these.

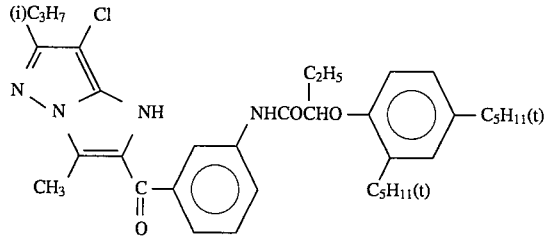

(M-1)

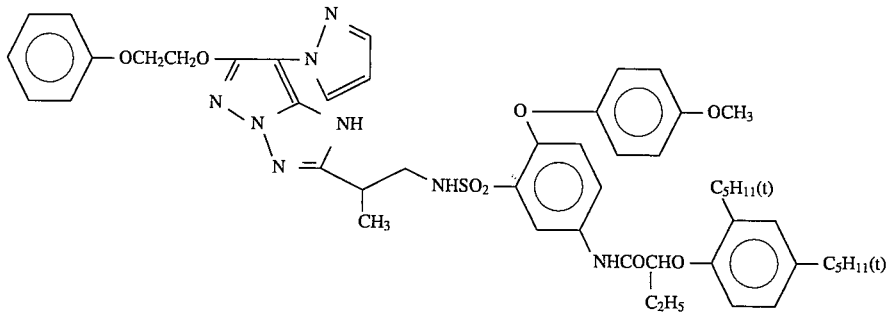

(M-2)

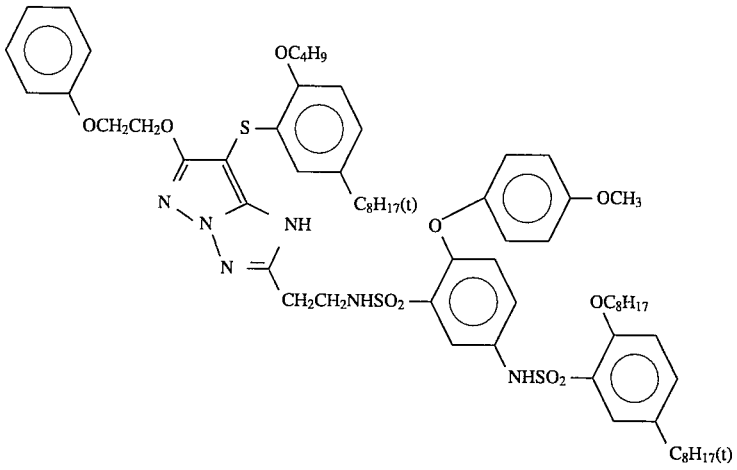

(M-3)

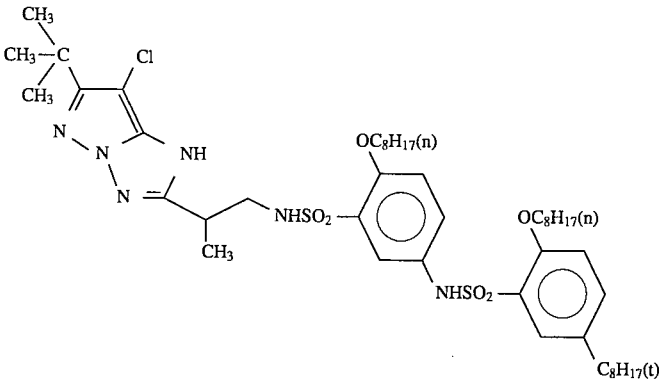

(M-4)

-continued
(M-5)
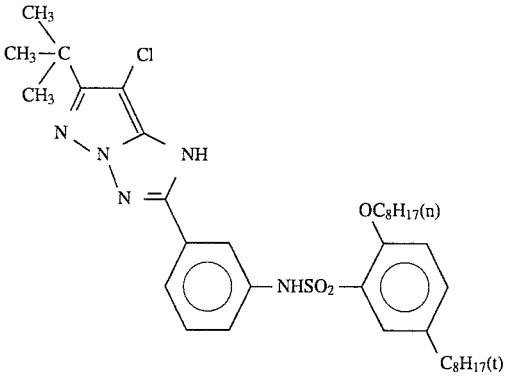
(M-6)
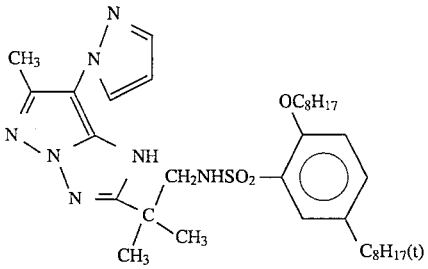
(M-7)
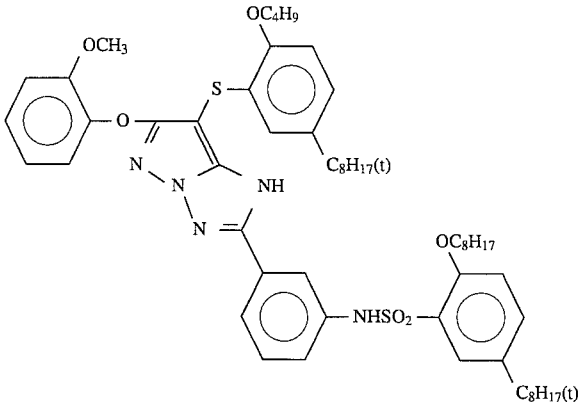
(M-8)
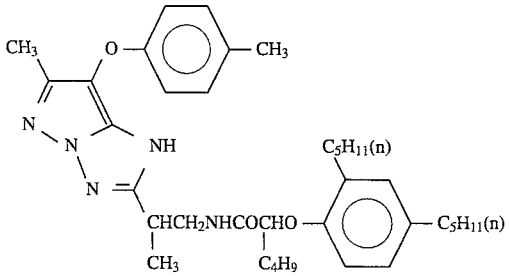
(M-9)
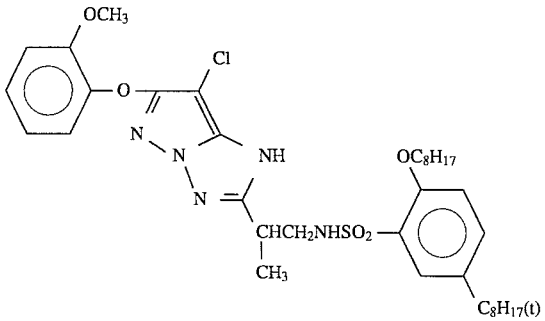

-continued
(M-10)
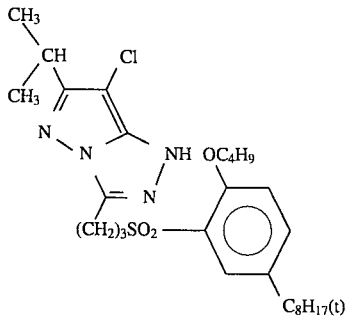
(M-11)
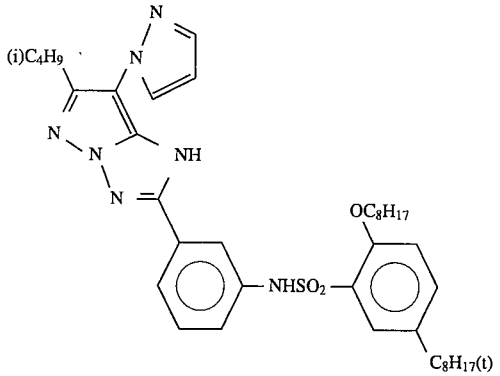
(M-12)
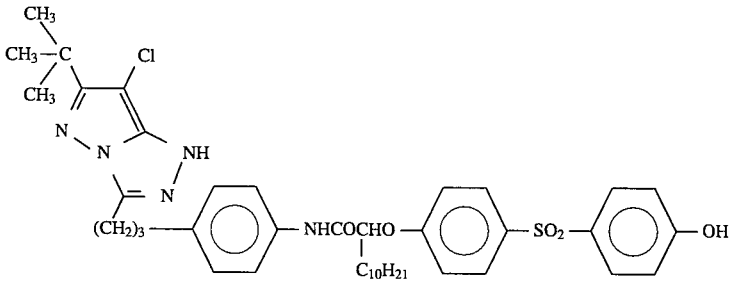
(M-13)
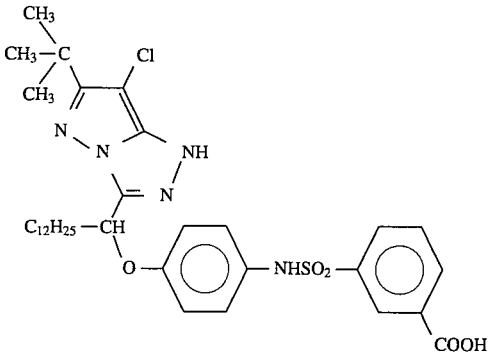

-continued
(M-14)
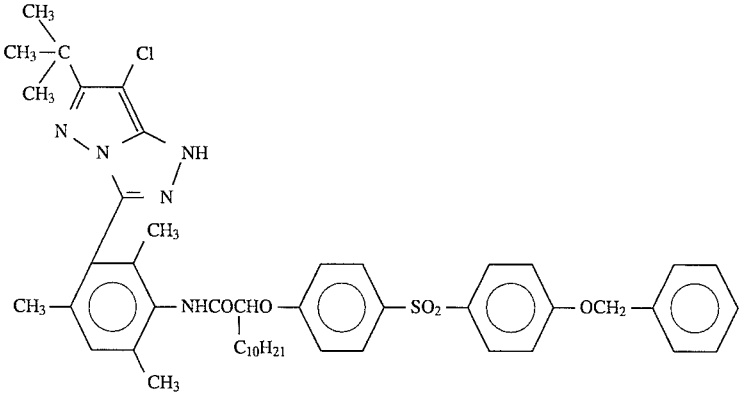
(M-15)
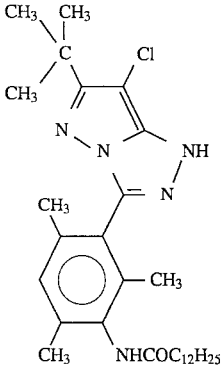
(M-16)
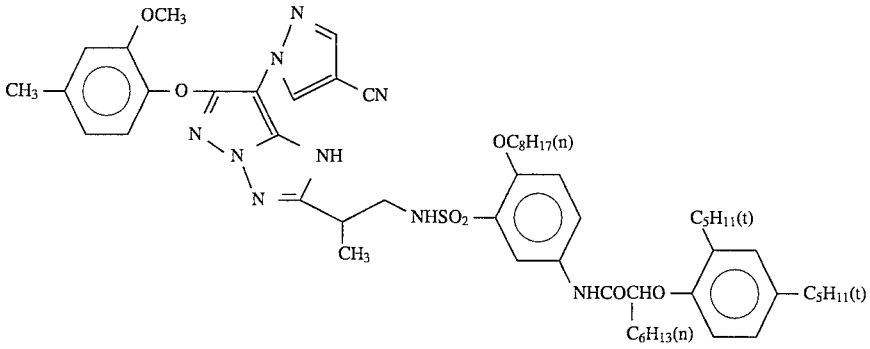
(M-17)
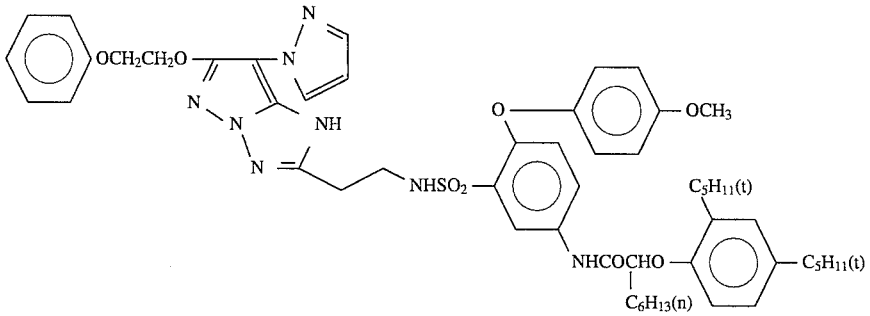

-continued
(M-18)
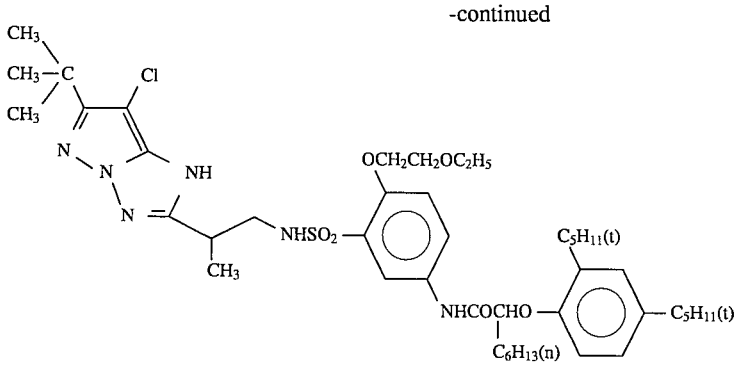
(M-19)
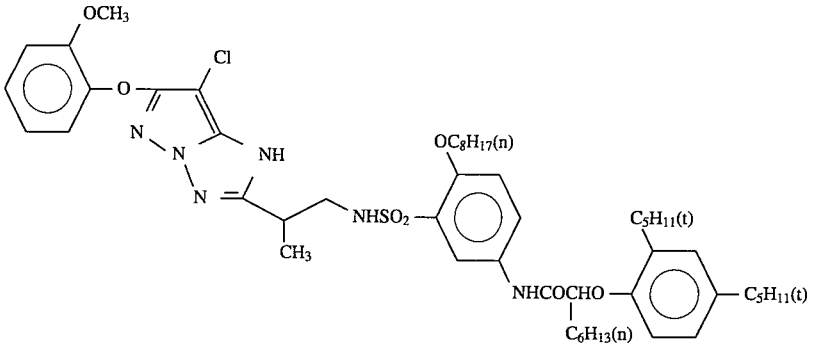
(M-20)
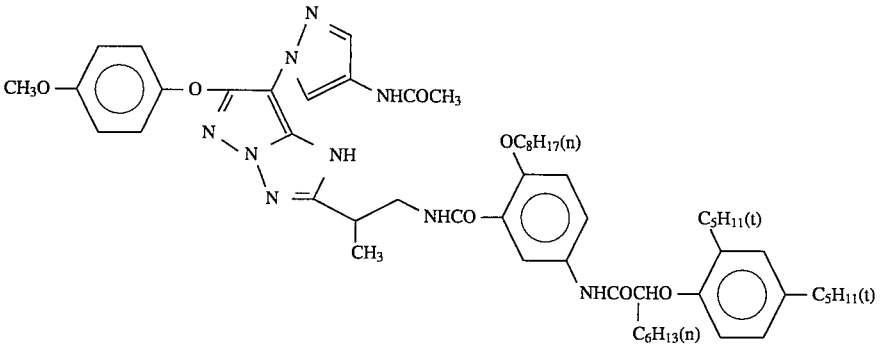
(M-21)
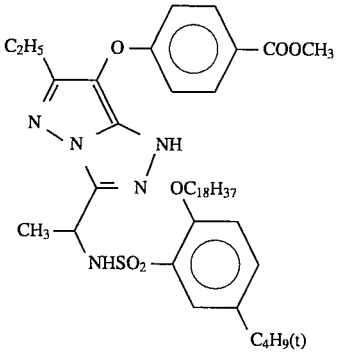
(M-22)
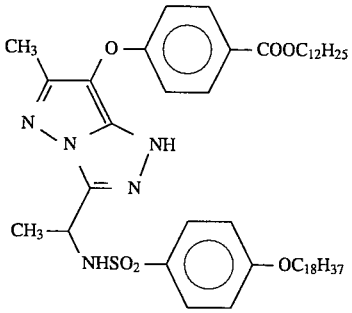

-continued
(M-23)
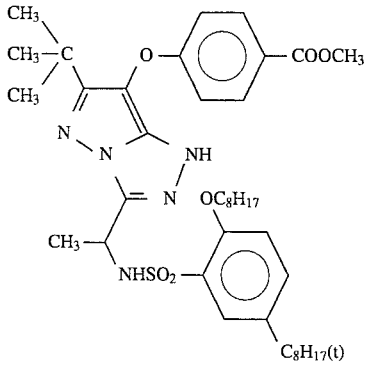
(M-24)
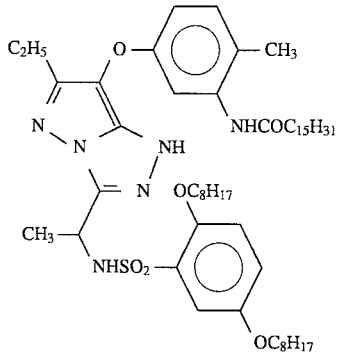
(M-25)
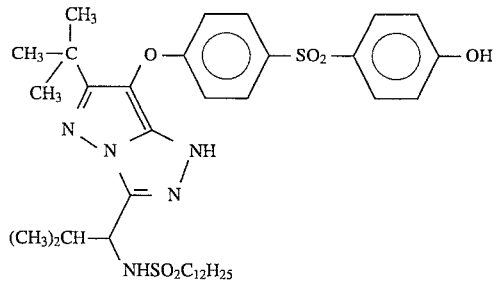
(M-26)
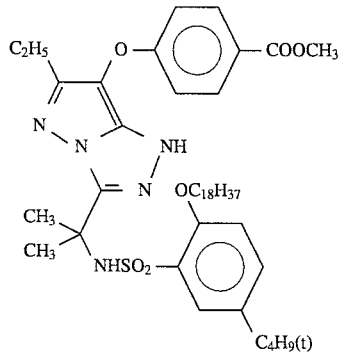

-continued
(M-27)
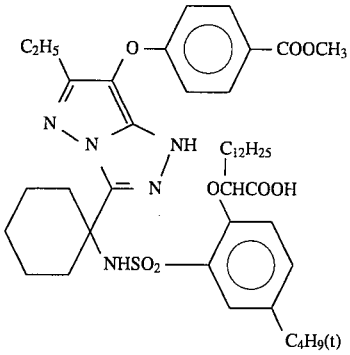
(M-28)
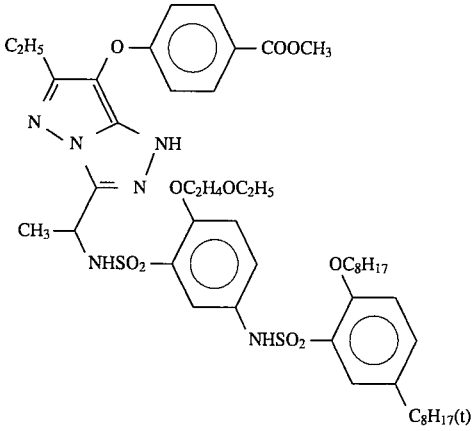
(M-29)
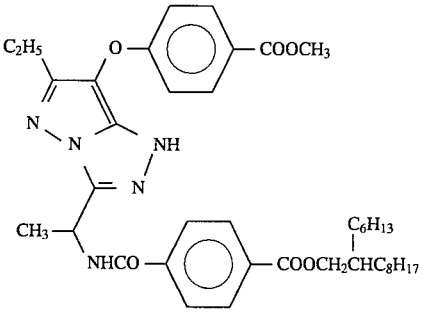
(M-30)
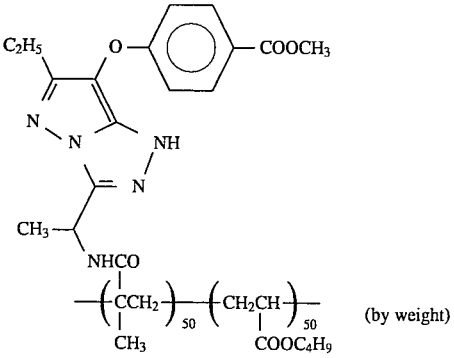
(by weight)

-continued (M-31)

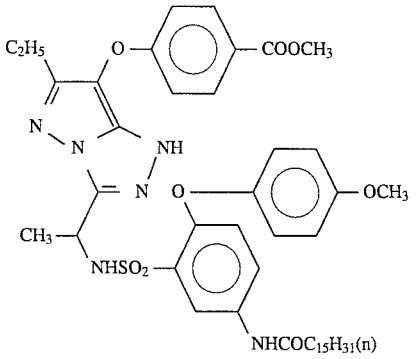

(M-32)

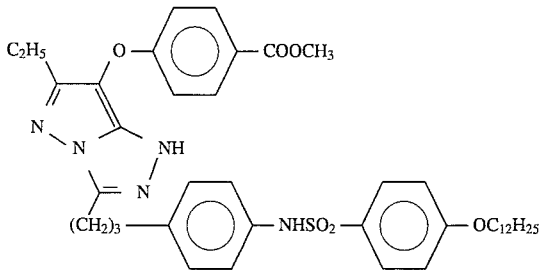

(M-33)

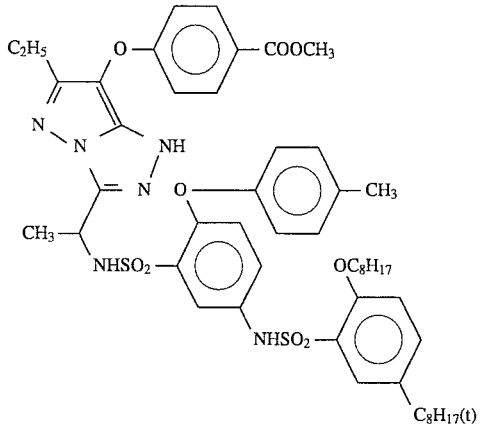

(M-34)

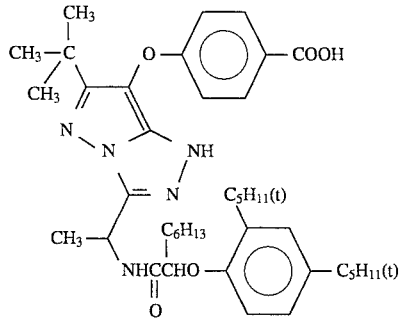

The synthesis method of the coupler represented by formula (M) is described in the following publications.

The compound represented by formula (M-I) can be synthesized by the method described in U.S. Pat. No. 4,500,630, the compound represented by formula (M-II) by the methods described in U.S. Pat. Nos. 4,540,654 and 4,705,863, JP-A-61-65245, JP-A-62-209457 and JP-A-62-249155, the compound represented by formula (M-III) by the methods described in JP-B-47-27411 and U.S. Pat. No. 3,725,067 and the compound represented by formula (M-IV) by the method described in JP-A-60-33552.

The magenta coupler represented by formula (M) is added to a green-sensitive emulsion layer and/or a layer adjacent thereto and the total addition amount thereof is from 0.01 to 5.0 g/m$^2$, preferably from 0.05 to 1.0 g/m$^2$, more preferably from 0.1 to 0.8 g/m$^2$. The addition of the magenta coupler of the present invention to a photographic material may be carried out in accordance with the addition method described later for other couplers, but the weight ratio of the high boiling point organic solvent used as a dispersion solvent to the whole couplers added to the magenta coupler-containing layer is from 0 to 10.0, preferably from 0 to 3.0, more preferably from 0.1 to 1.5.

The requirement (a) of the present invention will be described below.

In the present invention, it is preferred to use a surface- or inside-fogged silver halide grain in a light-sensitive silver halide emulsion layer or a layer adjacent to a light-sensitive silver halide emulsion layer. By taking such a constitution, the interlayer effect upon the emulsion layer to which the surface- or inside-fogged silver halide grain is added and the emulsion layer adjacent thereto can be elevated and the saturation of the color of the main coupler contained in the emulsion layer and the complementary color thereof can be improved, because the surface- or inside-fogged silver halide grain used encourages the development activity of the light-sensitive emulsion layer to thereby increase the interlayer effect provided thereto.

Further, in order to control the development progressing width and the development progressing speed in each layer upon development for high emulsion speed, it is preferred to use an inside-fogged emulsion and adjust the thickness of the shell of the inside-fogged emulsion added to each layer so that the necessary development speed can be achieved at a required timing.

The term "surface- or inside-fogged silver halide grain" as used herein means a silver halide grain which can ensure uniform (non-imagewise) development regardless of unexposed area or exposed area of the photographic material. The silver halide for forming an internal nucleus of the silver halide grain with the inside of the grain being fogged may be either one having the same halogen composition or one having different halogen compositions. The surface- or inside-fogged silver halide grain may be any of silver iodobromide, silver bromide, silver chloride, silver chlorobromide and silver chloroiodobromide. Preferred are silver bromide and silver iodobromide, and more preferred is silver iodobromide. There is no particular restriction on the grain size of the surface- or inside-fogged silver halide grain but the average grain size is preferably from 0.01 to 0.75 μm, more preferably from 0.05 to 0.6 μm. The emulsion may be polydisperse but it is preferably monodisperse (at least 95% by weight or by number of the silver halide grains has a grain size within the average grain size ±40%).

With respect to the use of the above-described surfaceor inside-fogged silver halide grain in practicing the present invention, for example, JP-B-59-35011, JP-B-1-38296 and publications cited therein may be referred to.

The requirement (b) of the present invention will be described below.

In the present invention, a DIR compound represented by formula (F) is very preferably used. By taking such a constitution, the interlayer effect upon the layer to which the compound represented by formula (F) is added and the layer adjacent thereto can be increased, because the DIR compound represented by formula (F) can increase the products capable of providing a state susceptible to the interlayer effect in proportion to the increase in the developed amount of the light-sensitive emulsion:

$$A—(L)_n—(G)_m—(Time)_t—X \quad (F)$$

wherein A represents a redox mother nucleus or a precursor thereof which is a group able to first allow the $—(Time)_2—X$ to split off when the group is oxidized during the photographic development processing, Time represents a group capable of releasing X after the release of the $—(Time)_t—X$ group and may have a timing controlling function, X represents a development inhibitor, L represents a divalent linking group, G represents an acidic group and n, m and t each represents 0 or 1, provided that when n is 1, m is not 0.

Examples of the DIR compound represented by formula (F) include DIR hydroquinone compounds described in U.S. Pat. Nos. 3,379,529 and 3,639,417, JP-A-49-129536, JP-A-64-546 and JP-A-3-226744 and DIR hydrazide compounds described in JP-A-61-213847, JP-A-64-88451 and U.S. Pat. No. 4,684,604, and these patents and publications cited therein may be referred to in practicing the present invention.

In the present invention, it is found that the technical difficulties encountered in using conventional DIR compounds can be overcome by using the DIR compound represented by formula (F).

The compound represented by formula (F) of the present invention will be described below in detail.

The redox mother nucleus represented by A follows the Kendall-Pelz Rule, and examples thereof include hydroquinone, catechol, p-aminophenol, o-aminophenol, 1,2-naphthalenediol, 1,4-naphthalenediol, 1,6-naphthalenediol, 1,2-aminonaphthol, 1,4-aminonaphthol, 1,6-aminonaphthol, gallate, gallic acid amido, hydrazine, hydroxylamine, pyrazolidone and reductone.

The amino group contained in the redox mother nucleus is preferably substituted by a sulfonyl group having from 1 to 25 carbon atoms or an acyl group having from 1 to 25 carbon atoms. Examples of the sulfonyl group include a substituted or unsubstituted aliphatic sulfonyl group or a substituted or unsubstituted aromatic sulfonyl group. Examples of the acyl group include a substituted or unsubstituted aliphatic acyl group or a substituted or unsubstituted aromatic acyl group. The hydroxyl group or the amino group constituting the redox mother nucleus represented by A may be protected by a protective group capable of deprotection at the time of development processing. Examples of the protective group include an acyl group, an alkoxycarbonyl group and a carbamoyl group each having from 1 to 25 carbon atoms and the protective groups described in JP-A-59-197037 and JP-A-59-201057. The protective group may combine, if possible, with the substituent of A, which will be described below, to form a 5-, 6- or 7-membered ring.

The redox mother nucleus represented by A may be substituted by a substituent at the position capable of substitution. Examples of the substituent include an alkyl group, an aryl group, an alkylthio group, an arylthio group, an alkoxy group, an aryloxy group, an amino group, an amido group, a sulfonamido group, an alkoxycarbonylamino group, a ureido group, a carbamoyl group, an alkoxycarbonyl group, a sulfamoyl group, a sulfonyl group, a cyano group, a halogen atom, an acyl group, a carboxyl group, a sulfo group, a nitro group, a heterocyclic residue or $—(L)_n—(G)_m—(Time)_2—X$, each having 25 or less carbon atoms. These substituents each may further be substituted by a substituent described above. These substituents may combine, if possible, with each other to form a saturated or unsaturated carbon ring or a saturated or unsaturated heterocyclic ring.

A is preferably hydroquinone, catechol, p-aminophenol, o-aminophenol, 1,4-naphthalenediol, 1,4-aminonaphthol, gallate, gallic acid amido or hydrazine, more preferably hydroquinone, catechol, p-aminophenol, o-aminophenol or hydrazine, and most preferably hydroquinone or hydrazine.

L represents a divalent linking group and preferred examples thereof include alkylene, alkenylene, arylene, oxyalkylene, oxyarylene, aminoalkyleneoxy, aminoalkenyleneoxy, aminoaryleneoxy and an oxygen atom.

G represents an acidic group and it is preferably —CO—, —CO—CO—, —CS—, —SO, $—SO_2—$, $—P(=O)(OR_{15})—$ or $—C(=NR_{16})—$ (wherein $R_{15}$ represents an alkyl group, an aryl group or a heterocyclic group and $R_{16}$ represents a hydrogen atom or a group described for $R_{15}$), more preferably —CO— or —CO—CO—, and most preferably —CO—.

n and m each is 0 or 1 and the preferred embodiment thereof varies depending on the kind of A. For example, when A is hydroquinone, catechol, aminophenol, naphthalenediol, aminonaphthol or a gallic acid, n is preferably 0 and more preferably, n and m both are 0.

When A is hydrazine or hydroxylamine, preferably n is 0 and m is 1 and when A is pyrazolidone, n and m both are preferably 1.

The —(Time)$_t$—X group is a group which is first released as —(Time)$_2$—X when the redox mother nucleus represented by A in formula (F) makes cross-oxidation reaction at the time of development to convert into an oxidation product.

Time is preferably linked with G through a sulfur atom, a nitrogen atom, an oxygen atom or a selenium atom.

Time represents a group capable of releasing X after the release of the —(Time)$_2$—X group and may have a timing controlling function. Also, Time may be a coupler which releases X upon reaction with an oxidation product of a developing agent or a redox group.

In the case when Time is a group having a timing controlling function, examples thereof include those described in U.S. Pat. Nos. 4,248,962 and 4,409,323, British Patent 2,096,783, U.S. Pat. No. 4,146,396, JP-A-51-146828 and JP-A-57-56837. Time may be a combination of two or more selected from those described in the above-described patents.

Preferred examples of the timing controlling group include those described below.

(1) Group using Cleavage Reaction of Hemiacetal

For example, U.S. Pat. No. 4,146,396, JP-A-60-249148 and JP-A-60-249149 describe thereon and the group is represented by formula (2):

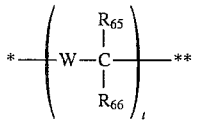

(a)

wherein the mark * represents a site for bonding at the left side in formula (F), the mark ** represents a site for bonding at the right side in formula (F), W represents an oxygen atom, a sulfur atom or an —N($R_{67}$)— group (wherein $R_{67}$; represents a substituent), $R_{65}$ and $R_{67}$ each represents a hydrogen atom or a substituent and t represents 1 or 2 and when t is 2, two —W—C($R_{65}$)($R_{66}$)— groups may be the same or different. When $R_{65}$ and $R_{66}$ each represents a substituent, representative examples of $R_{65}$, $R_{66}$ or $R_{67}$ include an $R_{69}$ group, an $R_{69}$CO— group, an $R_{69}SO_2$— group, an N($R_{69}$)($R_{70}$)CO— group and an N($R_{69}$)($R_{70}$)$SO_2$— group, wherein $R_{69}$ represents an aliphatic group, an aromatic group or a heterocyclic group and R70 represents an aliphatic group, an aromatic group, a heterocyclic group or a hydrogen atom. $R_{65}$, $R_{66}$ and $R_{67}$ each may be a divalent group and combined with each other to form a cyclic structure.

(2) Group which causes Cleavage Reaction using Intramolecular Nucleophilic Substitution Reaction The group is a timing group described, for example, in U.S. Pat. No. 4,248,962 and represented by formula: *-Nu-Link-E-** wherein the mark * represents a site for bonding at the left side in formula (F), the mark  represents a site for bonding at the right side in formula (F), Nu represents a nucleophilic group, for example, an oxygen atom or a sulfur atom, E represents an electrophilic group which is a group capable of cleaving the bonding to the site  upon the nucleophilic attack by Nu and Link represents a linking group for sterically positioning Nu and E so as to cause an intramolecular nucleophilic substitution reaction therebetween.

(3) Group which causes Cleavage Reaction using Electron Transfer Reaction along Conjugated System The group is described, for example, in U.S. Pat. Nos. 4,409,323 and 4,421,845 and represented by the following formula:

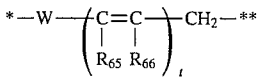

wherein the marks * and **, W, $R_{65}$, $R_{66}$ and t each has the same meaning as defined in formula (a).

(4) Group using Cleavage Reaction by Hydrolysis of Ester

The group is a linking group described, for example, in West German Patent Application (OLS) No. 2,626,315 and includes *—O—C(O)—** and *—O—C(S)—**, wherein the marks * and ** each has the same meaning as defined in formula (a).

(5) Group using Cleavage Reaction of Iminoketal

The group is a linking group described, for example, in U.S. Pat. No. 4,546,073 and represented by the following formula:

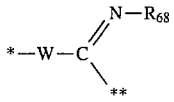

wherein the marks * and ** and W each has the same meaning as defined in formula (a) and $R_{68}$ has the same meaning as $R_{67}$.

Examples of the coupler or the redox group represented by D include the following.

In the case of a phenol-type coupler, the coupler is bonded to G of formula (F) through an oxygen atom after removal of a hydrogen atom from a hydroxyl group. In the case of a 5-pyrazolone-type coupler, the coupler is bonded to G though an oxygen atom after removal of a hydrogen atom from a hydroxy group in the from of tautomerism to 5-hydroxypyrazole. Either coupler acts as a coupler first when it is released from G and reacts with an oxidation product of a developing agent to release X bonded to the coupling site thereof.

Preferred examples of the coupler represented by Time include the following groups:

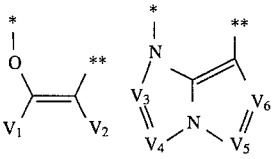

-continued

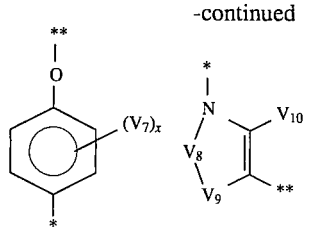

wherein $V_1$ and $V_2$ each represents a substituent, $V_3$, $V_4$, $V_5$ and $V_6$ each represents a nitrogen atom or a methine group, $V_7$ represents a substituent, x represents 0 or an integer of from 1 to 4 and when x is a plural number, the $V_7$ groups may be the same or different and two $V_7$ groups may be combined to form a cyclic structure, $V_8$ represents a —CO— group, —$SO_2$— group, an oxygen atom or a substituted imino group, $V_9$ represents a nonmetallic atom group necessary for forming a 5-, 6-, 7- or 8-membered ring and $V_{10}$ represents a hydrogen atom or a substituent.

$V_1$, $V_2$, $V_7$ and $V_{10}$ each represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a sulfonyl group, an aryloxycarbonyl group, an acyl group or an azolyl group, and $V_1$, $V_2$, $V_7$ and $V_{10}$ each may form a bis form by a divalent group.

More specifically, $V_1$, $V_2$, $V_7$ and $V_{10}$ each represents a hydrogen atom, a halogen atom (e.g., chlorine, bromine), an alkyl group (e.g., a linear or branched alkyl group having from 1 to 32 carbon atoms, an aralkyl group, an alkenyl group, an alkynyl group, a cycloalkyl group, a cycloalkenyl group; specific examples of these groups include ethyl, methyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy] dodecaneamido}phenyl}propyl, 2-ethoxytridecyl, trifluoromethyl, cyclopentyl and 3-(2,4-di-t-amylphenoxy)propyl), an aryl group (e.g., phenyl, 4-t-butylphenyl, 2,4-di-t-amylphenyl, 4-tetradecaneamidophenyl), a heterocyclic group (e.g., 2-furyl, 2-thienyl, 2-pyrimidinyl, 2-benzothiazolyl), a cyano ring, a hydroxyl group, a nitro group, a carboxyl group, an amino group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, 3-methoxycarbamoyl), an acylamino group (e.g., acetamido, benzamido, tetradecaneamido, 2-(2,4-di-t-amylphenoxy)butaneamido, 4-(3-t-butyl-4-hydroxyphenoxy)butaneamido, 2-{4-(4-hydroxyphenylsulfonyl)phenoxy}decaneamido), an alkylamino group (e.g., methylamino, butylamino, dodecylamino, diethylamino, methylbutylamino), an anilino group (e.g., phenylamino, 2-chloroanilino, 2-chloro-5-tetradecaneaminoanilino, 2-chloro-5-dodecyloxycarbonylanilino, N-acetylanilino, 2-chloro-5-{α-(3-t-butyl-4-hydroxyphenoxy)dodecaneamido}anilino), a ureido group (e.g., phenylureido, methylureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-toctylphenylthio, 3-pentadecylphenylthio, 2-carboxyphenylthio, 4-tetradecaneamidophenylthio ), an alkoxycarbonylamino group (e.g., methoxycarbonylamino, tetradecyloxycarbonylamino), a sulfonamido group (e.g., methanesulfonamido, hexadecanesulfonamido, benzenesulfonamido, p-toluenesulfonamido, octadecanesulfonamido, 2-methyloxy-5-t-butylbenzenesulfonamido), a carbamoyl group (e.g., N-ethylcarbamoyl, N,N-dibutylcarbamoyl, N-(2-dodecyloxyethyl) carbamoyl, N-methyl-N-dodecylcarbamoyl, N-(3-(2,4-di-t-amylphenoxy)propyl}carbamoyl), a sulfamoyl group (e.g. , N-ethylsulfamoyl, N,N-dipropylsulfamoyl, N-(2-dodecyloxyethyl ) sulfamoyl, N-ethyl-N-dodecylsulfamoyl, N,N-diethylsulfamoyl), a sulfonyl group (e.g., methanesulfonyl, octanesulfonyl, benzenesulfonyl, toluene-sulfonyl), an alkoxycarbonyl group (e.g., methoxycarbonyl, butyloxycarbonyl, dodecyloxycarbonyl, octadecyloxycarbonyl), a heterocyclic oxy group (e.g., 1-phenyltetrazole-5-oxy, 2-tetrahydropyranyloxy), an azo group (e.g., phenylazo, 4-methoxyphenylazo, 4-pivaloylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g., phenoxycarbonylamino), an imido group (e.g., N-succinimido, N-phthalimido, 3-octadecenylsuccinimido), a heterocyclic thio group (e.g., 2-benzothiazolylthio, 2,4-di-phenoxy-1,3,5-triazole-6-thio, 2-pyridylthio), a sulfinyl group (e.g., dodecanesulfinyl, 3-pentadecylphenylsulfinyl, 3-phenoxypropylsulfinyl), a phosphonyl group (e.g., phenoxyphosphonyl, octyloxyphosphonyl, phenylphosphonyl), an aryloxycarbonyl group (e.g., phenoxycarbonyl), an acyl group (e.g., acetyl, 3-phenylpropanoyl, benzoyl, 4-dodecyloxybenzoyl) or an azolyl group (e.g., imidazolyl, pyrazolyl, 3-chloropyrazole-1-yl, triazole).

When the group represented by Time in formula (F) is a redox compound, the group is preferably represented by formula: *—P(Y=Z)$_k$—Q—B, wherein P and Q each independently represents an oxygen atom or an imino group, at least one of Y and Z of k in number represents a methine group having X as a substituent and the remaining Y and Z each represents a methine group or a nitrogen atom, k represents an integer of from 1 to 3 (the Y or Z groups of k in number may be the same or different), B represents a hydrogen atom or a group capable of being removed in alkali. At least two groups of P, Y, Z, Q and B may be a divalent group and combined to form a cyclic structure. For example, (Y=Z)$_k$ may form a benzene ring or a pyridine ring.

The substituted or unsubstituted imino group represented by P or Q is preferably an imino group substituted by a sulfonyl group or an acyl group.

In this case, P and Q each is represented by the following formula:

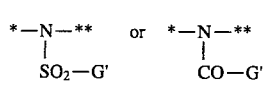

wherein the mark * represents a site for bonding to G of formula (F) or a site for bonding to B of formula: *—P(Y=Z)$_k$—Q—B, the mark ** represents a site for bonding to one of the free bonds of (Y=Z)$_k$— and G' represents an aliphatic group, an aromatic group or a heterocyclic group.

The group represented by formula, *—P(Y=Z)$_k$—Q—B, is more preferably a group shown below:

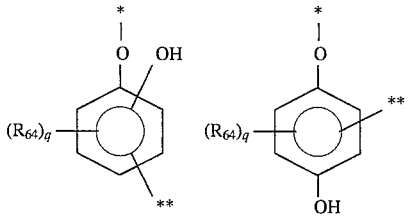

wherein the mark * represents a site for bonding to G of formula (F), the mark ** represents a site for bonding to X, $R_{64}$ represents a substituent, q represents 0 or an integer of from 1 to 3 and when q is 2 or greater, the two or more $R_{64}$ groups may be the same or different. When two $R_{64}$ groups each is a substituent on the carbon atoms adjacent to each other, the substituents may be a divalent group and combined to form a cyclic structure.

$R_{64}$ represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a sulfonyl group, an aryloxycarbonyl group, an acyl group or an azolyl group, and $R_{64}$ may form a bis form by a divalent group.

More specifically, $R_{64}$ represents a hydrogen atom, a halogen atom (e.g., chlorine, bromine), an alkyl group (e.g., a linear or branched alkyl group having from 1 to 32 carbon atoms, an aralkyl group, an alkenyl group, an alkynyl group, a cycloalkyl group, a cycloalkenyl group; specific examples of these groups include ethyl, methyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecaneamido}phenyl}propyl, 2-ethoxytridecyl, trifluoromethyl, cyclopentyl and 3-(2,4-di-t-amylphenoxy)propyl), an aryl group (e.g., phenyl, 4-t-butylphenyl, 2,4-di-t-amylphenyl, 4-tetradecaneamidophenyl), a heterocyclic group (e.g., 2-furyl, 2-thienyl, 2-pyrimidinyl, 2-benzothiazolyl), a cyano ring, a hydroxyl group, a nitro group, a carboxyl group, an amino group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, 3-methoxycarbamoyl), an acylamino group (e.g., acetamido, benzamido, tetradecaneamido, 2-(2,4-di-t-amylphenoxy)butaneamido, 4-(3-t-butyl-4-hydroxyphenoxy)butaneamido, 2-{4-(4-hydroxyphenylsulfonyl)phenoxy}decaneamido), an alkylamino group (e.g., methylamino, butylamino, dodecylamino, diethylamino, methylbutylamino), an anilino group (e.g., phenylamino, 2-chloroanilino, 2-chloro-5-tetradecaneaminoanilino, 2-chloro-5-dodecyloxycarbonylanilino, N-acetylanilino, 2-chloro-5-{α-(3-t-butyl-4-hydroxyphenoxy)dodecaneamido}anilino), a ureido group (e.g., phenylureido, methylureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecaneamidophenylthio), an alkoxycarbonylamino group (e.g., methoxycarbonylamino, tetradecyloxycarbonylamino), a sulfonamido group (e.g., methanesulfonamido, hexadecanesulfonamido, benzenesulfonamido, p-toluenesulfonamido, octadecanesulfonamido, 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-(3-(2,4-di-t-amylphenoxy)propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonyl), an alkoxycarbonyl group (e.g., methoxycarbonyl, butyloxycarbonyl, dodecyloxycarbonyl, octadecyloxycarbonyl), a heterocyclic oxy group (e.g., 1 -phenyltetra zole-5 -oxy, 2-tetrahydropyranyloxy), an azo group (e. g. , phenylazo, 4 -methoxyphenylazo, 4-pivaloylaminophenylazo, 2-hydroxy-4-propanoylphenylazo ), an acyloxy group (e.g., acetoxy ), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g., phenoxycarbonylamino), an imido group (e.g., N-succinimido, N-phthalimido, 3-octadecenylsuccinimido), a heterocyclic thio group (e.g., 2-benzothiazolylthio, 2,4-di-phenoxy-l,3,5-triazole-6-thio, 2-pyridylthio), a sulfinyl group (e.g., dodecanesulfinyl, 3-pentadecylphenylsulfinyl, 3-phenoxypropylsulfinyl), a phosphonyl group (e.g., phenoxyphosphonyl, octyloxyphosphonyl, phenylphosphonyl), an aryloxycarbonyl group (e.g., phenoxycarbonyl), an acyl group (e.g., acetyl, 3-phenylpropanoyl, benzoyl, 4-dodecyloxybenzoyl) or an azolyl group (e.g., imidazolyl, pyrazolyl, 3-chloropyrazole-1-yl, triazole).

X represents a development inhibitor and preferred examples of the development inhibitor represented by X include a compound having a mercapto group bonded to a heterocyclic ring, which is represented by formula (b), and a heterocyclic compound capable of forming imino silver, which is represented by formula (c):

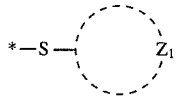

(b)

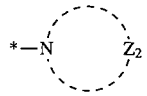

(c)

wherein $Z_1$ represents a nonmetallic atom group necessary for forming a monocyclic or condensed heterocyclic ring, $Z_2$ represents a nonmetallic atom group necessary for forming a monocyclic or condensed heterocyclic ring together with N, provided that the heterocyclic ring may have a substituent, and * represents a site for bonding to Time.

The heterocyclic ring formed by $Z_1$ or $Z_2$ is more preferably a 5-, 6-, 7- or 8-membered heterocyclic ring containing at least one of nitrogen, oxygen, sulfur and selenium as a hetero atom, most preferably a 5- or 6-membered heterocyclic ring.

Examples of the heterocyclic ring represented by $Z_1$ include azoles (e.g., tetrazole, 1,2,4-triazole, 1,2,3triazole, 1,3,4-thiadiazole, 1,3,4-oxadiazole, 1,3-thiazole, 1,3-oxazole, imidazole, benzothiazole, benzoxazole, benzimidazole, pyrrole, pyrazole, indazole), azaindenes (e.g., tetrazaindene, pentazaindene, triazaindene) and azines (e.g., pyrimidine, triazine, pyrazine, pyridazine).

Examples of the heterocyclic ring represented by $Z_2$ include triazoles (e.g., 1,2,4-triazole, benzotriazole, 1,2,3-triazole), indazole, benzimidazole, azaindenes (e.g., tetrazaindene, pentazaindene) and tetrazole. Preferred examples of the substituent which the development inhibitor represented by formula (b) or (c) has, include the followings:

an $R_{77}$ group, an $R_{78}O-$ group, an $R_{77}S-$ group, an $R_{77}OCO-$ group, an $R_{77}OSO_2-$ group, a halogen atom, a cyano group, a nitro group, an $R_{77}SO_2-$ group, an $R_{78}CO-$ group, an $R_{77}COO-$ group, an $R_{77}SO_2N(R_{78})-$ group, an $R_{78}NSO_2(R_{79})-$ group, an $R_{78}NCO(R_{79})-$ group, an

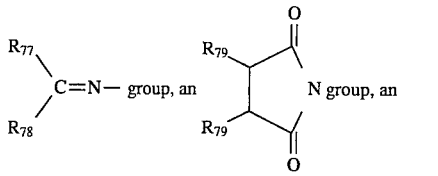

$R_{77}R_{78}C{=}N-$ group, an

N group, an $R_{77}R_{78}N-$ group, an $R_{78}CON(R_{79})-$ group, an $R_{77}OCON(R_{78})-$ group, $R_{78}NCOCN(R_{79})(R_{80})-$ group, an $R_{77}SO_2O-$ group, a

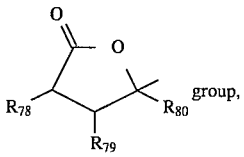

group, wherein $R_{77}$ represents an aliphatic group, an aromatic group or a heterocyclic group and $R_{78}$, $R_{79}$ and $R_{80}$ each represents an aliphatic group, an aromatic group, a heterocyclic group or hydrogen atom. When two or more $R_{77}$, $R_{78}$, $R_{79}$ or $R_{80}$ groups are present in one molecule, they may be combined to form a ring (e.g., benzene ring).

Examples of the compound represented by formula (b) include substituted or unsubstituted mercaptoazoles (e.g., 1-phenyl-5-mercaptotetrazole, 1-propyl-5-mercaptotetrazole, 1-butyl-5-mercaptotetrazole, 2-methylthio-5-mercapto-1,3,4-thiadiazole, 3-methyl-4-phenyl-5-mercapto-1,2,4-triazole, 1-(4-ethylcarbamoylphenyl)-2-mercaptoimidazole, 2-mercaptobenzoxazole, 2-mercaptobenzimidazole, 2-mercaptobenzothiazole, 2-mercaptobenzoxazole, 2-phenyl-5-mercapto-1,3,4-oxadiazole, 1-{3-(3-methylureido)phenyl}-5-mercaptotetrazole, 1-(4-nitrophenyl)-5-mercaptotetrazole, 5-(2-ethylhexanoylamino)-2-mercaptobenzimidazole), substituted or unsubstituted mercaptoazaindenes (e.g., 6-methyl-4-mercapto-1,3,3a,7-tetrazaindene, 4,6-dimethyl-2-mercapto-1,3,3a,7-tetrazaindene) and substituted or unsubstituted mercaptopyrimidines (e.g., 2-mercaptopyrimidine, 2-mercapto-4-methyl-6-hydroxypyrimidine).

Examples of the heterocyclic compound capable of forming imino silver include substituted or unsubstituted triazoles (e.g., 1,2,4-triazole, benzotriazole, 5-methylbenzotriazole, 5-nitrobenzotriazole, 5-bromobenzotriazole, 5-n-butylbenzotriazole, 5,6-dimethylbenzotriazole), substituted or unsubstituted indazoles (e.g., indazole, 5-nitroindazole, 3-nitroindazole, 3-chloro-5-nitroindazole) and substituted or unsubstituted benzimidazoles (e.g., 5-nitrobenzimidazole, 5,6-dichlorobenzimidazole).

Also, X may be one which is released from Time of Formula (F) to convert once into a compound having development inhibiting property and then causes a certain kind of chemical reaction with the developer component to convert into a compound having substantially no or extremely diminished development inhibiting property. Examples of the functional group to be subjected to such a chemical reaction include an ester group, a carbonyl group, an imino group, an immonium group, a Mickel addition receptor group and an imido group.

Examples of the deactivation-type development inhibitor include development inhibitor residues described in U.S. Pat. No. 4,477,563, JP-A-60-218644, JP-A-60-221750, JP-A-60-233650 and JP-A-61-11743.

Among these, those having an ester group are particularly preferred. Specific examples thereof include 1-(3-phenoxycarbonylphenyl)-5-mercaptotetrazole, 1-(4-phenoxycarbonylphenyl)-5-mercaptotetrazole, 1-(3-maleinimidophenyl)-5-mercaptotetrazole, 5-phenoxycarbonylbenzotriazole, 5-(4-cyanophenoxycarbonyl)benzotriazole, 2-phenoxycarbonylmethylthio-5-mercapto-1,3,4-thiadiazole, 5-nitro-3-phenoxy-5-(2,3-dichloropropyloxycarbonyl-)carbonylimidazole, benzotriazole, 1-(4-benzoyloxyphenyl)-5-mercaptotetrazole, 5-(2-methanesulfonylethoxycarbonyl)-2-mercaptobenzothiazole, 5-cinnamoylaminobenzotriazole, 1-(3-vinylcarbonylphenyl)-5-mercaptotetrazole, 5-succinimidomethylbenzotriazole, 2-{4-succinimidophenyl}-5-mercapto-1,3,4-oxadiazole, 6-phenoxy-carbonyl-2-mercaptobenzoxazole, 2-(1-methoxycarbonylethylthio)-5-mercapto-1,3,4-thiadiazole, 2-butoxycarbonylmethoxycarbonylmethyl thio-5-mercapto-1,3,4-thiadiazole, 2-(N-hexylcarbamoylmethoxycarbonylmethylthio)-5-mercapto-1,3,4-thiadiazole. and 5-butoxycarbonylmethoxycarbonylbenzotriazole.

The compound represented by formula (F) is more preferably a compound represented by formula (G)) or (H):

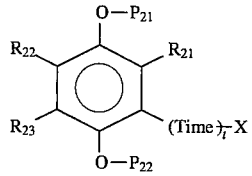

(G)

wherein $R_{21}$, $R_{22}$ and $R_{23}$ each represents a hydrogen atom or a group capable of substitution to the hydroquinone nucleus, and $P_{22}$ each represents a hydrogen atom or a group capable of deprotection at the time of development processing and Time, X and t each has the same meaning as defined in formula (F);

$$R_{31}-N(P_{31})-N(P_{32})-G-(Time)_t-X \quad (H)$$

wherein $R_{31}$ represents an aryl group, a heterocyclic group, an alkyl group, an aralkyl group, an alkenyl group or an alkynyl group, $P_{31}$ and $P_{32}$ each represents a hydrogen atom or a protective group capable of deprotection at the time of development processing and G, Time, X and t each has the same meaning as defined in formula (F).

Formula (G) will be described below in more detail.

The substituent represented by $R_{21}$, $R_{22}$ or $R_{23}$ includes those described as the substituent of A in formula (F) but $R_{22}$ and $R_{23}$ each is preferably a hydrogen atom, an alkylthio group, an arylthio group, an alkoxy group, an aryloxy group, an amido group, a sulfonamido group, an alkoxycarbonylamino group or a ureido group, more preferably a hydrogen atom, an alkylthio group, an alkoxy group, an amido group, a sulfonamido group, an alkoxycarbonylamino group or a ureido group.

$R_{21}$ is preferably a hydrogen atom, a carbamoyl group, an alkoxycarbonyl group, a sulfamoyl group, a sulfonyl group, a cyano group, an acyl group or a heterocyclic group, more preferably a hydrogen atom, a carbamoyl group, an alkoxycarbonyl group, a sulfamoyl group or a cyano group. R22 and $R_{23}$ may be combined with each other to form a ring.

Examples of the protective group represented by $P_{21}$ or $P_{22}$ include those described as the protective group for the hydroxyl group of A in formula (i), and preferred examples thereof include an acyl group, an alkoxycarbonyl group, an aryloxycarbonyl group, a carbamoyl group, an imidoyl group, an oxazolyl group, a group capable of hydrolysis such as a sulfonyl group, a precursor group using a reversal Mickel reaction described in U.S. Pat. No. 4,009,029, a precursor group using an anion generated after the ring cleavage reaction as an intramolecular nucleophilic group described in U.S. Pat. No. 4,310,612, a precursor group causing a cleavage reaction due to the electron transfer of an anion through a conjugated system described in U.S. Pat. Nos. 3,674,478, 3,932,480 and 3,993,661, a precursor group causing a cleavage reaction due to the electron transfer of an anion reacted after the ring cleavage described in U.S. Pat. No. 4,335,200 and a precursor group using an imidomethyl group described in U.S. Pat. Nos. 4,363,865 and 4,410,618.

$P_{21}$ and $P_{22}$ each is preferably a hydrogen atom.

X is preferably a mercaptoazole or a benzotriazole. More preferred examples of the mercaptoazole include a mercaptotetrazole, 5-mercapto-1,3,4-thiadiazole and a 5- =mercapto-1,3,4-oxadiazole.

X is most preferably a 5-mercapto-1,3,4-thiadiazole.

The compound represented by formula (G) is preferably a compound represented by formula (I) or (J):

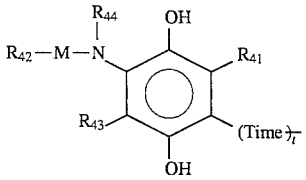

(I)

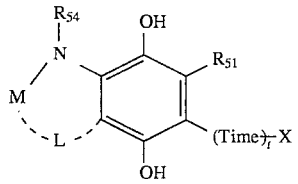

(J)

wherein $R_{42}$ represents an aliphatic group, an aromatic group, a heterocyclic group, M represents —C(O)—, —$SO_2$—, —($R_4$s)N—C(O—), —O—C(O)— or —($R_{45}$)N—$SO_2$—, $R_{44}$, $R_{45}$ and $R_{54}$ each represents a hydrogen atom, an alkyl group or an aryl group, L represents a divalent linking group necessary for forming a 5-, 6- or 7-membered ring, $R_{41}$ and $R_{51}$ each has the same meaning as $R_{21}$ defined in formula (G), and $R_{43}$ and —$(Time)_t$—X each has the same meaning as $R_{23}$ and —$(Time)_t$—X defined in formula (G), respectively. To state more specifically about $R_{42}$, the aliphatic group represented by $R_{42}$ includes a linear, branched or cyclic alkyl, alkenyl or alkynyl group having from 1 to 30 carbon atoms, the aromatic group includes an aromatic group having from 6 to 30 carbon atoms such as a phenyl group and a naphthyl group, and the heterocyclic ring includes 3- to 12-membered heterocyclic rings each containing at least one of nitrogen, oxygen and sulfur. These groups each may be further substituted by a group described for the substituent of A.

Formula (H) will be described below in detail.

The aryl group represented by $R_{31}$ includes an aryl group having from 6 to 20 carbon atoms such as phenyl and naphthyl, the heterocyclic group includes a 5-, 6- or 7-membered heterocyclic group containing at least one of nitrogen, oxygen and sulfur, such as furyl and pyridyl, the alkyl group includes an alkyl group having from 1 to 30 carbon atoms such as methyl, hexyl and octadecyl, the aralkyl group includes an aralkyl group having from 7 to 30 carbon atoms such as benzyl and trityl, the alkenyl group includes an alkenyl group having from 2 to 30 carbon atoms such as allyl, and the alkynyl group includes an alkynyl group having from 2 to 30 carbon atoms such as propargyl. $R_{31}$ is preferably an aryl group, more preferably phenyl.

Examples of the protective group represented by $P_{31}$ or $R_{32}$ include those described for the protective group of an amino group of A in formula (F). $P_{31}$ and $P_{31}$ each is preferably a hydrogen atom.

G is preferably —CO— and X is preferably one described in formula (G).

$R_{21}$, $R_{22}$ and $R_{23}$ of formula (G) and $R_{31}$ of formula (H) each may be substituted by a substituent. The substituent may have a so-called ballast group or an adsorption group to silver halide so as to impart non-diffusibility but it preferably has a ballast group. When $R_{31}$ is a phenyl group, the substituent is preferably an electron-withdrawing group and examples thereof include a sulfonamido group, an amido group, an alkoxy group and a ureido group. When $R_{21}$, $R_{22}$, $R_{23}$ or $R_{31}$ has a ballast group, it is particularly preferred to have a polar group in the molecule, such as a hydroxyl group, a carboxyl group or a sulfo group.

Specific examples of the compound represented by formula (F) include Compounds I-1 to 1-87 described in JP-A-6-222522, from page 12, first part to page 26, upper half part, however, the compound which can be used in the present invention is by no means limited to these.

The compound represented by formula (F) of the present invention can be synthesized according to the methods described, for example, in JP-A-49-129536, JP-A-52-57828, JP-A-60-21044, JP-A-60-233642, JP-A-60-233648, JP-A-61-18946, JP-A61-156043, JP-A-61-213847, JP-A-61-230135, JP-A-61-236549, JP-A-62-62352, JP-A-62-103639 and U.S. Pat. Nos. 3,379,529, 3,620,746, 4,332,828, 4,377,634 and 4,684,604.

The compound represented by formula (F) may be added to any emulsion layer and/or any light-insensitive layer. The compound may be added to both layers. The addition amount is preferably from 0.001 to 0.2 mmol/$m^2$, more preferably from 0.01 to 0.1 mmol/$m^2$.

The requirement (c) of the present invention will be described below.

The compound represented by formula (ii) can be very preferably used in the present invention. The compound can elevate the interlayer effect provided to the layer where the compound represented by formula (ii) is added or to an emulsion layer adjacent thereto, because the compound represented by formula (ii) acts to render the layer susceptible to the interlayer effect.

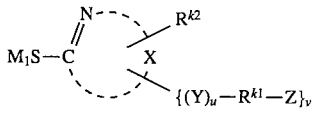

(ii)

wherein $M_1$ represents a hydrogen atom, a cation or a protective group of the mercapto group to be cleaved in alkali, X represents an atomic group necessary for forming a 5- or 6-membered heterocyclic ring, with two or three nitrogen atoms being present in the five or six atoms constituting the heterocyclic ring, $R^{k1}$ represents a linear or branched alkylene, alkenylene, aralkylene or arylene group, Y represents a divalent polar linking group, $R^{k2}$ represents a hydrogen atom or a group capable of substitution thereto, Z represents a polar substituent, u represents 0 or 1 and v represents 0, 1 or 2.

More specifically, $M_1$ represents a hydrogen atom, a cation (e.g., sodium ion, potassium ion, ammonium ion) or a protective group of the mercapto group to be cleaved in alkali (e.g., $—COR^{kA1}$, $—COOR^{kA1}$, $—CH_2CH_2COR^{kA1}$, wherein $R^{kA1}$ represents a hydrogen atom, an alkyl group, an aralkyl group or an aryl group).

X represents an atomic group necessary for forming a 5- or 6-membered heterocyclic ring, in which two or three nitrogen atoms are present in the five or six atoms constituting the heterocyclic ring and the remaining hetero atoms are a sulfur, selenium or oxygen atom. Examples of the 5- or 6-membered heterocyclic ring include triazole, imidazole, thiadiazole, triazine, azabenzimidazole, tetraazaindene, triazaindene, benzotriazole, benzimidazole and naphthoimidazole.

Y represents a divalent polar linking group and examples thereof include —S—, —O—, $—N(R^{kB1})—$, $—C(O)—N(R^{kB2})—$, $—N(R^{kB3})—C(O)—$, $—SO_2N(R^{kB4})—$, $—N(R^{kB5})SO_2—$, —C(O)O—, —OC(O)—, —C(O)—, $—N(R^{kB6})—C(O)—N(R^{kB7})—$, $—N(R^{kB8})—C(S)—N(R^{kB9})—$ and $—N(R^{kB10})—C(O)—C—$, wherein $R^{kB1}$, $R^{kB2}$, $R^{kB3}$, $R^{kB4}$, $R^{kB5}$, $R^{kB6}$, $R^{kB8}$, $R^{kB9}$ and $R^{kB10}$ each represents a hydrogen atom or an alkyl, aryl, alkenyl or aralkyl group.

Examples of the polar substituent represented by Z include an amino group, a quaternary ammoniumyl group, an alkoxyl group, an aryloxy group, an alkylthio group, an arylthio group, a heterocyclic oxy group, a heterocyclic thio group, a sulfonyl group, a carbamoyl group, a sulfamoyl group, a carbonamido group, a sulfonamido group, an acyloxy group, a ureido group, an acyl group, an aryloxycarbonyl group, a thioureido group, a sulfonyloxy group, a heterocyclic group and a hydroxy group.

$R^{k2}$ represents a hydrogen atom or a group capable of substitution thereto and examples of the group capable of substitution include a halogen atom (e.g., fluorine, chlorine, bromine), an alkyl group having from 1 to 6 carbon atoms, an aryl group having from 6 to 12 carbon atoms, an alkoxy group having from 1 to 6 carbon atoms, an aryloxy group having from 6 to 12 carbon atoms, a sulfonyl group having from 1 to 12 carbon atoms, a sulfonamido group having from 1 to 12 carbon atoms, a sulfamoyl group having from 1 to 12 carbon atoms, a carbamoyl group having from 1 to 12 carbon atoms, an amido group having from 2 to 12 carbon atoms, a ureido group having from 1 to 12 carbon atoms, an aryl- or alkoxycarbonyl group having from 2 to 12 carbon atoms, an aryl- or alkoxycarbonylamino group having from 2 to 12 carbon atoms and a cyano group.

In formula (ii), preferably, $R^{k1}$ represents a linear or branched alkylene group, Y represents —S—, —O—, $—N(R^{kB1})—$, $—N(R^{kB3})—C(O)—$, $—N(R^{kB6})—C(O)—N(R^{kB7})—$, $R^{kB1}$, $R^{kB3}$, $R^{kB6}$ and $R^{kB7}$ each represents a hydrogen atom and Z represents an amino group or a heterocyclic group.

Specific preferred examples of the compound represented by formula (ii) are set forth below.

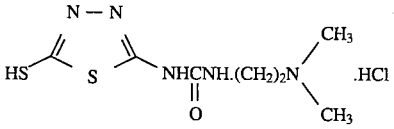

(ii)-1

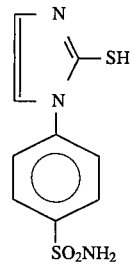

(ii)-2

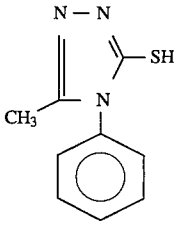

(ii)-3

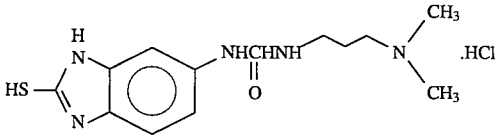

(ii)-4

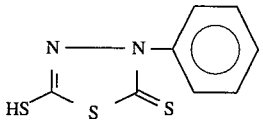

(ii)-5

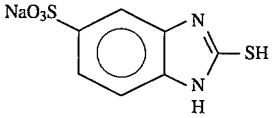

(ii)-6

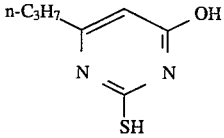

(ii)-7

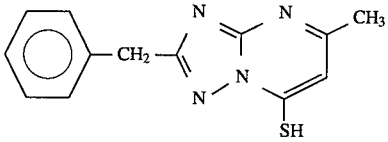

(ii)-8

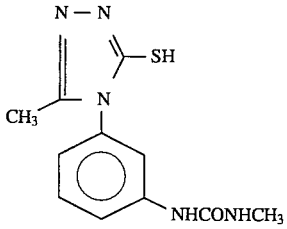

(ii)-9

-continued

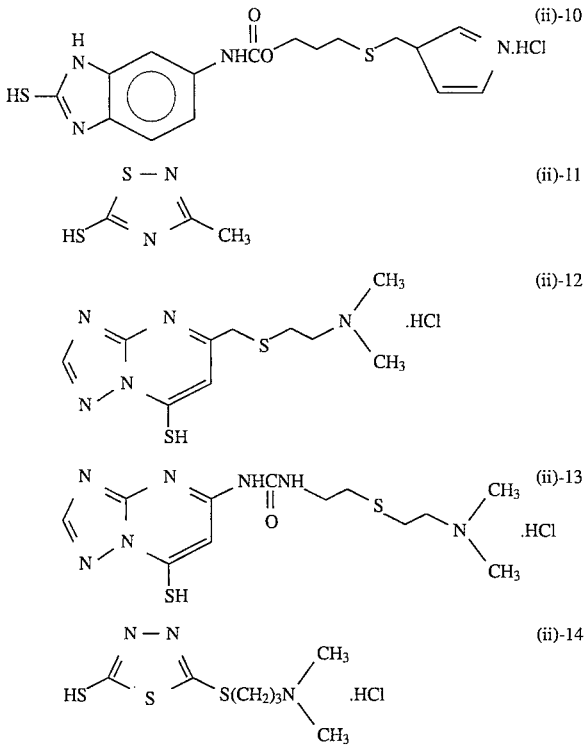

The compound represented by formula (ii) may be added to any emulsion layer and/or any light-insensitive layer. The compound may also be added to both layers. The addition amount is preferably from 0,001 to 0.2 mmol/$m^2$, more preferably from 0.01 to 0.1 mmol/$m^2$.

The yellow colloidal silver, the surface and/or inside-fogged silver halide grain, the DIR compound and the compound represented by formula (ii), which are preferably used in the present invention, may be used either individually or in combination and there is no particular restriction thereon. By using them in combination, the saturation in color reproduction can be further improved.

The requirement (d) will be described below.

The silver halide color photographic material of the present invention preferably satisfies the following relations between the average iodide content of a low speed green-sensitive silver halide emulsion layer (AgI(GL)) and the average iodide content of a low speed blue-sensitive silver halide emulsion layer (AgI(BL)), and between the average iodide content of a low speed green-sensitive silver halide emulsion layer (AgI(GL)) and the average iodide content of a low speed red-sensitive silver halide emulsion layer (AgI(RL)):

$$2 \leqq \{AgI(GL)/AgI(BL)\} \leqq 0.9$$

$$2 \leqq \{AgI(GL)/AgI(RL)\} \leqq 0.9$$

By constituting the material as described above, the interlayer effect from the green-sensitive emulsion layer to the blue-sensitive emulsion layer and the interlayer effect from the green-sensitive emulsion layer to the red-sensitive emulsion layer can be more easily made greater than the interlayer effect between the blue-sensitive emulsion layer and the red-sensitive emulsion layer. If the values of {AgI(GL)/AgI(BL)} and {AgI(GL)/AgI(RL)} each is less than 0.9, it is difficult to enhance the interlayer effect from the green-sensitive emulsion. As a result, the effort for elevating the interlayer effect provided to the blue-sensitive emulsion layer or the red-sensitive emulsion layer is accompanied by the increase in the interlayer effect between the blue-sensitive emulsion layer and the red-sensitive emulsion layer, wherefore the color temperature dependency cannot be sufficiently improved. Thus, the values of {AgI(GL)/AgI(BL)} and {AgI(GL)/AgI(RL)} each is preferably 0.9 or more.

Since the interlayer effect from the blue-sensitive emulsion layer or the red-sensitive emulsion layer to the green-sensitive emulsion layer can be elevated by the method (a), (b) or (c) described above, a photographic material capable of showing excellent saturation in color reproduction and improved in the bad effect by the color temperature of light source can be obtained. On the other hand, if the values of {AgI(GL)/AgI(BL)} and {AgI(GL)/AgI(RL)} each is more than 2, even if the above-described method (a), (b) or (c) is used in combination, the interlayer effect to the green-sensitive emulsion layer cannot be increased sufficiently. Accordingly, the values of {AgI(GL)/AgI(BL)} and {AgI(GL)/AgI(RL)} each is preferably 2 or less.

A requirement (e) will be described below.

In the present invention, yellow colloidal silver is preferably contained at least in a layer adjacent to the green-sensitive emulsion layer or the red-sensitive emulsion layer among the blue-sensitive emulsion layer, the green-sensitive emulsion layer and the red-sensitive emulsion layer.

The photographic material of the present invention comprises a blue-sensitive emulsion layer, a green-sensitive emulsion layer and a red-sensitive emulsion layer, which light-sensitive emulsion layers each consists of two or more silver halide emulsion layers having different sensitivities, and when the yellow colloidal silver is added to a layer adjacent to the light-sensitive emulsion layer, at least one yellow colloidal silver-containing layer is preferably present adjacent to the emulsion layer having the lowest sensitivity out of the group of silver halide emulsion layers having sensitivities to respective colors. This constitution is preferred because the saturation in color reproduction can be increased.

The colloidal silver used preferably has a maximum absorption wavelength at from 400 to 500 nm, more preferably from 430 to 460 nm, to bear yellow color.

Due to such a constitution, the interlayer effect provided to the emulsion layer adjacent to the yellow colloidal silver-containing layer can be elevated and the saturation of the color of the main coupler contained in the emulsion layer and of the complementary color thereof can be improved. This is because, by incorporating yellow colloidal silver to a layer adjacent to a light-sensitive emulsion layer, the development activity of the light-sensitive emulsion layer can be enhanced and the interlayer effect provided to the layer can be elevated to a higher degree.

The preparation method for various types of colloidal slivers is described, for example, in Wiser, *Colloidal Elements* (*Yellow Colloidal silver by Dextrin Reduction Method by Carey Lea*), Wiley & Sons, New York (1933), German Patent 1,096,193 (blown and black colloidal slivers) and U.S. Pat. No. 2,688,601 (blue colloidal silver). Among these, the yellow colloidal silver having a maximum absorption wavelength at from 400 to 500 nm is found to have an effect to impart property of development for high emulsion speed.

In the present invention, the layer containing yellow colloidal silver is preferably provided, among a blue-sensitive emulsion layer, a green-sensitive emulsion layer and a red-sensitive emulsion layer, at least adjacent to (in direct contact with) the green-sensitive emulsion layer or the red-sensitive emulsion layer, however, in order to prevent the occurrence of deterioration in the color balance upon the development for high emulsion speed, it is preferred to provide a yellow colloidal silver-containing layer in direct contact with each of the blue-sensitive emulsion layer, the green-sensitive emulsion layer and the red-sensitive emulsion layer. In this case, the amount of yellow colloidal silver added to the layer adjacent to the blue-sensitive emulsion layer is smaller than that of yellow filter added in a conventional photographic material for camera work. The coating amount of yellow colloidal silver is, in terms of metal silver, from 0.001 to 0.4 g/m$^2$, preferably from 0.003 to 0.3 g/m$^2$.

In the present invention, when the yellow colloidal silver is added as described above to elevate the interlayer effect or to correct the color balance in the development for high emulsion speed, the yellow colloidal silver is not added to an emulsion layer but added to a layer adjacent to a blue-sensitive emulsion layer, a green-sensitive emulsion layer or a red-sensitive emulsion layer. If the yellow colloidal silver is added to an emulsion layer, unnecessary fog is disadvantageously formed during the storage of or in the development processing of the photographic material. Also, if the yellow colloidal silver is added to a layer which is not adjacent to a spectrally sensitized layer but to a layer with an intervention, for example, of an interlayer, the above-described effect to improve the development activity cannot be provided.

When the total silver coated amount of the photographic material is 20 mg/m$^2$ or more (usually 7.0 g/m$^2$ or less), an outstanding effect can be achieved.

It is very hard to expect that the improvement effect on the saturation in color reproduction, which is achieved by incorporating yellow colloidal silver to a layer adjacent to a light-sensitive layer, varies according to the silver coated amount of the photographic material. However, when considered that the development of a relatively low-sensitivity layer tends to be retarded due to the halogen ion released upon development of a relatively high-sensitivity layer, the above-described phenomenon can be understood. In other words, as the coated amount of silver halide as a cause of retardation in the development of a low-sensitivity layer is larger or as the number of high-sensitivity layers to the low-sensitivity layers is larger, the improvement effect by the yellow colloidal silver incorporated to a layer adjacent to a low-sensitivity layer on the saturation in color reproduction is greater.

In the present invention, the addition amount of yellow colloidal silver is preferably from 0.001 to 0.4 g/m$^2$, more preferably from 0.003 to 0.3 g/m$^2$, per the layer added.

In practicing the above-described use of yellow colloidal silver in combination in the present invention, for example, JP-A-6-130590 and publications cited therein may be referred to.

In the present invention, a tabular emulsion is extremely preferably used. With respect to the use of a tabular grain, for example, Gutoff, *Photographic Science and Engineering*, Vol. 14, pp. 248–257 (1970), U.S. Pat. Nos. 4,434,226, 4,414,310, 4,433,048 and 4,439,520 and British Patent 2,112,157 can be referred to.

The term "plate-like grain" (sometimes, "tabular grain") as used in the present invention means a grain having two facing parallel main planes, with the circle-corresponding diameter of the main plane (a diameter of a circle having the same projected area as that of the main plane) being 3 or more times the distance between main planes (namely, grain thickness).

The technique for rendering the size of tabular grains monodisperse to increase the population ratio of tabular grains disclosed in JP-A-63-011928 and JP-A-63-151618 can be very preferably used in the practice of the present invention. More specifically, a silver halide emulsion comprising tabular grains in which at least 50% of the projected area has an average grain diameter/average grain thickness ratio of 3 or more and the coefficient of variation in the grain size distribution of the grains occupying this 50% is 25% or less, is very useful in practicing the present invention.

The term "coefficient of variation" as used herein is shown by a value obtained in such a way that the dispersion (standard deviation) in the grain size (R μm) resulting from the substitution of the circle-corresponding diameter (r μm) of the projected area of a tabular grain and the thickness (d μm) to the equation $R=(3r^2d/2)^{1/3}$ is divided by an average grain size and then the resulting value is multiplied by 100. The tabular grain which is preferably used in the present invention has a coefficient of valuation in the grain size distribution of preferably 25% or less, more preferably 20% or less, still more preferably 15% or less.

The term "sphere-corresponding diameter" as used herein means a diameter of a sphere having the same volume as that of the grain.

Further, the technique for rendering the size of tabular grains monodisperse to increase the population ratio of tabular grains disclosed in EP-A-514742, EP-A-514743, EP-A-515865, EP-A-513723 and U.S. Pat. Nos. 5,147,771, 5,147,772 and 5,147,773 can be very preferably used in the practice of the present invention.

Also, the method for integrating a dislocation into the inside of a silver halide grain to improve sensitivity, resistance to damage by pressure and storage stability as disclosed in JP-A-63-220238 and JP-A-4-190226 can be preferably used for the tabular grain of the present invention.

In the present invention, an internal latent image-type silver halide emulsion subjected to chemical sensitization in the area from the grain surface to 0.02 μm in depth can be preferably used. Due to such a constitution, the granularity can be improved and a silver halide color reversal photographic material for camera work having further excellent image quality can be obtained. This is because the internal latent imagetype emulsion is insusceptible to intrinsic desensitization due to the sensitizing dye because the site of the latent image is not exposed to the grain surface and accordingly, can have a superior sensitivity/granularity ratio particularly on spectral sensitization as compared with a normal surface latent image-type emulsion. In using the above-described internal latent image-type silver halide grain in the present invention, for example, U.S. Pat. No. 4,623,612 and publications cited therein can be referred to.

In order to improve color reproducibility, a donor layer (CL) of an interlayer effect and different in the spectral sensitivity distribution from main light-sensitive layers of a blue-sensitive emulsion layer, a green-sensitive emulsion layer and a red-sensitive emulsion layer, described in U.S. Pat. Nos. 4,663,271, 4,705,744 and 4,707,436, JP-A-62-160448 and JP-A-63-89850, is preferably disposed adjacent to or in the neighborhood of the main light-sensitive layers. The CL may be provided between a blue-sensitive emulsion layer and a green-sensitive emulsion layer, between a green-sensitive emulsion layer and a red-sensitive emulsion layer or closer to the support than the red-sensitive emulsion layer.

Similarly to other disclosures and citations herein, various layer structures or arrangements may be selected according to the object of respective photographic materials.

With respect to various techniques and inorganic/organic materials which can be used in the silver halide photographic emulsion of the present invention and in the silver halide photographic material using the emulsion, those described in *Research Disclosure*, No. 308119 (1989) can be generally used.

In addition, more specifically, for example, the techniques and inorganic/organic materials which can be used in the color photographic material to which the silver halide photographic material of the present invention can be applied, are described in EP-A-436938, the portion described below, and in the patents cited therein.

| Item | | Pertinent Portion |
|---|---|---|
| 1) | Layer structure | from p. 146, line 34 to p. 147, line 25 |
| 2) | Silver halide emulsion | from p. 147, line 26 to p. 148, line 12 |
| 3) | Yellow coupler | from p. 137, line 35 to p. 146, line 33, p. 149, lines 21 to 23 |
| 4) | Magenta coupler which can also be used in combination | p. 149, lines 24 to 28; EP-A-421453, from p. 3, line 5 to p. 25, line 55 |
| 5) | Cyan coupler | p. 149, lines 29 to 33; EP-A-432804, from p. 3, line 28 to p. 40, line 2 |
| 6) | Polymer coupler | p. 149, lines 34 to 38; EP-A-435334, from p. 113, line 39 to p. 123, line 37 |
| 7) | Colored coupler | from p. 53, line 42 to p. 137, line 34, p. 149, lines 39 to 45 |
| 8) | Other functional couplers | from p. 7, line 1 to p. 53, line 41, from p. 149, line 46 to p. 150, line 3; EP-A-435334, from p. 3, line 1 to p. 29, line 50 |
| 9) | Antiseptic and antimold | p. 150, lines 25 to 28 |
| 10) | Formalin scavenger | p. 149, lines 15 to 17 |
| 11) | Other additives | p. 153, lines 38 to 47; EP-A-421453, from p. 75, line 21 to p. 84, line 56, from p. 27, line 40 to p. 37, line 40 |
| 12) | Dispersion method | p. 150, lines 4 to 24 |
| 13) | Support | p. 150, lines 32 to 34 |
| 14) | Thickness and physical properties of layer | p. 150, lines 35 to 49 |
| 15) | Color development, black-and-white development and fogging | from p. 150, line 50 to p. 151, line 47; EP-A-442323, p. 34, lines 11 to 54, page 35, lines 14 to 22 |
| 16) | Desilvering | from p. 151, line 48 to p. 152, line 53 |
| 17) | Automatic developing machine | from p. 152, line 54 to p. 153, line 2 |
| 18) | Water washing and stabilization | p. 153, lines 3 to 37 |

The present invention will be described below in greater detail with reference to the examples, but the present invention should not be construed as being limited to these.

EXAMPLE 1

Preparation of Sample 101

A multi-layer color photographic material was prepared by coating layers each having the following composition on a 205 μm-thick cellulose triacetate film support with both surfaces thereof being undercoated and designated as Sample 101.

The coating amount of each composition is shown by the amount per $m^2$ of the sample. With respect to silver halide and colloidal silver, it is shown by the weight calculated in terms of equivalent silver.

| | |
|---|---|
| First Layer (antihalation layer) | |
| Black colloidal silver | 0.25 g |
| Gelatin | 1.90 g |
| Ultraviolet Absorbent U-1 | 0.20 g |
| Ultraviolet Absorbent U-3 | 0.10 g |
| Ultraviolet Absorbent U-4 | 0.20 g |
| High Boiling Point Organic Solvent Oil-1 | 0.10 g |
| Second Layer (interlayer) | |
| Light-insensitive fine grain silver iodobromide emulsion (average grain size: 0.1 μm, AgI content: 1 mol %) | 0.15 g as Ag |
| Surface- and inside-fogged fine grain silver iodobromide emulsion (average grain size: 0.06 μm, coefficient of variation: 18%, AgI content: 1 mol %) | 0.050 g as Ag |
| Compound Cpd-A | 0.10 g |
| Compound Cpd-G | 0.050 g |
| Gelatin | 0.40 g |
| Thrid Layer (interlayer) | |
| Gelatin | 0.40 g |
| Compound Cpd-C | 4.0 mg |
| High Boiling Point Organic Solvent Oil-3 | 40 mg |
| Fourth Layer (low speed red-sensitive emulsion layer) | |
| Emulsion A | 0.30 g as Ag |
| Emulsion B | 0.40 g as Ag |
| Gelatin | 0.80 g |
| Coupler C-1 | 0.090 g |
| Coupler C-2 | 0.050 g |
| Coupler C-3 | 0.020 g |
| Compound Cpd-C | 1.0 mg |
| Compound Cpd-F | 0.05 g |
| High Boiling Point Organic Solvent Oil-2 | 0.10 g |
| Latex dispersion of ethylacrylate | 0.50 g |
| Fifth Layer (medium speed red-sensitive emulsion layer) | |
| Emulsion B | 0.20 g as Ag |
| Emulsion C | 0.30 g as Ag |
| Gelatin | 0.80 g |
| Coupler C-1 | 0.20 g |
| Coupler C-2 | 0.050 g |
| Coupler C-3 | 0.20 g |
| High Boiling Point Organic Solvent Oil-2 | 0.10 g |
| Latex dispersion of ethylacrylate | 0.050 g |
| Sixth Layer (high speed red-sensitive emulsion layer) | |
| Emulsion D | 0.40 g as Ag |
| Gelatin | 1.10 g |
| Coupler C-1 | 0.30 g |
| Coupler C-2 | 0.10 g |
| Coupler C-3 | 0.10 g |
| Additive P-1 | 0.020 g |
| Latex Dispersion of ethylacrylate | 0.10 g |
| Seventh Layer (interlayer) | |
| Gelatin | 1.00 g |
| Compound Cpd-E | 0.28 g |
| Additive P-1 | 0.050 g |
| Eighth Layer (interlayer) | |
| Surface- and inside-fogged silver iodobromide emulsion (average grain size: 0.06 μm, coefficient of variation: 16%, AgI content: 0.3 mol %) | 0.02 g as Ag |
| Gelatin | 0.40 g |
| Compound Cpd-A | 0.10 g |
| Compound Cpd-G | 0.050 g |
| Ninth Layer (low speed green-sensitive emulsion layer) | |
| Grain inside-fogged silver iodobromide emulsion (average grain size: 0.1 μm, | 0.15 g as Ag |

| | |
|---|---|
| AgI content: 0.1 mol %) | |
| Emulsion E | 0.30 g as Ag |
| Emulsion F | 0.10 g as Ag |
| Emulsion G | 0.10 g as Ag |
| Gelatin | 2.00 g |
| Coupler C-4 | 0.21 g |
| Coupler C-5 | 0.040 g |
| Coupler C-6 | 0.041 g |
| Compound Cpd-B | 0.03 g |
| Compound Cpd-G | 0.010 g |
| High Boiling Point Organic Solvent Oil-2 | 0.2 g |
| Tenth Layer (medium speed green-sensitive emulsion layer) | |
| Emulsion G | 0.3 g as Ag |
| Emulsion H | 0.1 g as Ag |
| Gelatin | 0.6 g |
| Coupler C-4 | 0.28 g |
| Coupler C-5 | 0.053 g |
| Coupler C-6 | 0.055 g |
| Compound Cpd-B | 0.030 g |
| Compound Cpd-G | 0.010 g |
| Additive F-5 | 0.08 mg |
| High Boiling Point Organic Solvent Oil-2 | 0.010 g |
| Eleventh Layer (high speed green-sensitive emulsion layer) | |
| Grain inside-fogged silver iodobromide emulsion (average grain size: 0.2 μm, AgI content: 0.1 mol %) | 0.050 g as Ag |
| Emulsion I | 0.50 g as Ag |
| Gelatin | 1.10 g |
| Coupler C-4 | 0.18 g |
| Coupler C-5 | 0.18 g |
| Coupler C-6 | 0.20 g |
| Compound Cpd-B | 0.08 g |
| Compound Cpd-G | 0.010 g |
| High Boiling Point Organic Solvent Oil-2 | 0.040 g |
| Twelfth Layer (interlayer) | |
| Gelatin | 0.40 g |
| Latex dispersion of ethylacrylate | 0.15 g |
| Thirteenth Layer (yellow filter layer) | |
| Yellow colloidal silver | 0.10 g as Ag |
| Gelatin | 1.0 g |
| Compound Cpd-A | 0.040 g |
| High Boiling Point Organic Solvent Oil-1 | 0.010 g |
| Fourteenth Layer (interlayer) | |
| Gelatin | 0.60 g |
| Fifteenth Layer (low speed blue-sensitive emulsion layer) | |
| Grain inside-fogged silver iodobromide emulsion (average grain size: 0.2 μm, AgI content: 0.1 mol %) | 0.10 g as Ag |
| Emulsion J | 0.40 g as Ag |
| Emulsion K | 0.10 g as Ag |
| Emulsion L | 0.10 g as Ag |
| Gelatin | 1.0 g |
| Coupler C-7 | 0.50 g |
| Coupler C-8 | 0.10 g |
| Coupler C-9 | 0.10 g |
| Compound Cpd-F | 0.10 g |

| | |
|---|---|
| Sixteenth Layer (medium speed blue-sensitive emulsion layer) | |
| Emulsion L | 0.10 g as Ag |
| Emulsion M | 0.10 g as Ag |
| Gelatin | 0.60 g |
| Coupler C-7 | 0.020 g |
| Coupler C-8 | 0.0020 g |
| Coupler C-9 | 0.020 g |
| Seventeenth Layer (high speed blue-sensitive emulsion layer) | |
| Emulsion N | 0.60 g as Ag |
| Gelatin | 1.40 g |
| Coupler C-7 | 0.050 g |
| Coupler C-8 | 0.080 g |
| Coupler C-9 | 0.80 g |
| Eighteenth Layer (first protective layer) | |
| Gelatin | 0.90 g |
| Ultraviolet Absorbent U-1 | 0.20 g |
| Ultraviolet Absorbent U-2 | 0.050 g |
| Ultraviolet Absorbent U-5 | 0.30 g |
| High Boiling Point Organic Solvent Oil-1 | 0.02 g |
| Formalin scavenger Cpd-D | 0.50 g |
| Latex dispersion of ethylacrylate | 0.050 g |
| Dye D-1 | 0.050 g |
| Compound Cpd-A | 0.020 g |
| Compound Cpd-E | 0.20 g |
| Nineteenth Layer (second protective layer) | |
| Colloidal silver | 0.050 mg as Ag |
| Fine grain silver iodobromide emulsion (average grain size: 0.06 μm, AgI content: 1 mol %) | 0.050 g as Ag |
| Gelatin | 0.30 g |
| Twentieth Layer (third protective layer) | |
| Colloidal silver | 0.050 mg as Ag |
| Fine grain silver iodobromide emulsion (average grain size: 0.07 μm, AgI content: 1 mol %) | 0.050 g as Ag |
| Gelatin | 0.60 g |
| Polymethyl methacrylate (average grain diameter: 1.5 μm) | 0.10 g |
| 4:6 Copolymer of methyl methacrylate and acrylic acid (average grain dizmeter: 1.5 μm) | 0.10 g |
| Silicone oil | 0.030 g |
| Surface Active Agent W-1 | 3.0 mg |
| Surface Active Agent W-2 | 0.030 g |

Additives F-1 to F-9 were added to each silver halide emulsion layer and interlayer.

Further, in addition to the above-described composition, Gelatin Hardening Agent H-1, Surface Active Agents W-3, W-4 and W-5 for coating and Surface Active Agent W-6 for emulsification were added to each layer.

Furthermore, phenol, 1,2-benzisothiazoline-3-one, 2-phenoxyethanol, phenyl isothiocyanate and phenetyl alcohol were added as an antiseptic and an antimold.

TABLE 1

Silver Iodobromide Emulsions used in Sample 101

| Emulsion | Properties of Grain | Average Sphere-corresponding Diameter (μm) | Coefficient of Variation (%) | AgI Content (%) |
|---|---|---|---|---|
| A | monodisperse tetradecahedral grain | 0.35 | 16 | 4.0 |
| B | monodisperse, cubic internal latent image-type grain | 0.45 | 10 | 2.0 |
| C | polydisperse twin grain (internal | 0.80 | 27 | 6.0 |

TABLE 1-continued

Silver lodobromide Emulsions used in Sample 101

| Emulsion | Properties of Grain | Average Sphere-corresponding Diameter (μm) | Coefficient of Variation (%) | AgI Content (%) |
|---|---|---|---|---|
| | high iodide type core/shell grain) | | | |
| D | polydisperse twin grain | 1.10 | 25 | 6.0 |
| E | polydisperse twin grain | 0.30 | 26 | 6.5 |
| F | polydisperse twin grain | 0.40 | 23 | 5.5 |
| G | monodisperse, cubic internal latent image-type grain | 0.50 | 11 | 4.5 |
| H | monodisperse tabular grain, average aspect ratio: 2.8 | 0.80 | 15 | 5.0 |
| I | polydisperse tabular grain, average aspect ratio: 3.5 | 1.50 | 28 | 6.5 |
| J | polydisperse tabular grain, average aspect ratio: 5.0 | 0.60 | 28 | 3.5 |
| K | monodisperse tabular grain, average aspect ratio: 4.3 | 0.70 | 15 | 5.0 |
| L | monodisperse octahedral grain | 0.80 | 14 | 5.0 |
| M | monodisperse tabular grain, average aspect ratio: 7.8 | 1.00 | 18 | 5.0 |
| N | polydisperse twin grain (internal high iodide type core/shell grain) | 1.70 | 27 | 7.5 |

TABLE 2

Spectral Sensitization of Emulsions A to H

| Emulsion | Sensitizing Dye Added | Addition Amount per mol of Silver Halide (g) |
|---|---|---|
| A | S-1 | 0.15 |
| | S-2 | 0.02 |
| | S-9 | 0.15 |
| B | S-1 | 0.15 |
| | S-2 | 0.04 |
| | S-9 | 0.20 |
| C | S-1 | 0.15 |
| | S-2 | 0.02 |
| | S-9 | 0.05 |
| D | S-1 | 0.08 |
| | S-2 | 0.01 |
| | S-9 | 0.02 |
| E | S-3 | 0.5 |
| | S-4 | 0.08 |
| | S-7 | 0.02 |
| | S-10 | 0.05 |
| F | S-3 | 0.3 |
| | S-4 | 0.07 |
| | S-7 | 0.03 |
| G | S-3 | 0.25 |
| | S-4 | 0.08 |
| H | S-3 | 0.2 |
| | S-4 | 0.03 |
| | S-7 | 0.03 |
| | S-10 | 0.1 |

TABLE 3

Spectral Sensitization of Emulsions I to N

| Emulsion | Sensitizing Dye Added | Addition Amount per mol of Silver Halide (g) |
|---|---|---|
| I | S-3 | 0.3 |
| | S-4 | 0.02 |
| | S-7 | 0.02 |
| | S-8 | 0.1 |
| | S-10 | 0.05 |
| J | S-5 | 0.2 |

TABLE 3-continued

Spectral Sensitization of Emulsions I to N

| Emulsion | Sensitizing Dye Added | Addition Amount per mol of Silver Halide (g) |
|---|---|---|
| | S-6 | 0.05 |
| K | S-5 | 0.2 |
| | S-6 | 0.05 |
| L | S-5 | 0.22 |
| | S-6 | 0.06 |
| M | S-5 | 0.15 |
| | S-6 | 0.04 |
| N | S-5 | 0.22 |
| | S-6 | 0.06 |

C-1
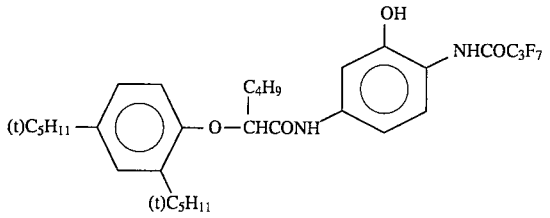
C-2
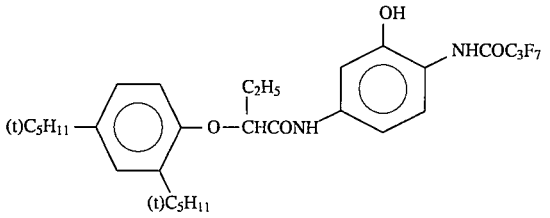
C-3
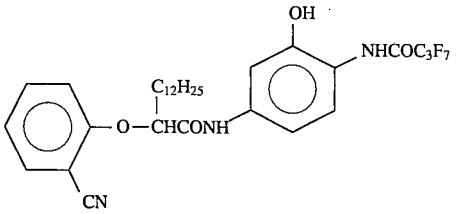
C-4
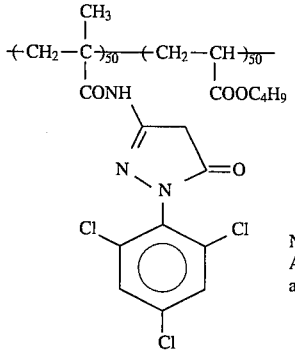
Numerals are % by weight
Average molecular weight:
about 25,000
C-5
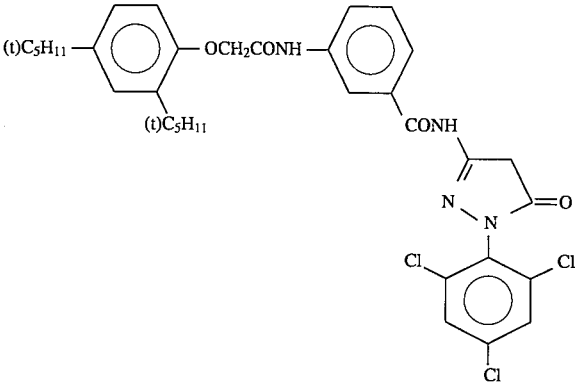

-continued
C-6
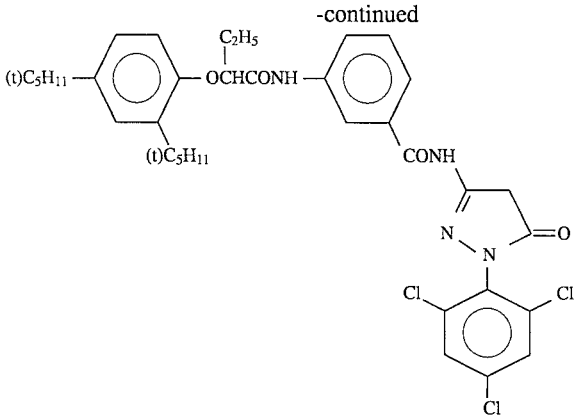
C-7
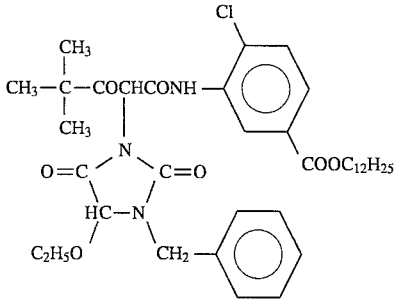
C-8
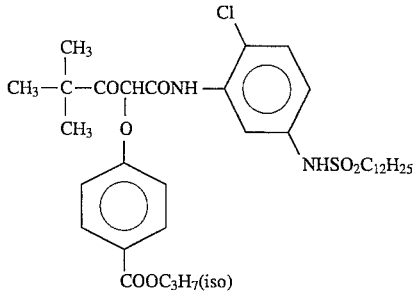
C-9
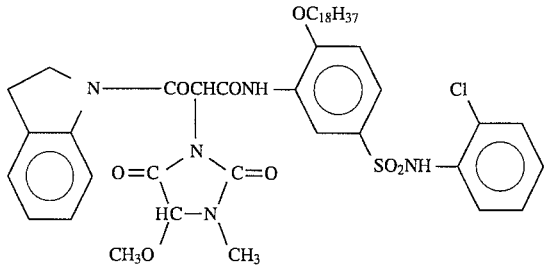
Disbutyl phthalate — Oil-1
Tricresyl phosphate — Oil-2
Oil-3
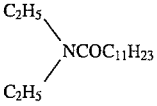
Cpd-A
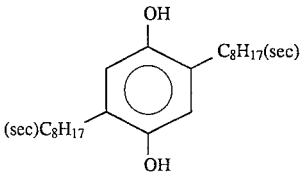

-continued
Cpd-B
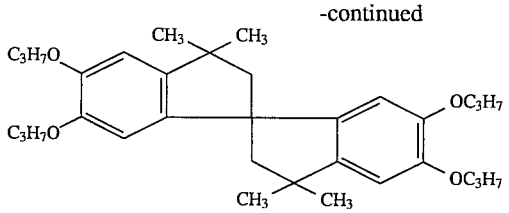
Cpd-C
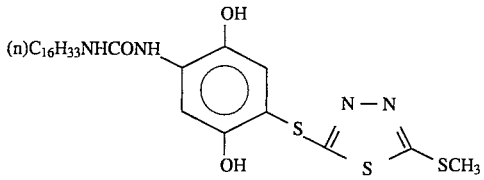
Cpd-D
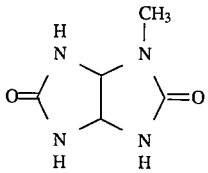
Cpd-E
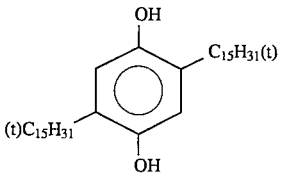
Cpd-F
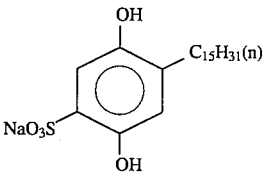
Cpd-G
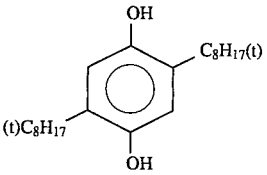
U-1
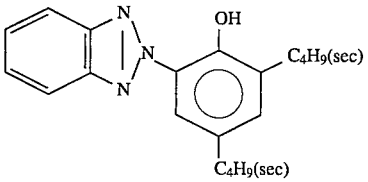
U-2
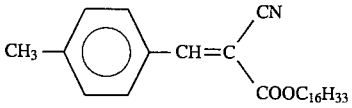
U-3
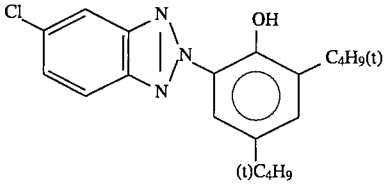

-continued
U-4
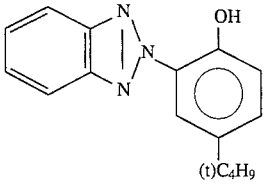
U-5
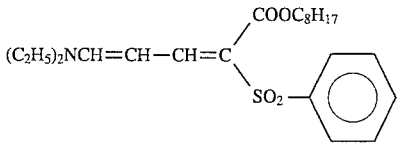
S-1
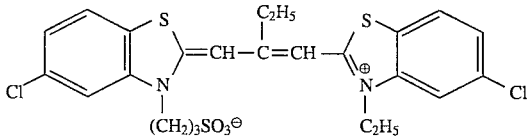
S-2
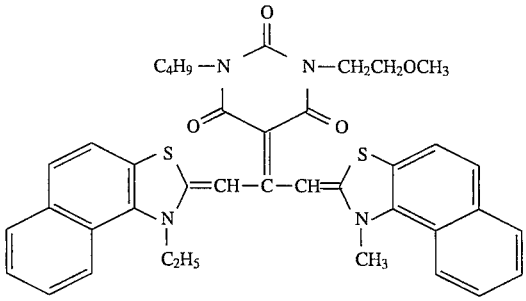
S-3
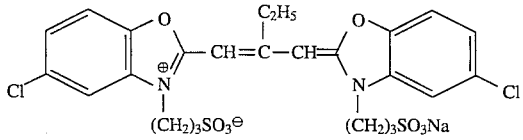
S-4
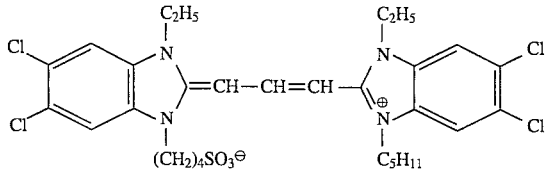
S-5
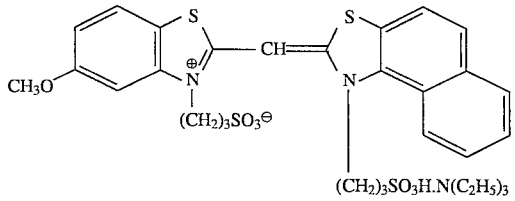
S-6
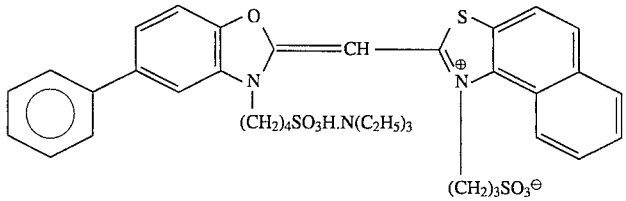
S-7
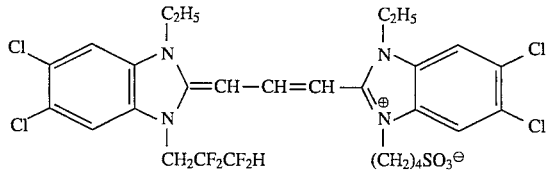

-continued
S-8
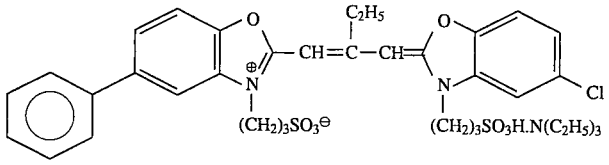
S-9
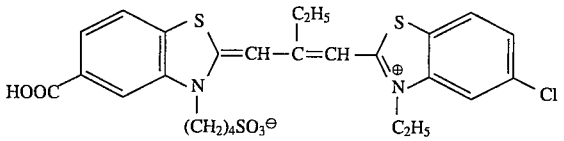
S-10
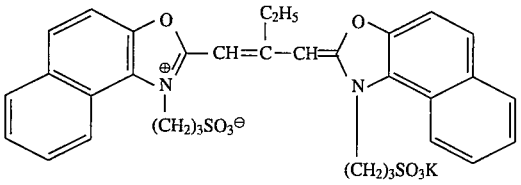
D-1
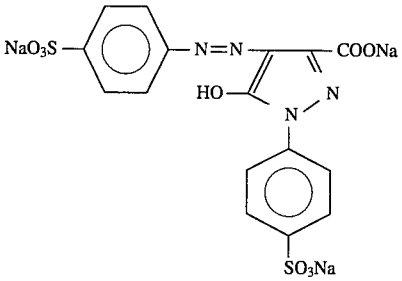
H-1
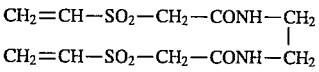
W-1
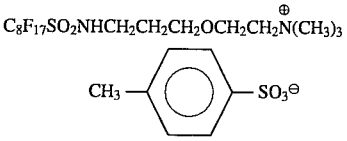
W-2
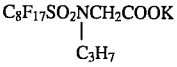
W-3
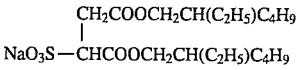
W-4
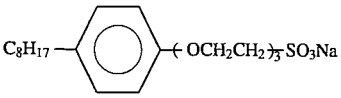
W-5
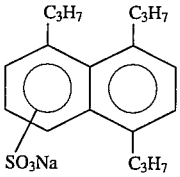
W-6
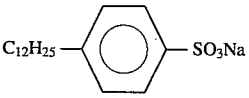
P-1
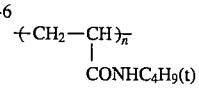
(n = 100–1,000)
F-1
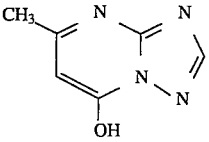
F-2
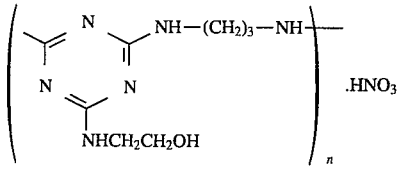
(n = 3–4)

-continued

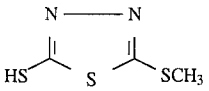

F-3

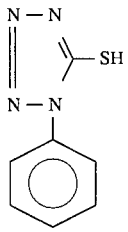

F-4

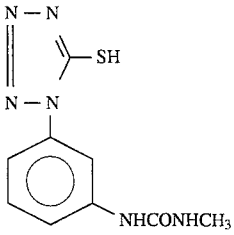

F-5

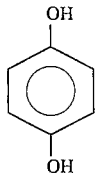

F-6

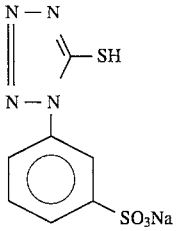

F-7

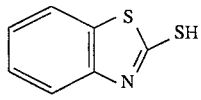

F-8

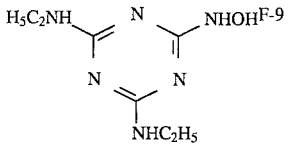

F-9

Preparation of Organic Solid Dye Dispersions A to I 10 g of Comparative Dye a shown below was placed in a pot together with 2 g of Demol T (a surface active agent, produced by KAO Corporation), 241 ml of water and 400 ml of zirconium oxide beads and dispersed in a vibration ball mill manufactured by Chuo Koki KK for four days. After the dispersion, the content was taken out, the beads were removed by filtration and gelatin was added thereto to obtain Organic Solid Dye Dispersion A.

Dispersions B to G were prepared thoroughly in the same manner as Dispersion A except for replacing Comparative Dye a of Dispersion A by an equal amount of Comparative Dyes b, c and d and Dyes (I-1), (I-5) and (I-37) of the present invention, respectively.

Comparative Dye a
(Compound 8 described in JP-A-3-167546)

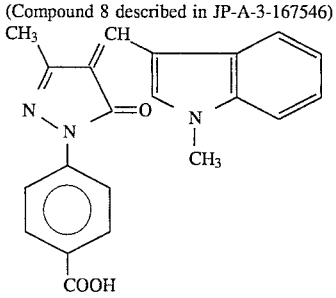

-continued

Comparative Dye b
(Compound (66) described in JP-A-3-144438)

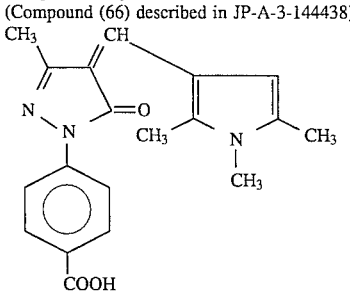

Comparative Dye c
(Compound 22 described in JP-A-5-86056)

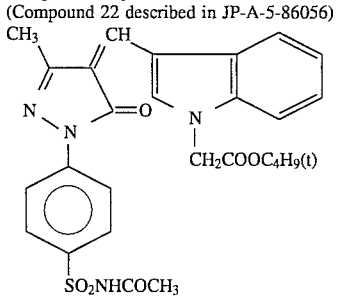

-continued

Comparative Dye d
(Compound Dye 1 described in U.S. Pat. No. 4,923,788)

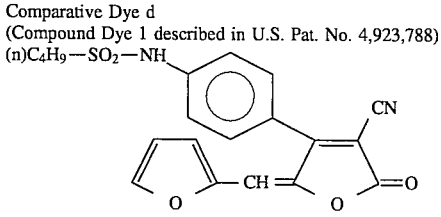

Further, Solid Dispersions H and I were prepared thoroughly in the same manner as above except for replacing Comparative Dye a by an equal amount of Dyes (II-15) and (II-16) of the present invention, respectively.

Preparation of Samples 102 to 110

Sample 102 was prepared thoroughly in the same manner as Sample 101 except for adding Organic Solid Dye Dispersion A in place of yellow colloidal silver in the thirteenth layer of Sample 101 to give a coated amount of Comparative Dye a of $8.5\times10^{-4}$ mol/m$^2$.

Sample 103 was prepared thoroughly in the same manner as Sample 102 except for adding Organic Solid Dispersion H to the eighteenth layer of Sample 102 to give a coated amount of Dye (II-15) of $4.0\times10^{-5}$ mol/m$^2$.

Sample 104 was prepared in the same manner as Sample 103 except for replacing Couplers C-4, C-5 and C-6 in the ninth layer, the tenth layer and the eleventh layer of Sample 103 by Magenta Coupler (M-23) of the present invention and changing the coated amount to 55 mol %.

Samples 105 to 110 each having the composition shown in Table 4 were prepared in the same manner as above using Organic Solid Dye Dispersions B to G and I and Magenta Couplers (M-13) and (M-21).

Each of the resulting Samples 101 to 110 was wedgewise exposed to white light and then subjected to the development processing described later.

After the processing, each sample was measured on the yellow density and the minimum value ($D^B_{min}$) was obtained. The residual color level ascribable to the dye used in place of colloidal silver was evaluated by the difference ($\Delta D^B_{min}$) in the minimum value from Sample 101.

Then, from each of Samples 101 to 110, two strip samples were prepared. One strip was stored at room temperature and the other was stored in conditions of 45° C. and 70% RH for seven days. Thereafter, each strip was processed and measured on the density in the same manner as above. The difference ($\Delta D^B_{max}$) in the yellow maximum density and the difference ($\Delta S^B_{1.0}$) in the logarithmic value of the reciprocal of the exposure amount giving a yellow density of 1.0 for the samples stored at 45° C. and 70%RH from those of the samples stored at room temperature were determined. The results were used as criteria for evaluation on the storage stability.

Also, each sample was exposed to white light through an MTF pattern, processed in the same manner as above and measured on the MTF value (5 cycles/mm) of the magenta color image and the sharpness was compared. The evaluation results were shown by the ratio (MTF ratio) to the MTF value of Comparative Sample 101 taken as 1.

The processing steps and the composition of each processing solutions are shown below.

| Processing Step | Time (min.) | Temperature (°C.) |
|---|---|---|
| First development | 6 | 38 |
| Water washing | 2 | 38 |
| Reversal | 2 | 38 |
| Color development | 6 | 38 |
| Pre-bleaching | 2 | 38 |
| Bleaching | 6 | 38 |
| Fixing | 4 | 38 |
| Water washing | 4 | 38 |
| Final rinsing | 1 | 25 |

Each processing solution had the following composition

| First Developer: | |
|---|---|
| Pentasodium nitrilo-N,N,N-trimethylene-phosphonate | 1.5 g |
| Pentasodium diethylenetriaminepenta-acetate | 2.0 g |
| Sodium sulfite | 22 g |
| Potassium hydroquinone · monosulfonate | 20 g |
| Potassium carbonate | 15 g |
| Sodium bicarbonate | 12 g |
| 1-Phenyl-4-methyl-4-hydroxymethyl-3-pyrazolidone | 1.5 g |
| Potassium bromide | 2.5 g |
| Potassium thiocyanate | 1.0 g |
| Potassium iodide | 2.0 mg |
| Diethylene glycol | 13 g |
| Water to make | 1,000 ml |
| pH | 9.60 |

The pH was adjusted by sulfuric acid or potassium hydroxide.

| Reversal Solution | |
|---|---|
| Pentasodium nitrilo-N,N,N-trimethylene-phosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Water to make | 1,000 ml |
| pH | 6.00 |

The pH was adjusted by acetic acid or sodium hydroxide.

| Color Developer: | |
|---|---|
| Pentasodium nitrilo-N,N,N-trimethylene-phosphonate | 2.0 g |
| Sodium sulfite | 4.0 g |
| Trisodium phosphate dodecahydrate | 36 g |
| Potassium bromide | 1.0 g |
| Potassium iodide | 90 mg |
| Sodium hydroxide | 3.0 g |
| Citrazinic acid | 0.8 g |
| N-Ethyl-N-(β-methanesulfonamidoethyl)-3-methyl-4-aminoaniline · ⅔ sulfuric acid monohydrate | 8.0 g |
| 3,6-Dithiaoctane-1,8-diol | 0.5 g |
| Water to make | 1,000 ml |
| pH | 11.65 |

The pH was adjusted by sulfuric acid or potassium hydroxide.

| Pre-Bleaching | |
|---|---|
| Disodium ethylenediaminetetraacetate dihydrate | 8.0 g |
| Sodium sulfite | 4.0 g |
| 1-Thioglycerol | 0.4 g |
| Formaldehyde sodium bisulfite adduct | 20 g |
| Water to make | 1,000 ml |
| pH | 6.20 |

The pH was adjusted by acetic acid or sodium hydroxide.

| Bleaching Solution | |
|---|---|
| Disodium ethylenediaminetetraacetate dihydrate | 2.0 g |
| Ammonium ethylenediaminetetraacetato ferrate dihydrate | 120 g |
| Potassium bromide | 100 g |
| Ammonium nitrate | 10 g |
| Water to make | 1,000 ml |
| pH | 5.70 |

The pH was adjusted by nitric acid or potassium hydroxide.

| Fixing Solution: | |
|---|---|
| Ammonium thiosulfate | 70 g |
| Sodium sulfite | 3.0 g |
| Sodium bisulfite | 4.0 g |
| Water to make | 1,000 ml |
| pH | 6.60 |

The pH was adjusted by acetic acid or aqueous ammonia.

| Final Rinsing Solution: | |
|---|---|
| 1,2-Benzoisothiazoline-3-one | 0.02 g |
| Polyoxyethylene-p-monononylphenyl ether (average polymerization degree: 10) | 0.3 g |
| Polymaleic acid (average molecular weight: 2,000) | 0.1 g |
| Water to make | 1,000 ml |
| pH | 7.0 |

The evaluation results are shown in Table 4.

TABLE 4

| Sample | Dye in 8th Layer | Colloidal Silver/Dye in 13th Layer | Magenta Coupler* 10th Layer | 11th Layer | 12th Layer | After Storage at 45° C., 70% $\Delta D^B_{min}$ | $\Delta D^B_{max}$ | $\Delta D^B_{1.0}$ | MTF Ratio of Magenta Image | Remarks |
|---|---|---|---|---|---|---|---|---|---|---|
| 101 | — | yellow colloidal silver | C-4 (0.70) C-5 (0.15) C-6 (0.15) | C-4 (0.70) C-5 (0.15) C-6 (0.15) | C-4 (0.30) C-5 (0.35) C-6 (0.35) | 0.00 | 0.32 | −0.02 | 1.00 | Comparison |
| 102 | — | Comparative Dye a | C-4 (0.70) C-5 (0.15) C-6 (0.15) | C-4 (0.70) C-5 (0.15) C-6 (0.15) | C-4 (0.30) C-5 (0.35) C-6 (0.35) | 0.12 | 0.21 | −0.25 | 0.92 | " |
| 103 | (II-15) | Comparative Dye a | C-4 (0.70) C-5 (0.15) C-6 (0.15) | C-4 (0.70) C-5 (0.15) C-6 (0.15) | C-4 (0.30) C-5 (0.35) C-6 (0.35) | 0.13 | 0.22 | −0.26 | 0.95 | " |
| 104 | (II-15) | Comparative | M-13 (1) | M-13 (1) | M-13 (1) | 0.13 | 0.22 | −0.26 | 0.96 | " |
| 105 | (II-15) | Dye a (I-1) | C-4 (0.70) C-5 (0.15) C-6 (0.15) | C-4 (0.70) C-5 (0.15) C-6 (0.15) | C-4 (0.30) C-5 (0.35) C-6 (0.35) | 0.00 | 0.15 | −0.03 | 0.98 | Invention |
| 106 | (II-16) | Comparative Dye b | C-4 (0.70) C-5 (0.15) C-6 (0.15) | C-4 (0.70) C-5 (0.15) C-6 (0.15) | C-4 (0.30) C-5 (0.35) C-6 (0.35) | 0.08 | 0.25 | −0.30 | 0.95 | Comparison |
| 107 | (II-16) | Comparative Dye c | C-4 (0.70) C-5 (0.15) C-6 (0.15) | C-4 (0.70) C-5 (0.15) C-6 (0.15) | C-4 (1) | 0.06 | 0.27 | −0.32 | 0.94 | " |
| 108 | (II-15) | Comparative Dye d | C-4 (0.70) C-5 (0.15) C-6 (0.15) | C-4 (0.70) C-5 (0.15) C-6 (0.15) | C-4 (1) | 0.06 | 0.25 | −0.35 | 0.95 | " |
| 109 | (II-16) | (I-5) | M-3 (1) | M-13 (1) | M-3 (1) | 0.01 | 0.15 | −0.02 | 1.00 | Invention |
| 110 | (II-16) | yellow colloidal silver (0.10 g) (I-37) (1.0 × $10^{-5}$ mol) | M-13 (0.5) M-21 (0.5) | M-13 (0.5) M-21 (0.5) | C-4 (1) | 0.00 | 0.18 | −0.01 | 1.02 | " |

*The numerals in parentheses indicate the molar ratio of couplers in the same layer.

As is clearly seen from Table 4, the organic solid dye dispersion of the present invention used in place of yellow colloidal silver exhibited excellent decoloration capability in the processing solution and samples using the dispersion were outstandingly improved in the residual color as compared with those using a conventional dye. In addition, the change in sensitivity during storage of the photographic material was improved. This reveals that the dye of the present invention is excellent in fixability.

The dye dispersion of the present invention as a substitute of yellow colloidal silver first can provide effects ascribable to the combination use with the magenta dye of the present invention and thus, a photographic material excellent in storage stability and sharpness can be provided.

Further, the improvement effect on the color reproducibility was examined as follows.

Each sample was processed into a size of 4 inch×5 inch, subjected to photographing by a camera and processed in the same manner as above. The object used is a color checker manufactured by Macbeth Co.

The resulting samples each was subjected to a sensory evaluation on the color reproducibility (mainly, saturation of blue, violet, red and orange colors) and as a result, samples 109 and 110 using the magenta coupler of the present invention exhibited an outstanding improvement effect. Thus, a photographic material improved in storage stability and color reproducibility can be provided.

EXAMPLE 2

Samples were prepared thoroughly in the same manner as Sample 105 in Example 1 except for replacing the dye in the thirteenth layer of Sample 105 by Dye (I-2), (I-10) or (I-26) or a 1/1 by mol mixture of Dyes (I-2)/(I-5) and evaluated in the same manner as in Example 1. As a result, the effect of the present invention could be achieved the same as in Sample 105.

Also, samples were prepared by replacing the magenta coupler of the tenth layer, the eleventh layer or the twelfth layer of Sample 109 by M-4, M-17 or a 1/1 by mol mixture of M-9/M-21 and evaluated in the same manner as above. As a result, the effect of the present invention could be confirmed with respect to $\Delta D^{B}_{min}$, storage stability, sharpness and color reproducibility.

EXAMPLE 3

This example is to demonstrate the usefulness of the combination such that the solid dispersion dye of the compound of formula (i) of the present invention is used in place of yellow colloidal silver conventionally commonly used as a yellow filter and the requirement (e) of the present invention is satisfied at the same time and also the combination where in addition, the requirement (d) is satisfied.

Preparation of Sample 200

A multi-layer color photographic material was prepared by coating the layers each having the following composition on a 127 μm-thick cellulose triacetate film support having an undercoat layer and designated as Sample 200. The numerals indicate the addition amount per $m^2$. The effect of the compound added is not restricted only to the use described below.

| | |
|---|---|
| First Layer (antihalation layer) | |
| Black colloidal silver | 0.20 g |
| Gelatin | 1.9 g |
| Ultraviolet Absorbent U-1 | 0.04 g |
| Ultraviolet Absorbent U-2 | 0.1 g |
| Ultraviolet Absorbent U-3 | 0.1 g |
| Ultraviolet Absorbent U-4 | 0.1 g |
| Ultraviolet Absorbent U-5 | 0.1 g |
| High Boiling Point Organic Solvent Oil-1 | 0.05 g |
| Fine crystal solid dispersion of Dye E-1 | 0.15 g |
| Second Layer (interlayer) | |
| Gelatin | 0.40 g |
| Compound Cpd-C | 5.0 mg |
| High Boiling Point Organic Solvent Oil-3 | 0.1 g |
| Dye D-4 | 0.4 mg |
| Third Layer (interlayer) | |
| Gelatin | 0.4 g |
| Fourth Layer (low speed red-sensitive emulsion layer) | |
| Emulsion | as silver 0.69 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 5.0 mg |
| High Boiling Point Organic Solvent Oil-2 | 0.1 g |
| Fifth Layer (medium speed red-sensitive emulsion layer) | |
| Emulsion | as silver 0.5 g |
| Gelatin | 0.8 g |
| Coupler C-1 | 0.2 g |
| Coupler C-2 | 0.05 g |
| Coupler C-3 | 0.2 g |
| Coupler C-9 | 0.05 g |
| High Boiling Point Organic Solvent Oil-2 | 0.1 g |
| Additive P-1 | 0.1 g |
| Sixth Layer (high speed red-sensitive emulsion layer) | |
| Emulsion | as silver 0.5 g |
| Gelatin | 1.1 g |
| Coupler C-1 | 0.3 g |
| Coupler C-2 | 0.1 g |
| Coupler C-3 | 0.7 g |
| Coupler C-9 | 0.1 g |
| Additive P-1 | 0.1 g |
| Seventh Layer (interlayer) | |
| Gelatin | 0.6 g |
| Additive M-1 | 0.3 g |
| Color Mixing Inhibitor Cpd-L | 2.6 mg |
| Compound Cpd-I | 2.6 mg |
| High Boiling Point Organic Solvent Oil-1 | 0.1 g |
| Ultraviolet Absorbent U-1 | 0.1 g |
| Ultraviolet Absorbent U-5 | 0.1 g |
| Dye D-1 | 0.015 g |
| Dye D-6 | 0.030 g |
| Dye D-7 | 0.008 g |
| Eighth Layer (interlayer) | |
| Gelatin | 1.0 g |
| Additive P-1 | 0.2 g |
| Color Mixing Inhibitor Cpd-C | 0.1 g |
| Color Mixing Inhibitor Cpd-A | 0.1 g |
| Ninth Layer (low speed green-sensitive emulsion layer) | |
| Emulsion | as silver 0.95 g |
| Gelatin | 0.5 g |
| Coupler C-4 | 0.05 g |
| Coupler C-7 | 0.25 g |

| | |
|---|---|
| Compound Cpd-B | 0.03 g |
| Compound Cpd-E | 0.02 g |
| Compound Cpd-F | 0.02 g |
| Compound Cpd-D | 0.02 g |
| High Boiling Point Organic Solvent Oil-1 | 0.1 g |
| High Boiling Point Organic Solvent Oil-2 | 0.1 g |
| Tenth Layer (medium speed green-sensitive emulsion layer) | |
| Emulsion | as silver 0.5 g |
| Gelatin | 0.6 g |
| Coupler C-4 | 0.1 g |
| Coupler C-7 | 0.3 g |
| Compound Cpd-B | 0.03 g |
| Compound Cpd-E | 0.02 g |
| Compound Cpd-F | 0.02 g |
| Compound Cpd-D | 0.05 g |
| High Boiling Poing Organic Solvent Oil-2 | 0.01 g |
| Eleventh Layer (high speed green-sensitive emulsion layer) | |
| Emulsion | as silver 0.44 g |
| Gelatin | 1.0 g |
| Coupler C-4 | 0.3 g |
| Coupler C-7 | 0.2 g |
| Compound Cpd-B | 0.08 g |
| Compound Cpd-E | 0.02 g |
| Compound Cpd-F | 0.02 g |
| Compound Cpd-D | 0.02 g |
| Compound Cpd-L | 0.02 g |
| High Boiling Poing Organic Solvent Oil-1 | 0.02 g |
| High Boiling Point Organic Solvent Oil-2 | 0.02 g |
| Twelfth Layer (interlayer) | |
| Gelatin | 0.6 g |
| Compound Cpd-L | 0.05 g |
| High Boiling Point Organic Solvent Oil-1 | 0.05 g |
| Dye D-5 | 0.001 g |
| Dye D-2 | 0.34 g |
| Dye D-3 | 0.02 g |
| Thirteenth Layer (yellow filter layer) | |
| Yellow colloidal silver | as silver 0.07 g |
| Gelatin | 1.1 g |
| Color Mixing Inhibitor Cpd-A | 0.01 g |
| Compound Cpd-L | 0.01 g |
| High Boiling Point Organic Solvent Oil-1 | 0.01 g |
| Fine crystal solid dispersion of Dye E-2 | 0.02 g |
| Fourteenth Layer (low speed blue-sensitive emulsion layer) | |
| Emulsion | as silver 0.43 g |
| Gelatin | 0.8 g |
| Coupler C-5 | 0.2 g |
| Coupler C-6 | 0.2 g |
| Coupler C-10 | 0.4 g |
| Compound Cpd-I | 0.02 g |
| Fifteenth Layer (medium speed blue-sensitive emulsion layer) | |
| Emulsion | as silver 0.16 g |

| | |
|---|---|
| Gelatin | 0.9 g |
| Coupler C-5 | 0.3 g |
| Coupler C-6 | 0.1 g |
| Coupler C-10 | 0.1 g |
| Sixteenth Layer (high speed blue-sensitive emulsion layer) | |
| Emulsion | as silver 0.47 g |
| Gelatin | 1.2 g |
| Coupler C-5 | 0.1 g |
| Coupler C-6 | 0.6 g |
| Coupler C-10 | 0.1 g |
| High Boiling Point Organic Solvent Oil-2 | 0.1 g |
| Compound Cpd-I | 0.02 g |
| Seventeenth Layer (first protective layer) | |
| Gelatin | 0.7 g |
| Ultraviolet Absorbent U-1 | 0.04 g |
| Ultraviolet Absorbent U-2 | 0.01 g |
| Ultraviolet Absorbent U-3 | 0.03 g |
| Ultraviolet Absorbent U-4 | 0.03 g |
| Ultraviolet Absorbent U-5 | 0.05 g |
| High Boiling Point Organic Solvent Oil-1 | 0.02 g |
| Formalin Scavenger Cpd-H | 0.2 g |
| Dye D-3 | 0.22 g |
| Eighteenth Layer (second protective layer) | |
| Colloidal silver | as silver 0.1 mg |
| Fine grain silver iodobromide emulsion (average grain size: 0.06 μm, AgI content: 1 mol %) | as silver 0.1 mg |
| Gelatin | 0.4 g |
| Nineteenth Layer (third protective layer) | |
| Gelatin | 0.4 g |
| Polymethyl methacrylate (average grain diameter: 1.5 μm) | 0.1 g |
| 4:6 Copolymer of methyl methacrylate and acrylic acid (average grain diameter: 1.5 μm) | 0.1 g |
| Silicone oil | 0.03 g |
| Surface Active Agent W-1 | 3.0 g |
| Surface Active Agent W-2 | 0.03 g |

Further, in addition to the above-described compositions, Additives F-1 to F-8 were added to all emulsion layers. Furthermore, in addition to the above-described compositions, Gelatin Hardening Agent H-1 and Surface Active Agents W-3, B-4, W-5 and W-6 for coating and emulsification were added to each layer.

Still further, phenol, 1,2-benzisothiazoline-3-one, 2-phenoxyethanol and phenetyl alcohol were added as an antiseptic and an antimold.

Chemical formulae of the compounds used in Sample 200 are shown below.

C-1

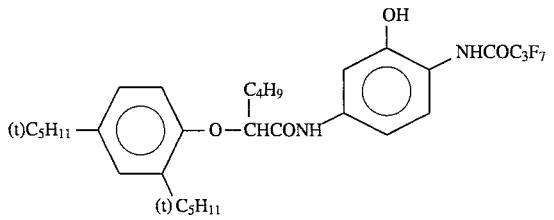

C-2

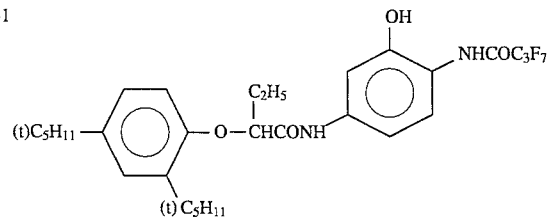

-continued
C-3
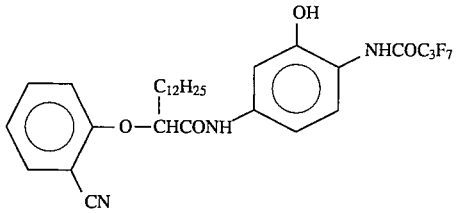
C-4
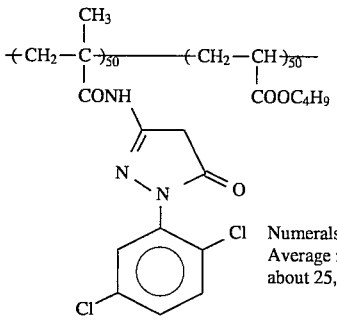
Numerals are % by weight
Average molecular weight: about 25,000
C-5
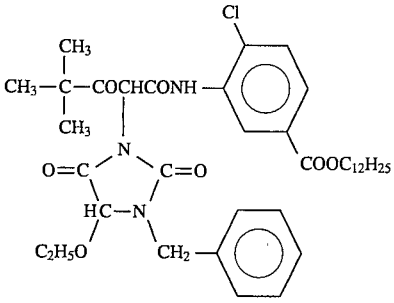
C-6
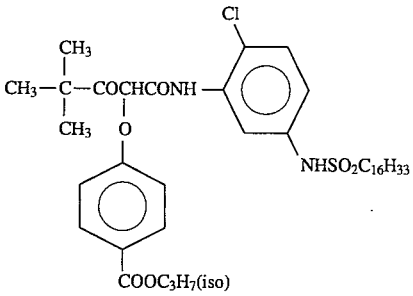
C-7
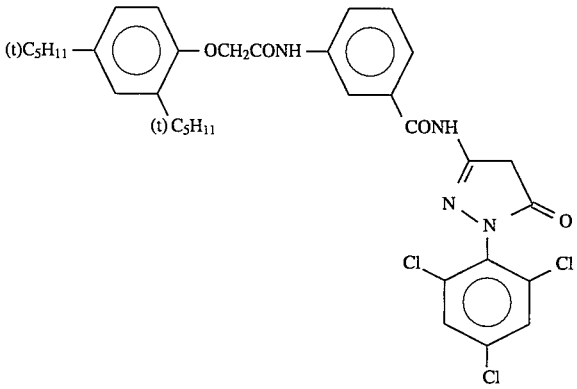
C-9
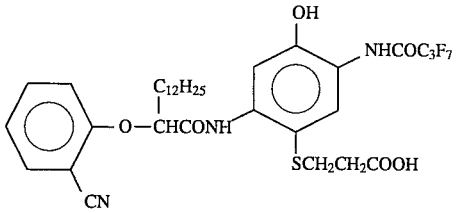
C-10
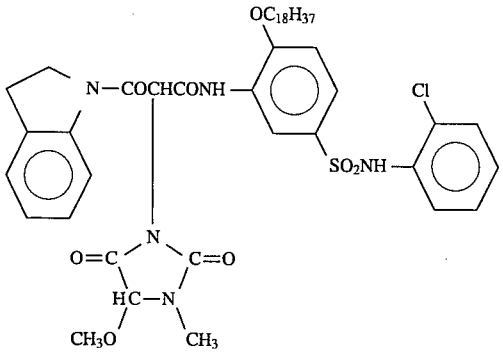
Dibutyl phthalate Oil-1
Tricresyl phosphate Oil-2
Oil-3
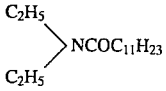
Cpd-A
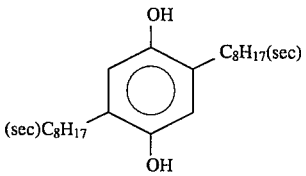

-continued
Cpd-B
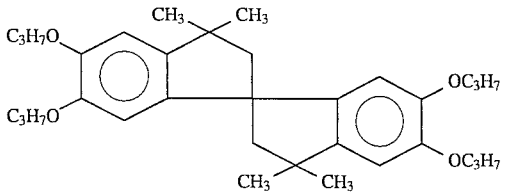
Cpd-C
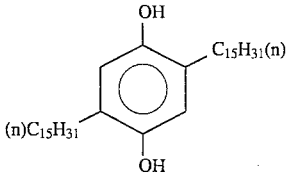
Cpd-D
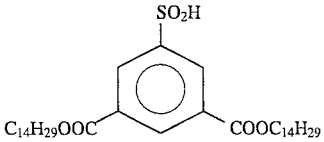
Cpd-E
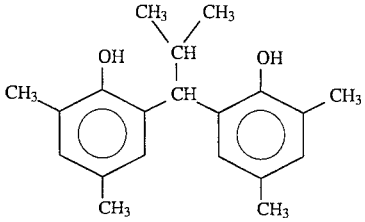
Cpd-F
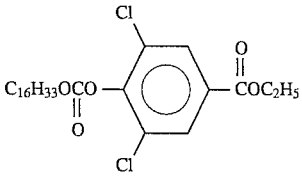
Cpd-H
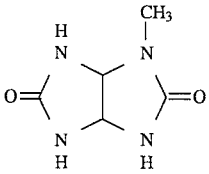
Cpd-I
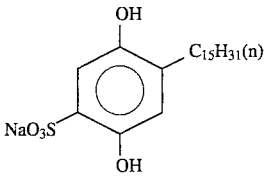
Cpd-L
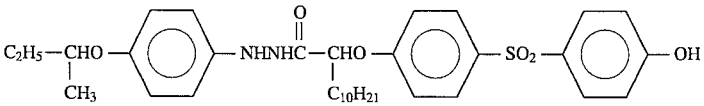
U-1
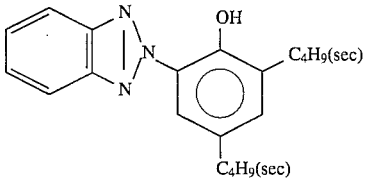
U-2
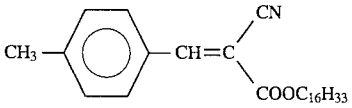
U-3
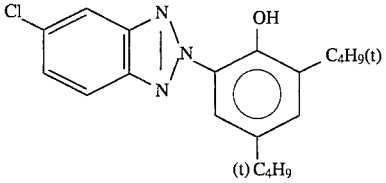
U-4
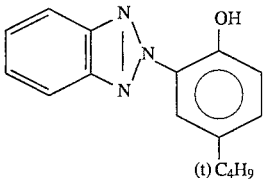
U-5
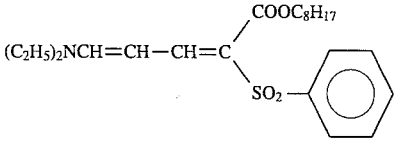
S-1
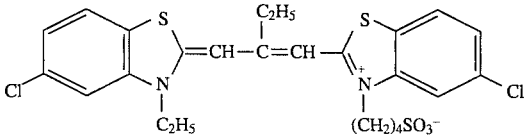
S-2
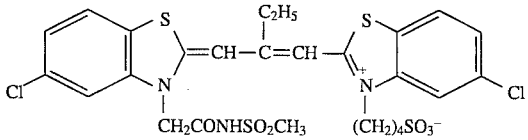
S-3
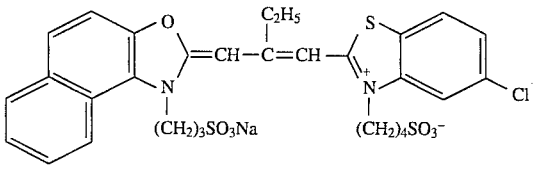

-continued
S-4
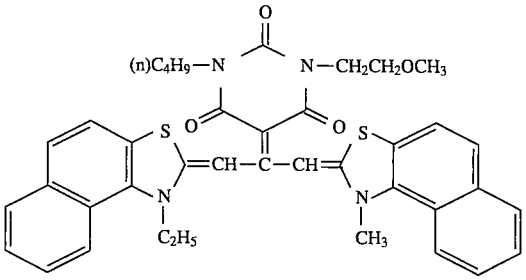
S-5
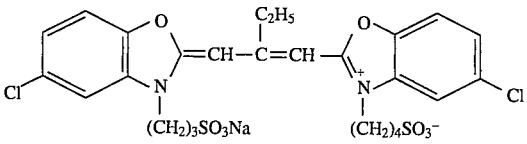
S-6
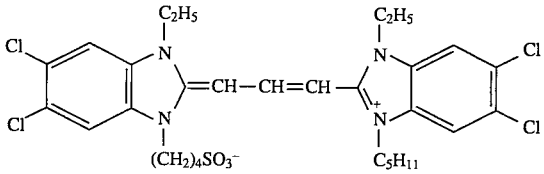
S-7
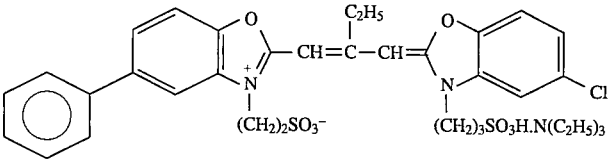
S-8
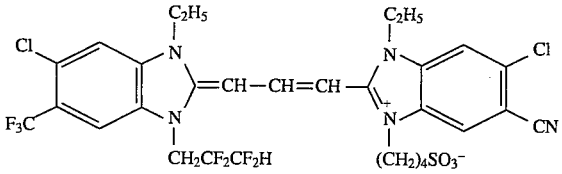
S-9
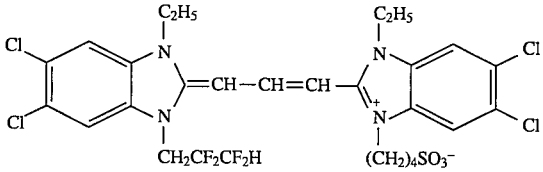
S-10
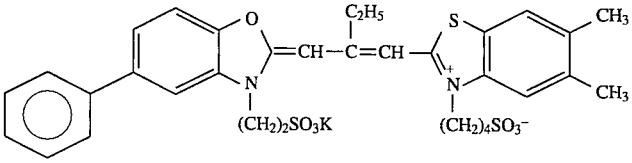
S-11
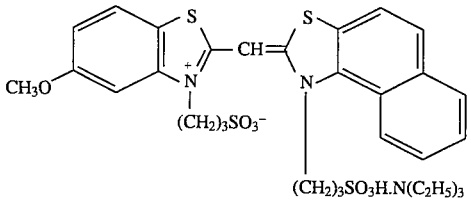
S-12
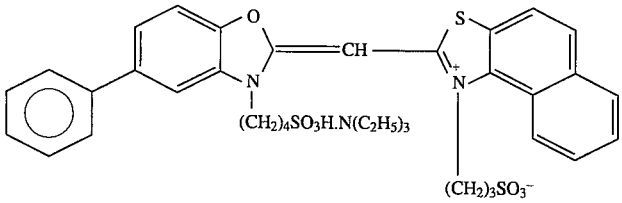

-continued
D-1
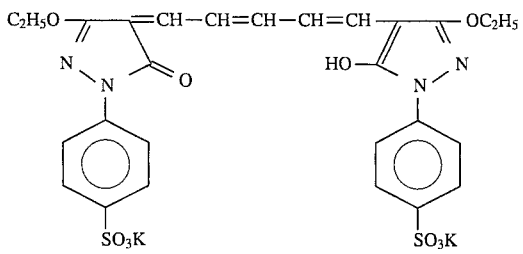
D-2
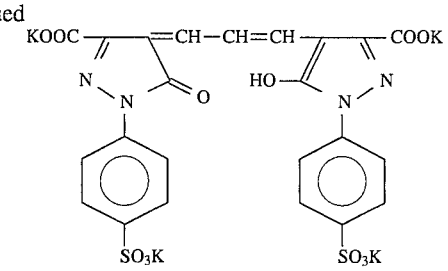
D-3
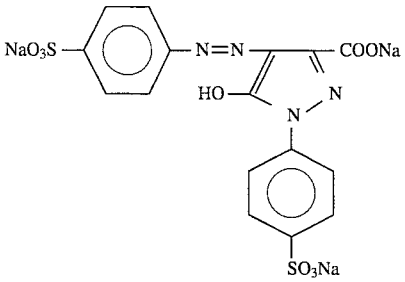
D-4
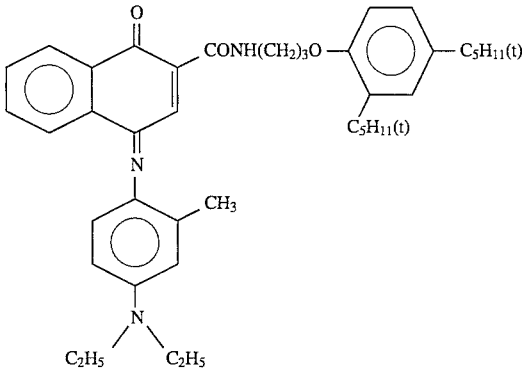
D-5
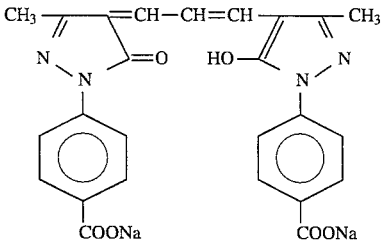
D-6
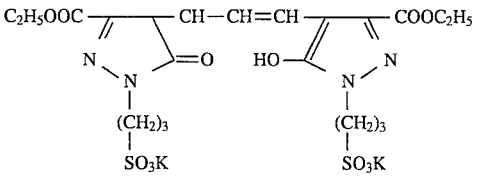
D-7
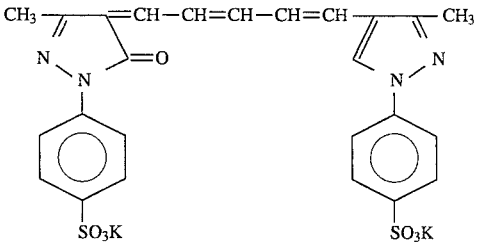
E-1
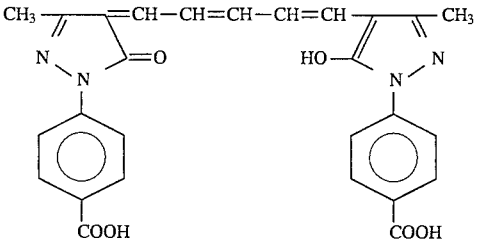
E-2
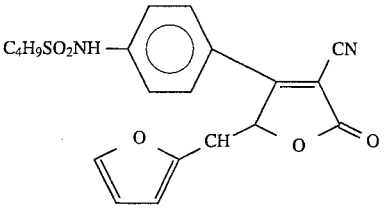
H-1
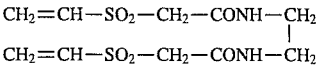
W-1
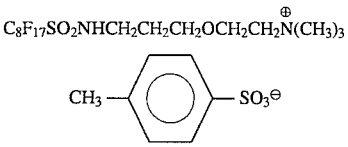
W-2
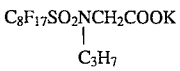
W-3
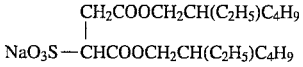
W-4
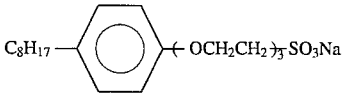

-continued

W-5

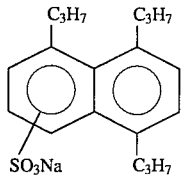

W-6

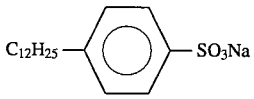

P-1

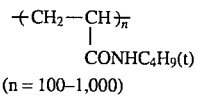

(n = 100–1,000)

M-1

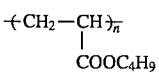

(n = 100–1,000)

F-1

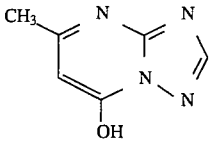

F-2

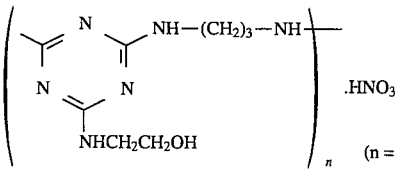

(n = 3~4)

F-3

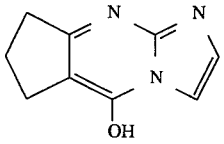

F-4

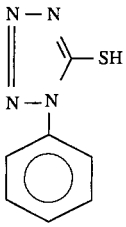

F-5

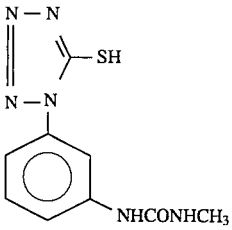

F-6

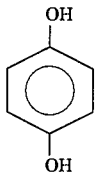

F-7

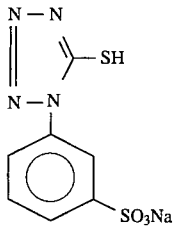

F-8

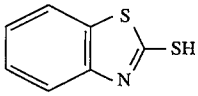

TABLE 5

Light-Sensitive Emulsions used in Sample 200

| Layer | Emulsion | Silver Coated Amount (g/m²) | Average Aspect Ratio of All Grains | Projected Area Diameter (circle-corresponding) Average Diameter (μm) | Projected Area Diameter (circle-corresponding) Coefficient of Variation (%) | AgI Content Average (mol %) | AgI Content Coefficient of Variation (%) | Property of Grain |
|---|---|---|---|---|---|---|---|---|
| Low speed red-sensitive emulsion layer | A | 0.16 | 1.0 | 0.24 | 13 | 4.0 | 55 | tetradecahedral |
| | B | 0.34 | 1.0 | 0.25 | 10 | 4.0 | 50 | tetradecahedral |
| | C | 0.19 | 1.0 | 0.28 | 10 | 4.0 | 20 | cubic |
| Medium speed red-sensitive emulsion layer | D | 0.50 | 1.0 | 0.43 | 18 | 4.6 | 50 | tetradecahedral |
| High speed red-sensitive emulsion layer | E | 0.50 | 4.1 | 1.43 | 8 | 1.6 | 20 | tabular |
| Low speed green-sensitive emulsion layer | F | 0.24 | 1.0 | 0.18 | 15 | 3.0 | 15 | cubic |
| | G | 0.41 | 1.0 | 0.24 | 11 | 3.0 | 30 | cubic |
| | H | 0.30 | 1.0 | 0.37 | 9 | 3.0 | 20 | cubic |
| Medium speed | I | 0.22 | 1.0 | 0.37 | 9 | 3.5 | 20 | cubic |

TABLE 5-continued

| | | | Light-Sensitive Emulsions used in Sample 200 | | | | | |
|---|---|---|---|---|---|---|---|---|
| green-sensitive emulsion layer | J | 0.28 | 1.0 | 0.52 | 9 | 3.2 | 25 | cubic |
| High speed green-sensitive emulsion layer | K | 0.44 | 4.5 | 1.64 | 25 | 1.6 | 65 | tabular |
| Low speed blue-sensitive emulsion layer | L | 0.17 | 1.0 | 0.32 | 12 | 4.0 | 15 | cubic |
| | M | 0.04 | 1.0 | 0.36 | 8 | 4.0 | 20 | cubic |
| | N | 0.22 | 1.0 | 0.53 | 10 | 4.0 | 35 | tetradecahedral |
| Medium speed blue-sensitive emulsion layer | O | 0.08 | 4.1 | 0.93 | 18 | 2.0 | 35 | tabular |
| | P | 0.08 | 4.1 | 1.15 | 17 | 2.5 | 30 | tabular |
| High speed blue-sensitive emulsion layer | Q | 0.21 | 3.0 | 1.52 | 25 | 1.2 | 65 | tabular |
| | R | 0.26 | 10.0 | 2.88 | 13 | 1.2 | 20 | tabular |

| Layer | Emulsion | Occupation Ratio of (111) Faces on Surface (g/m²) | Kind and Addition Amount of Sensitizing Dye (mg/Ag-mol) | | | | | | | |
|---|---|---|---|---|---|---|---|---|---|---|
| | | | Kind | Amount | Kind | Amount | Kind | Amount | Kind | Amount |
| Low speed red-sensitive emulsion layer | A | 45 | S-1 | 250 | S-4 | 25 | — | — | — | — |
| | B | 5 | S-2 | 381 | S-4 | 20 | — | — | — | — |
| | C | 0 | S-2 | 264 | S-3 | 41 | S-4 | 14 | — | — |
| Medium speed red-sensitive emulsion layer | D | 0 | S-1 | 267 | S-4 | 105 | — | — | — | — |
| High speed red-sensitive emulsion layer | E | 95 | S-1 | 66 | S-2 | 240 | S-3 | 22 | S-4 | 11 |
| Low speed green-sensitive emulsion layer | F | 15 | S-5 | 544 | S-6 | 128 | — | — | — | — |
| | G | 14 | S-5 | 422 | S-6 | 122 | — | — | — | — |
| | H | 12 | S-5 | 479 | S-6 | 86 | — | — | — | — |
| Medium speed green-sensitive emulsion layer | I | 0 | S-5 | 479 | S-6 | 86 | — | — | — | — |
| | J | 5 | S-5 | 273 | S-8 | 55 | S-10 | 28 | — | — |
| High speed green-sensitive emulsion layer | K | 92 | S-7 | 213 | S-9 | 71 | S-10 | 33 | — | — |
| Low speed blue-sensitive emulsion layer | L | 25 | S-12 | 92 | S-11 | 40 | — | — | — | — |
| | M | 20 | S-12 | 85 | S-11 | 38 | — | — | — | — |
| | N | 45 | S-12 | 60 | S-11 | 27 | — | — | — | — |
| Medium speed blue-sensitive emulsion layer | O | 95 | S-12 | 260 | S-11 | 49 | — | — | — | — |
| | P | 91 | S-12 | 207 | S-11 | 40 | — | — | — | — |
| High speed blue-sensitive emulsion layer | Q | 90 | S-12 | 187 | S-11 | 36 | — | — | — | — |
| | R | 88 | S-12 | 173 | S-11 | 33 | — | — | — | — |

Preparation of Samples 201 to 211

Samples 201 to 211 as samples for comparison between the yellow colloidal silver and the solid disperse dye of a compound of Formula (i) of the present invention in the thirteenth layer (yellow filter layer) of Sample 200, were prepared in the same manner as Sample 200 except for changing the AgI content of the emulsion added to the ninth layer and the amount of yellow colloidal silver added to the third layer, the eighth layer and the thirteenth layer as shown in Table 6.

The compound represented by formula (i) of the present invention was added as a solid dye dispersion prepared as follows.

Preparation of Organic Solid Dye Dispersion 10 g of the compound represented by formula (i) was placed in a pot together with 2 g of Demol T (a surface active agent, produced by KAO Corporation), 241 ml of water and 400 ml of zirconium oxide beads and dispersed in a vibration ball mill manufactured by Chuo Koki KK for four days. After the dispersion, the content was taken out, the beads were removed by filtration and gelatin was added thereto to obtain an organic solid dye dispersion.

Evaluation of Samples 200 to 211

Evaluation of Sensitivity

The thus-obtained Samples 200 to 211 each was exposed (exposure time: 1/100 second) through an optical wedge with a daylight source at a color temperature of 5,400K, developed as described below and determined on the sensitivity. The sensitivity obtained from the reciprocal of the exposure amount giving a magenta density of 1.0 are shown in Table 6 as a relative sensitivity to the sensitivity of Sample 200 taken as 100.

Evaluation of Saturation

The evaluation method of saturation in color reproduction is described below. The yellow, magenta and cyan of a Macbeth color chart were photographed at a color temperature of 5,400K while varying the exposure level and the average of each of the cyan and magenta densities (at the photographing of yellow), the yellow and cyan densities (at the photographing of magenta) and the yellow and magenta densities (at the photographing of cyan) was determined when the yellow density (at the photographing of yellow), the magenta density (at the photographing of magenta) and the cyan density (at the photographing of cyan) each reached 1.5 after the development processing. As a result, in Sample 200, the average was 0.43 (at the photographing of yellow), 0.64 (at the photographing of magenta) or 0.75 (at the photographing of cyan). With respect to Samples 201 to 211, the changed values from the above-described average value of Sample 200 are shown in Table 6. The smaller the average, the higher the saturation in color reproduction and therefore, the negative value in Table 6 indicates that the sample is higher in the saturation than Sample 200. In carrying out comparison of the color reproduction among Samples 200 to 211, if the coloration is not the same after the development processing when gray was photographed on each sample, the evaluation cannot be conducted correctly. Accordingly, in photographing the color chart, an optical filter was disposed nearer to the light source than the sample to obtain the same coloration after development processing at the photographing of gray.

Evaluation of Color Temperature Dependency

The evaluation method of the change in coloration resulting from the change of the color temperature is described below. The same optical filter as in the above-described photographing of a color chart was used and a gray photographing was carried out with a light source having a color temperature of 5,400K (corresponding to the color temperature of fine weather) or with a light source having a color temperature of 7,500K (corresponding to the color temperature of cloudy weather). The change in coloration was determined at a magenta density after development processing of 0.5. Due to the change in color temperature from 5,400K to 7,500K, the yellow density is reduced and the cyan density is increased and accordingly, the sum of the change width in the density is shown in Table 6.

The results are shown in Table 6.

TABLE 6

| Sample No. | 200 (Comp.) | 201 (Comp.) | 202 (Comp.) | 203 (Comp.) | 204 (Comp.) | 205 (Comp.) | 206 (Comp.) | 207 (Comp.) | 208 (Comp.) | 209 (Inv.) | 210 (Inv.) | 211 (Inv.) |
|---|---|---|---|---|---|---|---|---|---|---|---|---|
| Solid disperse dye of formula (i) ($g/m^2$) | none | none | none | none | none | none | 1<br>0.34 | 1<br>0.34 | 2<br>0.34 | 1<br>0.34 | 1<br>0.34 | 1<br>0.34 |
| AgI content (9th Layer) AGI(GL) | 3.0 | 4.2 | 8.0 | 3.0 | 4.2 | 8.0 | 3.0 | 4.2 | 8.0 | 3.6 | 4.2 | 6.0 |
| AgI(GL)/ AgI(BL) | 0.75 | 1.05 | 2.00 | 0.75 | 1.05 | 2.00 | 0.75 | 1.05 | 2.00 | 0.90 | 1.05 | 1.50 |
| AgI(GL)/ AgI(RL) | 0.75 | 1.05 | 2.00 | 0.75 | 1.05 | 2.00 | 0.75 | 1.05 | 2.00 | 0.90 | 1.05 | 1.50 |
| Yellow colloidal silver ($g/m^2$) | | | | | | | | | | | | |
| 13th Layer | 0.10 | 0.10 | 0.10 | 0.10 | 0.10 | 0.10 | — | — | — | 0.02 | 0.02 | 0.02 |
| 8th Layer | — | — | — | 0.02 | 0.02 | 0.02 | — | — | — | 0.02 | 0.02 | 0.02 |
| 3rd Layer | — | — | — | 0.01 | 0.01 | 0.01 | — | — | — | 0.01 | 0.01 | 0.01 |
| Sensitivity (magenta density: 1.0) | 100 | 102 | 104 | 102 | 104 | 105 | 120 | 122 | 124 | 125 | 125 | 128 |
| Saturation | | | | | | | | | | | | |
| Yellow | 0.00 | −0.01 | −0.02 | 0.00 | −0.01 | −0.02 | −0.08 | −0.09 | −0.09 | −0.11 | −0.12 | −0.13 |
| Magenta | 0.00 | 0.02 | 0.01 | −0.06 | −0.04 | −0.02 | −0.03 | −0.03 | 0.02 | −0.10 | −0.10 | −0.08 |
| Cyan | 0.00 | 0.00 | −0.01 | −0.03 | −0.03 | −0.05 | −0.01 | −0.03 | −0.04 | −0.08 | −0.08 | −0.10 |
| Color temperature dependency (coloration changed density) | 0.13 | 0.12 | 0.10 | 0.16 | 0.15 | 0.14 | 0.05 | 0.05 | 0.04 | 0.05 | 0.05 | 0.04 |

The following can be seen from the results in Table 6.

In Comparative Sample 200, the sensitivity was low, the saturation in color reproduction was insufficient and the change in coloration due to the color temperature was large. In Samples 201 and 202 where the AgI(GL) content was increased, the color temperature dependency was slightly improved but the saturation in magenta color reproduction was lowered. In Samples 203 to 205 where yellow colloidal silver was added to the eighth layer and the third layer, the saturation in magenta and cyan color reproduction was improved but yet the sensitivity was low and the color temperature dependency was worsened. In Samples 206 to 208 in which yellow colloidal silver was removed and a solid disperse dye of formula (i) of the present invention was used in the yellow filter layer, the sensitivity was high, the color temperature dependency was improved and the saturation in yellow color reproduction was improved, however, the saturation in magenta and cyan color reproduction was low.

In Samples 209 to 211 in which a solid disperse dye of formula (i) of the present invention was used in the yellow filter layer and at the same time, yellow colloidal silver was added to the thirteenth layer, the eighth layer and the third layer, the sensitivity was high, the saturation in color reproduction was high and the color temperature dependency was small, thus good results were exhibited. In particular, in Samples 209, 210 and 211 having an AgI(GL)/AgI(BL) ratio or an AgI(GL)/AgI(RL) ratio of 0.90, 1.05 and 1.50, respectively, the coloration changed density showing the color temperature dependency was extremely small as 0.05 or less and at the same time, the saturation in color reproduction of all of yellow, magenta and cyan showed a small value as −0.08 or less (namely, high saturation), thus particularly preferred results were obtained.

Processing Step and Processing Solution in Development Processing:

| Processing Step | Time (min) | Temperature (°C.) | Tank Volume (l) | Replenishing Amount (ml/m²) |
|---|---|---|---|---|
| First development | 6 | 38 | 12 | 2,200 |
| First water washing | 2 | 38 | 4 | 7,500 |
| Reversal | 2 | 38 | 4 | 1,100 |
| Color development | 6 | 38 | 12 | 2,200 |
| Pre-bleaching | 2 | 38 | 4 | 1,100 |
| Bleaching | 6 | 38 | 12 | 220 |
| Fixing | 4 | 38 | 8 | 1,100 |
| Second water washing | 4 | 38 | 8 | 7,500 |
| Final rinsing | 1 | 25 | 2 | 1,100 |

Each processing solution had the following composition.

First Developer:

| | Tank Solution (g) | Replenisher (g) |
|---|---|---|
| Pentasodium nitrilo-N,N,N-trimethylenephosphonate | 1.5 | 1.5 |
| Pentasodium diethylenetriaminepentaacetate | 2.0 | 2.0 |
| Sodium sulfite | 30 | 30 |
| Potassium hydroquinone. monophosphonate | 20 | 20 |
| Potassium carbonate | 15 | 20 |
| Potassium bicarbonate | 12 | 15 |
| 1-Phenyl-4-methyl-4-hydroxymethyl-3-pyrazolidone | 1.5 | 2.0 |
| Potassium bromide | 2.5 | 1.4 |
| Potassium thiocyanate | 1.2 | 1.2 |
| Potassium iodide | 2.0 mg | — |
| Diethylene glycol | 13 | 15 |
| Water to make | 1,000 ml | 1,000 ml |
| pH | 9.60 | 9.60 |

The pH was adjusted by sulfuric acid or potassium hydroxide.

Reversal Solution:

| | Tank Solution (g) | Replenisher (g) |
|---|---|---|
| Pentasodium nitrilo-N,N,N-trimethylenephosphonate | 3.0 | same as tank solution |
| Stannous chloride dihydrate | 1.0 | |
| p-Aminophenol | 0.1 | |
| Sodium hydroxide | 8 | |
| Glacial acetic acid | 15 ml | |
| Water to make | 1,000 ml | |
| pH | 6.00 | |

The pH was adjusted by acetic acid or sodium hydroxide.

Color Developer

| | Tank Solution (g) | Replenisher (g) |
|---|---|---|
| Pentasodium nitrilo-N,N,N-trimethylenephosphonate | 2.0 | 2.0 |
| Sodium sulfite | 7.0 | 7.0 |
| Trisodium phosphate dodecahydrate | 36 | 36 |
| Potassium bromide | 1.0 | — |
| Potassium iodide | 90 mg | — |
| Sodium hydroxide | 3.0 | 3.0 |
| Citrazinic acid | 1.5 | 1.5 |
| N-Ethyl-N-(β-methanesulfonamidoethyl)-3-methyl-4-aminoaniline.3/2 sulfuric acid monohydrate | 11 | 11 |
| 3,6-Dithiaoctane-1,8-diol | 1.0 | 1.0 |
| Water to make | 1,000 ml | 1,000 ml |
| pH | 11.80 | 12.00 |

The pH was adjusted by sulfuric acid or potassium hydroxide.

Pre-Bleaching Solution:

| | Tank Solution (g) | Replenisher (g) |
|---|---|---|
| Disodium ethylenediaminetetraacetate dihydrate | 8.0 | 8.0 |
| Sodium sulfite | 6.0 | 8.0 |
| 1-Thioglycerol | 0.4 | 0.4 |
| Formaldehyde sodium bisulfite adduct | 30 | 35 |
| Water to make | 1,000 ml | 1,000 ml |
| pH | 6.30 | 6.10 |

The pH was adjusted by acetic acid or sodium hydroxide.

Bleaching Solution:

| | Tank Solution (g) | Replenisher (g) |
|---|---|---|
| Disodium ethylenediaminetetraacetate dihydrate | 2.0 | 4.0 |
| Ammonium ethylenediaminetetraacetato.ferrate dihydrate | 120 | 240 |
| Potassium bromide | 100 | 200 |
| Ammonium nitrate | 10 | 20 |
| Water to make | 1,000 ml | 1,000 ml |
| pH | 5.70 | 5.50 |

The pH was adjusted by nitric acid or sodium hydroxide.

Fixing Solution:

| | Tank Solution (g) | Replenisher (g) |
|---|---|---|
| Ammonium thiosulfate | 80 | same as tank solution |
| Sodium sulfite | 5.0 | same as tank |

-continued

| Fixing Solution: | | |
|---|---|---|
| | Tank Solution (g) | Replenisher (g) |
| Sodium bisulfite | 5.0 | solution same as tank solution |
| Water to make | 1,000 ml | |
| pH | 6.60 | |

The pH was adjusted by acetic acid or aqueous ammonia.

| Stabilizing Solution: | | |
|---|---|---|
| | Tank Solution (g) | Replenisher (g) |
| 1,2-Benzoisothiazoline-3-one | 0.02 | 0.03 |
| Polyoxyethylene-p-monononyl-phenyl ether (average polymerization degree: 10) | 0.3 | 0.3 |
| Polymaleic acid (average molecular weight: 2,000) | 0.1 | 0.15 |
| Water to make | 1,000 ml | 1,000 ml |
| pH | 7.0 | 7.0 |

Solid Dye Dispersion described in Example 3 and then added.

Solid dispersion Dye α for comparison used in Comparative Sample 301 was the same as Compound I-4 used in the example of JP-A-1-303437 and it was added according the method described below. The chemical formulae of Comparative Compounds α and β are shown below.

Addition Method of Comparative Compound α

0.70 g of Comparative Dye α, 1.0 ml of High Boiling Point Organic Solvent (Oil-2) and 0.08 g of Surface Active Agent (W-6) were mixed and thereto 15 ml of ethyl acetate was added and dissolved under heating at 70° C. to prepare an organic compound solution.

100 ml of water was added to lime-processed gelatin and after swelling for 1 hour, dissolved under heating at 50° C. to produce a hydrophilic colloid solution and thereto the organic compound solution prepared above was added and mixed and then emulsion-dispersed in a high-speed rotary homogenizer (rotation number: 15,000 rpm) for 5 minutes to prepare an emulsified dispersion of Organic Compound α. The thus-obtained emulsified dispersion was added in Sample 301.

Comparative Compound α in Table 7:

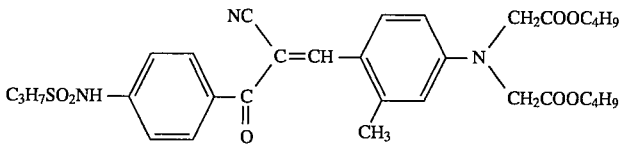

Comparative Compound β in Table 7:
(Compound Dye 1 described in U.S. Pat. 4,923,788)

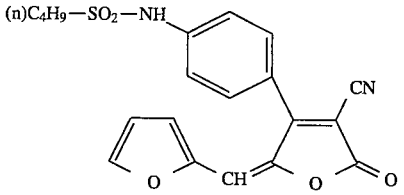

EXAMPLE 4

This example is to demonstrate the usefulness of using a solid disperse dye of the compound represented by formula (i) of the present invention as a yellow filter by comparing it with conventionally commonly used yellow colloidal silver and with the solid disperse dye according to a conventional technique outside of the present invention.

Preparation of Samples 301 to 304

Samples 301 to 304 were prepared in the same manner as Sample 210 except for changing the solid disperse dye 1 of the compound represented by formula (i) of the present invention used in the thirteenth layer (yellow filter layer) of Sample 210 in Example 3 as shown in Table 7.

The compound represented by formula (i) of the present invention and Comparative Compound β each was formulated into a solid dispersion as in Preparation of Organic

Evaluation of Samples 301 to 304 and 204, 207 and 210

The evaluation of capability was conducted as follows on Samples 301 to 304 obtained as above and also on Samples 204 and 210 the same as Samples 301 to 304 except for the constitution of the thirteenth layer, on Sample 210 of the present invention and on Sample 207 different from Sample 210 only in the use method of yellow colloidal silver in the thirteenth layer, the eighth layer and the third layer (requirement (e)).

Evaluation of Sensitivity

Similarly to the evaluation of sensitivity in Example 3, the sensitivity obtained from the reciprocal of the exposure amount giving a magenta density of 1.0 is shown in Table 7 as a relative sensitivity to the sensitivity of Sample 200 in Example 3 taken as 100.

Evaluation of Raw Stock Storability of Photographic Material

After the completion of hardening reaction following the preparation, each sample was stored in conditions of 45° C. and 75% RH for 14 days so as to compare the raw stock storability of a photographic material among samples and then examined on the photographic capability according to the same operation as in the evaluation of sensitivity. The photographic materials using a solid disperse dye obtained from a comparative compound exhibited, after aging in the raw stock storability test of the photographic material, remarkable reduction in the sensitivity particularly of a blue-sensitive emulsion layer and conspicuous increase in the minimum yellow density on the area where a sufficiently large amount of light was given. The results are shown in Table 7.

With respect to the reduction in sensitivity of the blue-sensitive emulsion layer, the reciprocal of the exposure amount giving a yellow density of 1.0 was obtained before raw stock storability test (Fresh) and after raw stock storability test (Test) and it is shown by a common logarithm of a ratio of the sensitivity (Test) to the sensitivity (Fresh) (the smaller, the larger the reduction in sensitivity).

The increase in the minimum yellow density is shown by a value obtained by subtracting the density value before raw stock storability test from the density value after the raw stock storability test.

In the raw stock storability test, the difference between the solid disperse dye of the present invention of formula (i) and the comparative dye was more distinguishable. More specifically, Samples 210, 303 and 304 using a solid disperse dye of formula (i) of the present invention each was low in the reduction in sensitivity of the blue-sensitive emulsion layer and in the increase in the minimum yellow density as compared with Sample 204 using yellow colloidal silver as a yellow filter, thus they showed good capability (in Samples 303 and 304, a slight increase in the minimum yellow density was observed, but the degree was small and on a practically allowable level). On the other hand, in Comparative Samples 301 and 302, the reduction in sensitivity of the blue-sensitive emulsion layer was conspicuous and the increase in the minimum yellow density was also large, thus they could not be allowable in practical use.

As described above, the superiority of the solid disperse dye of formula (i) of the present invention is clearly verified.

With respect to the effect of yellow colloidal silver on the raw stock storability test (requirement (e)), as is seen from the comparison between Samples 207 and 210, no particular adverse effect was found.

EXAMPLE 5

This example is to demonstrate the usefulness of the combination such that a solid disperse dye of the compound represented by formula (i) of the present invention is used in place of yellow colloidal silver conventionally commonly used as a yellow filter and at the same time, the requirement (a) described in claim 1 is satisfied, namely, a surface- and/or inside-fogged silver iodobromide emulsion is used.

Samples 401 and 402 were prepared in the same manner as Samples 201 and 207, respectively, except for the following changes made on Samples 201 and 207 of Example 3.

TABLE 7

| Sample No. | 204 (Comp.) | 207 (Comp.) | 210 (Inv.) | 301 (Comp.) | 302 (Comp.) | 303 (Inv. | 304 (Inv.) |
|---|---|---|---|---|---|---|---|
| Dye of 13th Layer (g/m$^2$) | none | 1 Invention 0.34 | 1 Invention 0.34 | α Comparative 0.34 | β Comparative 0.34 | 5 Invention 0.34 | 30 Invention 0.34 |
| AgI content (9th Layer) AgI(GL) | 4.2 | 4.2 | 4.2 | 4.2 | 4.2 | 4.2 | |
| AgI(GL)/AgI(BL) | 1.05 | 1.05 | 1.05 | 1.05 | 1.05 | 1.05 | |
| AgI(GL)/AgI(RL) | 1.05 | 1.05 | 1.05 | 1.05 | 1.05 | 1.05 | |
| Yellow colloidal silver (g/m$^2$) | | | | | | | |
| 13th Layer | 0.10 | — | 0.02 | 0.02 | 0.02 | 0.02 | 0.02 |
| 8th Layer | 0.02 | — | 0.02 | 0.02 | 0.02 | 0.02 | 0.02 |
| 3rd Layer | 0.01 | — | 0.01 | 0.01 | 0.01 | 0.01 | 0.01 |
| Sensitivity (magenta density: 1.0) | 104 | 122 | 125 | 115 | 103 | 130 | 120 |
| Saturation | | | | | | | |
| Yellow | −0.01 | −0.09 | −0.12 | −0.11 | −0.10 | −0.13 | -0.12 |
| Magenta | −0.04 | −0.03 | −0.10 | −0.09 | −0.09 | −0.11 | 0.10 |
| Cyan | −0.03 | −0.03 | −0.08 | −0.08 | −0.08 | -0.08 | -0.08 |
| Color temperature dependency (coloration changed density) | 0.15 | 0.05 | 0.05 | 0.05 | 0.05 | 0.05 | 0.05 |
| Raw stock storability | | | | | | | |
| Reduction in sensitivity of blue-sensitive emulsion layer | −0.00 | −0.00 | −0.00 | −0.17 | −0.24 | -0.00 | -0.01 |
| Increase in minimum yellow density | +0.00 | −300.00 | +0.00 | +0.04 | +0.09 | +0.005 | +0.015 |

From the results in Table 7, the following can be seen.

In Samples 210, 303 and 304 of the present invention using a solid disperse of formula (i) of the present invention, the increase in sensitivity was large as compared with Sample 204 using yellow colloidal silver, whereas in Samples 301 and 302 using a comparative dye, the increase in sensitivity was small.

| Layer | Kind of Fogged Emulsion | Average Grain Size (μm) | AgI Content (mol %) | Addition Amount (g/m²) |
|---|---|---|---|---|
| 3rd Layer | surface- and inside-fogged type | 0.06 | 1.0 | 0.05 |
| 4th Layer | inside-fogged type | 0.20 | 0.0 | 0.04 |
| 9th Layer | inside-fogged type | 0.20 | 0.01 | 0.02 |
| 14th Layer | inside-fogged type | 0.24 | 0.02 | 0.01 |

Samples 201, 207, 401 and 402 were tested in the same manner as in Example 3 and then the results as shown in Table 8 were obtained. Sample 402 of the present invention exhibited very good results such that the sensitivity was high, the saturation in color reproduction was high and the color temperature dependency was small. Sample 402 of the present invention exhibited good results even on a raw stock storability test conducted in the same manner as in Example 4 and thus, it was very useful.

TABLE 8

| Sample No. | 201 (Comp.) | 207 (Comp.) | 401 (Comp.) | 403 (Inv.) |
|---|---|---|---|---|
| Solid disperse dye of 13th layer (g/m²) | none | 1 Invention 0.34 | none | 1 Invention 0.34 |
| Yellow colloidal silver of 13th layer (g/m²) | 0.10 | none | 0.10 | none |
| AgI content (9th Layer) AgI(GL) | 4.2 | 4.2 | 4.2 | 4.2 |
| AgI(GL)/AgI(BL) | 1.05 | 1.05 | 1.05 | 1.05 |
| AgI(GL)/AgI(RL) | 1.05 | 1.05 | 1.05 | 1.05 |
| Fogged emulsion (g/m²) | | | | |
| 3rd Layer: surface- and inside-fogged type | — | — | 0.05 | 0.05 |
| 4th Layer: inside-fogged type | — | — | 0.04 | 0.04 |
| 9th Layer: inside-fogged type | — | — | 0.02 | 0.02 |
| 14th Layer: inside-fogged type | — | — | 0.01 | 0.01 |
| Sensitivity (magenta density: 1.0) | 102 | 122 | 106 | 128 |
| Saturation | | | | |
| Yellow | −0.01 | −0.09 | −0.01 | −0.12 |
| Magenta | 0.02 | −0.03 | −0.05 | −0.11 |
| Cyan | 0.00 | −0.03 | −0.05 | −0.10 |
| Color temperature dependency (coloration changed density) | 0.15 | 0.05 | 0.18 | 0.06 |
| Raw stock storability | −0.00 | −0.00 | −0.00 | −0.00 |
| Reduction in sensitivity of blue-sensitive emulsion layer | | | | |
| Increase in minimum yellow density | +0.00 | +0.00 | +0.00 | +0.00 |

EXAMPLE 6

This example is to demonstrate the usefulness of the combination such that the solid disperse dye of a compound represented by formula (i) of the present invention is used in place of yellow colloidal silver conventionally commonly used as a yellow filter and at the same time, the requirement (b) described in claim 1 is satisfied, namely, a DIR compound represented by formula (F) is used.

Samples 501 and 502 were prepared in the same manner as Samples 201 and 207, respectively, except for adding Compound I-10 as a compound represented by formula (F) in an amount of 50 mg/m² to the second layer, 40 mg/m² to the eighth layer and 10 mg/m² to the thirteenth layer, of Samples 201 and 207 of Example 3. Samples 201, 207, 501 and 502 were tested in the same manner in Example 3 and then the results as shown in Table 9 were obtained. Sample 502 of the present invention exhibited very good results such that the sensitivity was high, the saturation in color reproducing was high and the color temperature dependency was small. Sample 502 of the present invention showed good results even on the same raw stock storability test as in Example 4 and thus, it was very useful.

TABLE 9

| Sample No. | 201 (Comp.) | 207 (Comp.) | 501 (Comp.) | 502 (Inv.) |
|---|---|---|---|---|
| Solid disperse dye of 13th layer (g/m²) | none | 1 Invention 0.34 | none | 1 Invention 0.34 |
| Yellow colloidal silver of 13th layer (g/m²) | 0.10 | none | none 0.10 | |
| AgI content (9th Layer) AgI(GL) | 4.2 | 4.2 | 4.2 | 4.2 |
| AgI(GL)/AgI(BL) | 1.05 | 1.05 | 1.05 | 1.05 |
| AgI(GL)/AgI(RL) | 1.05 | 1.05 | 1.05 | 1.05 |
| Compound of formula (F) (mg/m²) | | | I-10 | I-10 |
| 2nd Layer: | — | — | 50 | 50 |
| 8th Layer: | — | — | 40 | 40 |
| 13th Layer: | — | — | 10 | 10 |
| Sensitivity (magenta density: 1.0) | 102 | 122 | 97 | 118 |
| Saturation | | | | |
| Yellow | −0.01 | −0.09 | −0.03 | −0.13 |
| Magenta | 0.02 | −0.03 | −0.07 | −0.13 |
| Cyan | 0.00 | −0.03 | −0.06 | −0.11 |
| Color temperature dependency (coloration changed density) | 0.15 | 0.05 | 0.20 | 0.07 |
| Raw stock storability | | | | |
| Reduction in sensitivity of: blue-sensitive emulsion layer | −0.00 | −0.00 | −0.00 | −0.00 |
| Increase in minimum yellow density | +0.00 | +0.00 | +0.00 | +0.00 |

Further, Samples 504 to 512 were prepared in the same manner as Sample 501 except for replacing Compound I-10 of Sample 501 by Compound I-2, I-12, I-28,I-36, I-48, I-51, I-58, I-70 or I-87. Samples 504 to 512 were tested in the same manner as in Example 3 and then showed good results similarly to those of Sample 501.

EXAMPLE 7

This example is to demonstrate the usefulness of the combination such that a solid disperse dy of the compound represented by formula (i) of the present invention is used in place of yellow colloidal silver conventionally commonly used as a yellow filter and at the same time requirement (c) described in claim 1 was satisfied, namely, a compound of formula (ii) was used.

Samples 601 and 602 were prepared in the same manner as Samples 201 and 207, respectively, except for adding Compound (ii)-11 as a compound represented by formula (ii) of the present invention in an amount of 15 mg/m$^2$ to the fourth layer, 15 mg/m$^2$ to the ninth layer and 3 mg/m$^2$ to the fourteenth layer, of Samples 201 and 207 of Example 3. Samples 201, 207, 601 and 602 were tested in the same manner as in Example 3 and then the results as shown in Table 10 were obtained. Sample 602 of the present invention exhibited very good results such that the sensitivity was high, the saturation in color reproduction was high and the color temperature dependency was small. Sample 602 of the present invention showed good results even on the same raw stock storability test as in Example 4, thus it was very useful.

TABLE 10

| Sample No. | 201 (Comp.) | 207 (Comp.) | 601 (Comp.) | 602 (Inv.) |
|---|---|---|---|---|
| Solid disperse dye of 13th layer (g/m$^2$) | none | 1 Invention 0.34 | none | 1 Invention 0.34 |
| Yellow colloidal silver of 13th layer (g/m$^2$) | 0.10 | none | none 0.10 | |
| AgI content (9th Layer) AgI(GL) | 4.2 | 4.2 | 4.2 | 4.2 |
| AgI(GL)/AgI(BL) | 1.05 | 1.05 | 1.05 | 1.05 |
| AgI(GL)/AgI(RL) | 1.05 | 1.05 | 1.05 | 1.05 |
| Compound of formula (ii) (mg/m$^2$) | | | (ii)-11 | (ii)-11 |
| 4th Layer: | — | — | 15 | 15 |
| 9th Layer: | — | — | 15 | 15 |
| 14th Layer: | — | — | 3 | 3 |
| Sensitivity (magenta density: 1.0) | 102 | 122 | 99 | 120 |
| Saturation | | | | |
| Yellow | −0.01 | −0.09 | −0.02 | −0.11 |
| Magenta | 0.02 | −0.03 | −0.06 | −0.09 |
| Cyan | 0.00 | −0.03 | −0.05 | −0.09 |
| Color temperature dependency (coloration changed density) | 0.15 | 0.05 | 0.19 | 0.06 |
| Raw stock storability | | | | |
| Reduction in sensitivity of: blue-sensitive emulsion layer | −0.00 | −0.00 | −0.00 | −0.00 |
| Increase in minimum yellow density | +0.00 | +0.00 | +0.00 | +0.00 |

EXAMPLE 8

The photographic materials subjected to evaluations in Examples 3 to 7 all were a silver halide color reversal photographic material for camera work under a daylight source which was adjusted to give a balance in sensitivity among the red-sensitive layer, the green-sensitive layer and the blue-sensitive layer in photographing under a daylight source. This example is to demonstrate that the present invention is particularly useful for a silver halide color reversal photographic material for camera work under a tungsten light source.

Silver halide color reversal photographic materials for camera work under a tungsten light source were prepared from the photographic materials subjected to evaluations in Examples 3 to 7, each of which was adjusted to have a balance in sensitivity among the red-sensitive layer, the green-sensitive layer and the blue-sensitive layer in photographing under a tungsten light source in such a manner that the sensitivity of the green-sensitive layer was elevated by reducing the coated amount of water-soluble Dye D-2 added to the twelfth layer to 0.32 g/m$^2$ and the sensitivity of the blue-sensitive layer was elevated by reducing the coated amount of water-soluble Dye D-3 added to the eighteenth layer to 0.10 g/m$^2$, replacing Emulsions L and M of the fourteenth layer by the same silver amount of Emulsion O and P, replacing Emulsions O and P of the fifteenth layer by the same silver amount of Emulsions Q and R and further replacing Emulsions Q and R of the sixteenth layer by the same silver amount of Emulsion S (average aspect ratio: 1.5, projected area-corresponding circle diameter: 2.3 μm (coefficient of variation: 12%), AgI content: 1.8 mol % (coefficient of variation 15%)). These samples were tested in the same manner as in Examples 3 and 4 except for changing the light source in photographing to a tungsten light source and conducting the evaluation of color temperature dependency at 2,800K and 3,200K. As a result, similarly to the results in Examples 3 to 7, samples of the present invention exhibited very good results such that the sensitivity was high, the saturation in color reproduction was high and the color temperature dependency was small and also showed good results even on the same raw stock storability test as in Example 4, thus these samples were found to be very useful.

EXAMPLE 9

The effect of the present invention could be achieved alike even when the above-described color reversal development was changed as follows.

Processing Step:

| Step | Processing Time (min) | Processing Temperature (°C.) | Replenishing Amount*1 (ml) | Tank Volume (l) |
|---|---|---|---|---|
| First development | 6 | 38 | 2,200 | 12 |
| First water washing | 2 | 38 | 7,500 | 4 |
| Reversal | 2 | 39 | 1,100 | 4 |
| Color development | 6 | 38 | 2,200 | 12*3 |
| Pre-bleaching | 2 | 38 | 1,100 | 4 |
| Bleaching | 6 | 38 | 220 | 12 |
| Water washing (1) | 1 | 24 | 7,500 | 2 |
| Fixing | 4 | 38 | 1,100 | 8 |
| Water washing (2) | 2 | 24 | *2 | 2 |
| Water washing (3) | 2 | 24 | 7,500 | 2 |
| Stabilization | 1 | 38 | 1,100 | 2 |
| Drying | 4 | 55 | | |

*1The replenishing amount was per m$^2$ of the photographic material.
*2Supplied in a counter-current piping system from water washing (3) to (2)
*3An aeration device was equipped in the bleaching solution tank and aeration was carried out at a rate of 1 l/min.

| | Tank Solution (g) | Replenisher (g) |
|---|---|---|
| Pre-Bleaching Solution: | | |
| Sodium sulfite | 3.0 | 3.0 |
| Sodium bisulfite | 3.0 | 5.0 |
| Formaldehyde sodium bisulfite adduct | 30.0 | 35.0 |
| Disodium ethylenediamine-tetraacetate | 1.0 | 1.1 |
| Water to make | 1,000 ml | 1,000 ml |
| pH | 6.5 | 6.2 |

-continued

| | Tank Solution (g) | Replenisher (g) |
|---|---|---|
| Bleaching Solution: | | |
| 2,6-Pyridinedicarboxylic acid | 4.6 | 6.9 |
| Ferric nitrate (nonahydrate) | 5.1 | 7.7 |
| Acetic acid (90%) | 67.0 | 100.0 |
| Sodium persulfate | 30.0 | 45.0 |
| Sodium chloride | 8.7 | 13.0 |
| Aqueous ammonia (27%) | 38.0 ml | 50.0 ml |
| Water to make | 1.0 l | 1.0 l |
| pH | 4.0 | 3.7 |

According to the latter constitution of the present invention, a high-sensitivity silver halide color photographic material capable of showing excellent saturation in color reproduction, improved with respect to the adverse effect in the color reproduction due to the change in color temperature of a light source and having superior raw stock storability can be provided, which has hitherto been difficult to achieve.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon, in the order from the support side, a red-sensitive silver halide emulsion layer, a green-sensitive silver halide emulsion layer and a blue-sensitive silver halide emulsion layer, said material further comprising a light-insensitive layer disposed between said green-sensitive layer and said blue-sensitive layer and which contains at least one fine grain solid dispersion of a yellow dye represented by formula (I), and a light-insensitive layer disposed between said red-sensitive layer and said green-sensitive layer and which contains at least one fine grain solid dispersion of a magenta dye represented by formula (II):

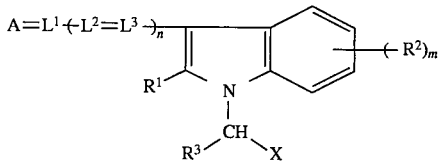

(I)

wherein A represents an acidic nucleus having at least one carboxyl group, $L^1$, $L^2$ and $L^3$ each represents a substituted or unsubstituted methine group, $R^1$ and $R^3$ each represents a hydrogen atom or a substituent, $R^2$ represents a substituent, n represents 0 or 1, m represents an integer of from 0 to 4, provided that when m is an integer of from 2 to 4, the $R^2$ groups are the same or different, and X represents an electron-withdrawing group having a Hammett's substituent constant $\sigma_m$ of from 0.3 to 1.5;

$$D\text{-}(X)_y \qquad \text{(II)}$$

wherein D represents a compound having a chromophore, X represents a dissociative proton bonded to D directly or through a divalent linking group or a group having the dissociative proton and y represents an integer of from 1 to 7.

2. The silver halide color photographic material as claimed in claim 1, wherein at least one silver halide emulsion layer contains a coupler represented by formula (M):

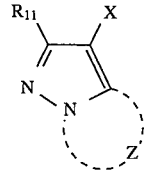

(M)

wherein $R_{11}$ represents a hydrogen atom or a substituent, Z represents a nonmetallic atom group necessary for forming a 5-membered azole ring containing from 2 to 4 nitrogen atoms, provided that said azole ring may have a substituent (including a condensed ring), and X represents a hydrogen atom or a group capable of splitting off upon coupling reaction with an oxidation product of the developing agent.

3. A silver halide color photographic material comprising a blue-sensitive silver halide emulsion layer containing a yellow coupler, a green-sensitive silver halide emulsion layer containing a magenta coupler and a red-sensitive silver halide emulsion layer containing a cyan coupler, each of said silver halide emulsion layers being comprised of at least two silver halide emulsion sublayers having different sensitivities from each other, said silver halide color photographic material further comprising (1) at least one hydrophilic colloid layer containing at least one solid disperse dye of a compound represented by formula (i) and (2) satisfying at least one of the following requirements (a) to (c):

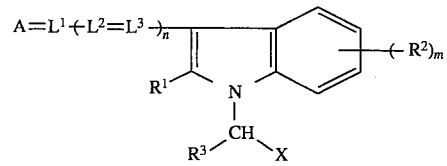

(i)

wherein A represents an acidic nucleus having at least one carboxyl group, $L^1$, $L^2$ and $L^3$ each represents a substituted or unsubstituted methine group, $R^1$ and $R^3$ each represents a hydrogen atom or a substituent, $R^2$ represents a substituent, n represents 0 or 1, m represents an integer of from 0 to 4, provided that when m is an integer of from 2 to 4, the $R^2$ groups are the same or different, and X represents an electron-withdrawing group having a Hammett's substituent constant $\sigma_m$ of from 0.3 to 1.5;

(a) a surface- and/or inside-fogged silver halide emulsion is contained in a light-sensitive silver halide emulsion layer or a layer adjacent to a light-sensitive silver halide emulsion layer;

(b) a DIR compound represented by formula (F) is contained in a light-sensitive silver halide emulsion layer or a light-insensitive layer;

$$A\text{—}(L)_n\text{—}(G)_m\text{—}(Time)_t\text{—}X \qquad \text{(F)}$$

wherein A represents a redox mother nucleus or a precursor thereof which is a group able to first allow —$(Time)_t$—X to split off when the group is oxidized in the process of photographic development processing, Time represents a group capable of releasing X after the release of the —$(Time)_t$—X group and may have a timing controlling function, X represents a development inhibitor, L represents a divalent linking group, G represents an acidic group and n, m and t each represents 0 or 1, provided that when n is 1, m is not 0; and (c) a compound represented by formula (ii) is contained in at least one emulsion layer:

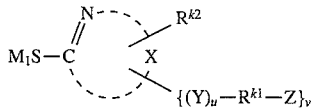

(ii)

wherein $M_1$ represents a hydrogen atom, a cation or a protective group of the mercapto group to be cleaved in an alkali, X represents an atomic group necessary for forming a 5- or 6-membered heterocyclic ring (which may be substituted or condensed), with two or three nitrogen atoms being present in the five or six atoms constituting said heterocyclic ring, $R^{k1}$ represents a linear or branched alkylene, alkenylene, aralkylene or arylene group, Y represents a divalent polar linking group, $R^{k2}$ represents a hydrogen atom or a group capable of substitution thereto, Z represents a polar substituent, u represents 0 or Z and v represents 0, Z or 2.

4. The silver halide color photographic material as claimed in claim 3, wherein said silver halide color photographic material further satisfies requirement (d):

(d) relations as defined by the following expressions are present between the average iodide content of a low speed green-sensitive silver halide emulsion layer (AgI(GL)) and the average iodide content of a low speed blue-sensitive silver halide emulsion layer (AgI(BL)), and between the average iodide content of a low speed green-sensitive silver halide emulsion layer (AgI(GL)) and the average iodide content of a low speed red-sensitive silver halide emulsion layer (AgI(RL)):

$$2 \leqq \{AgI(GL)/AgI(BL)\} \leqq 0.9$$

$$2 \leqq \{AgI(GL)/AgI(RL)\} \leqq 0.9$$

5. The silver halide color photographic material as claimed in claim 3, wherein said silver halide color photographic material is a silver halide color reversal photographic material for camera work.

6. The silver halide color photographic material as claimed in claim 4, wherein said silver halide color photographic material is a silver halide color reversal photographic material for camera work.

7. The silver halide color photographic material as claimed in claim 1, wherein X of formula (I) is selected from the group consisting of a halogen atom, a trifluoromethyl group, a cyano group, a formyl group, an acyl group, an acetyl group, an acyloxy group, a carboxy group, an alkoxycarbonyl group, an aryloxycarbonyl group, an alkylcarbamoyl group, a nitro group, an alkylsulfinyl group, an alkylsulfonyl group, and a sulfamoyl group.

8. The silver halide color photographic material as claimed in claim 7, wherein X of formula (I) is selected from the group consisting of alkoxycarbonyl and cyano.

9. The silver halide color photographic material as claimed in claim 8, wherein X of formula (I) is selected from the group consisting of methoxycarbonyl and ethoxycarbonyl.

10. The silver halide color photographic material as claimed in claim 1, wherein the acidic nucleus represented by A is selected from the group consisting of 5-pyrazolone, isooxazolone, barbituric acid, thiobarbituric acid, pyrazolopyridone, rhodanine, hydantoin, thiohydantoin, oxazolidinedione, pyrazolidinedione, indandione, hydroxypyridone, 1,2,3,4-tetrahydroquinoline-2,4-dione and 3-oxo-2,3-dihydrobenzo[d]thiophene-1,1-dioxide.

11. The silver halide color photographic material as claimed in claim 10, wherein the acidic nucleus represented by A is selected from the group consisting of 5-pyrazolone, hydroxypyridone, pyrazolopyridone, barbituric acid and isooxazolone.

12. The silver halide color photographic material as claimed in claim 11, wherein the acidic nucleus represented by A is 5-pyrazolone.

13. The silver halide color photographic material as claimed in claim 1, wherein n is zero.

14. The silver halide color photographic material as claimed in claim 1, wherein n is zero, m is zero, $R^1$ is hydrogen, $R^3$ is a hydrogen or an alkyl group, and X is an alkoxycarbonyl or a cyano group.

15. The silver halide color photographic material as claimed in claim 3, wherein X of formula (i) represents an alkoxycarbonyl group or a cyano group, and A represents an acidic nucleus substituted by a carboxyphenyl group.

16. The silver halide color photographic material as claimed in claim 3, wherein the acidic nucleus represented by A of formula (i) is selected from the group consisting of 5-pyrazolone, isooxazolone, barbituric acid, thiobarbituric acid, pyrazolopyridone, rhodanine, hydantoin, thiohydantoin, oxazolidinedione, pyrazolidinedione, indandione, hydroxypyridone, 1,2,3,4-tetrahydroquinoline-2,4-dione and 3-oxo-2,3-dihydrobenzo[d]thiophene-1,1-dioxide.

17. The silver halide color photographic material as claimed in claim 16, wherein the acidic nucleus represented by A is 5-pyrazolone.

18. The silver halide color photographic material as claimed in claim 15, wherein the acidic nucleus represented by A is 5-pyrazolone.

19. The silver halide color photographic material as claimed in claim 3, wherein n is zero.

* * * * *